US008035589B2

(12) United States Patent
Shiomi

(10) Patent No.: US 8,035,589 B2
(45) Date of Patent: Oct. 11, 2011

(54) DRIVE METHOD OF LIQUID CRYSTAL DISPLAY DEVICE, DRIVER OF LIQUID CRYSTAL DISPLAY DEVICE, PROGRAM OF METHOD AND STORAGE MEDIUM THEREOF, AND LIQUID CRYSTAL DISPLAY DEVICE

(75) Inventor: Makoto Shiomi, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 920 days.

(21) Appl. No.: 11/794,153

(22) PCT Filed: Mar. 10, 2006

(86) PCT No.: PCT/JP2006/304792

§ 371 (c)(1),
(2), (4) Date: Jun. 26, 2007

(87) PCT Pub. No.: WO2006/098246

PCT Pub. Date: Sep. 21, 2006

(65) Prior Publication Data

US 2008/0158443 A1 Jul. 3, 2008

(30) Foreign Application Priority Data

Mar. 15, 2005 (JP) ..... 2005-073926

(51) Int. Cl.
*G09G 3/36* (2006.01)

(52) U.S. Cl. ..... 345/87; 345/88; 345/89

(58) Field of Classification Search ..... 345/87, 345/88, 89

See application file for complete search history.

(56) References Cited

U.S. PATENT DOCUMENTS 5,390,293 A 2/1995 Nishioka et al.
5,488,389 A 1/1996 Nakanishi et al.

(Continued)

FOREIGN PATENT DOCUMENTS

JP 56-117483 9/1981

(Continued)

OTHER PUBLICATIONS

International Search Report for Corresponding PCT Application PCT/JP2006/305039.
International Search Report for Corresponding PCT Application PCT/JP2006/317619.
International Search Report for Corresponding PCT Application PCT/JP2006/304396.

(Continued)

*Primary Examiner* — Amare Mengistu
*Assistant Examiner* — Koosha Sharifi-Tafreshi
(74) *Attorney, Agent, or Firm* — Harness, Dickey & Pierce, P.L.C.

(57) ABSTRACT

The objective of one embodiment of the present invention is to provide a liquid crystal display device which is brighter, has a wider range of viewing angles, has a faster response speed, and has improved moving image quality. When a sub pixel performs dark display, a sub frame processing section sets video data for a sub frame at a value falling within a range for dark display, and controls the luminance of the sub pixel by increasing or decreasing video data for a sub frame. When the sub pixel performs light display, the sub frame processing section sets the video data at a value falling within a range for light display, and controls the luminance of the sub pixel by increasing or decreasing the video data. The value within the range for dark display indicates luminance brighter than black, and the sub frame processing section outputs this value as the video data, even if video data for a sub pixel indicates black display.

31 Claims, 41 Drawing Sheets

U.S. PATENT DOCUMENTS

| | | | | |
|---|---|---|---|---|
| 5,818,419 | A | 10/1998 | Tajima et al. | |
| 5,874,933 | A | 2/1999 | Hirai et al. | |
| 6,222,515 | B1 | 4/2001 | Yamaguchi et al. | |
| 6,310,588 | B1 | 10/2001 | Kawahara | |
| 6,359,663 | B1 | 3/2002 | Gadeyne et al. | |
| 6,466,225 | B1 | 10/2002 | Larkin et al. | |
| 6,542,141 | B1 | 4/2003 | Mano et al. | |
| 6,646,625 | B1 | 11/2003 | Shigeta et al. | |
| 6,771,243 | B2 | 8/2004 | Hirohata | |
| 6,803,894 | B1 | 10/2004 | Hirota et al. | |
| 6,894,669 | B2 | 5/2005 | Suzuki et al. | |
| 6,937,224 | B1 | 8/2005 | Miyachi | |
| 7,002,540 | B2 | 2/2006 | Aoki | |
| 7,123,226 | B2 | 10/2006 | Ham | |
| 7,133,015 | B1 | 11/2006 | Yoshida et al. | |
| 2001/0026256 | A1* | 10/2001 | Sugiyama | 345/87 |
| 2001/0028347 | A1 | 10/2001 | Kawahara et al. | |
| 2001/0052886 | A1 | 12/2001 | Ikeda | |
| 2002/0003520 | A1 | 1/2002 | Aoki | |
| 2002/0003522 | A1* | 1/2002 | Baba et al. | 345/89 |
| 2002/0024481 | A1* | 2/2002 | Kawabe et al. | 345/87 |
| 2002/0044105 | A1 | 4/2002 | Nagai | |
| 2002/0044151 | A1 | 4/2002 | Ijima et al. | |
| 2002/0051153 | A1 | 5/2002 | Hiyama et al. | |
| 2002/0105506 | A1 | 8/2002 | Hiyama et al. | |
| 2002/0109659 | A1 | 8/2002 | Hiroki | |
| 2003/0011614 | A1 | 1/2003 | Itoh et al. | |
| 2003/0146893 | A1 | 8/2003 | Sawabe | |
| 2003/0218587 | A1 | 11/2003 | Ikeda | |
| 2003/0227429 | A1 | 12/2003 | Shimoshikiryo | |
| 2004/0001167 | A1 | 1/2004 | Takeuchi et al. | |
| 2004/0066355 | A1 | 4/2004 | Shigeta et al. | |
| 2004/0125064 | A1 | 7/2004 | Adachi et al. | |
| 2004/0155847 | A1 | 8/2004 | Taoka et al. | |
| 2004/0239698 | A1 | 12/2004 | Kamada et al. | |
| 2004/0263462 | A1* | 12/2004 | Igarashi | 345/98 |
| 2005/0078060 | A1 | 4/2005 | Shigeta et al. | |
| 2005/0088370 | A1 | 4/2005 | Shigeta et al. | |
| 2005/0156843 | A1 | 7/2005 | Itoh et al. | |
| 2005/0162359 | A1 | 7/2005 | Sugino | |
| 2005/0162360 | A1 | 7/2005 | Ishihara et al. | |
| 2005/0184944 | A1 | 8/2005 | Miyata et al. | |
| 2005/0213015 | A1 | 9/2005 | Shimoshikiryo | |
| 2005/0253785 | A1 | 11/2005 | Miyasaka et al. | |
| 2005/0253793 | A1 | 11/2005 | Chien et al. | |
| 2005/0253798 | A1 | 11/2005 | Hiyama et al. | |
| 2006/0125765 | A1 | 6/2006 | Hiyama et al. | |
| 2006/0125812 | A1 | 6/2006 | Lee | |
| 2006/0139289 | A1 | 6/2006 | Yoshida et al. | |
| 2006/0214897 | A1 | 9/2006 | Murai | |
| 2008/0129762 | A1 | 6/2008 | Shiomi | |
| 2008/0136752 | A1 | 6/2008 | Inoue et al. | |
| 2009/0122207 | A1 | 5/2009 | Inoue et al. | |
| 2009/0167791 | A1 | 7/2009 | Shiomi | |
| 2010/0156963 | A1 | 6/2010 | Shiomi | |

FOREIGN PATENT DOCUMENTS

| | | |
|---|---|---|
| JP | 03-174186 | 7/1991 |
| JP | 04-302289 | 10/1992 |
| JP | 05-068221 | 3/1993 |
| JP | 06-083295 | 3/1994 |
| JP | 6-118928 | 4/1994 |
| JP | 07-294881 | 11/1995 |
| JP | 08-076090 | 3/1996 |
| JP | 08-114784 | 5/1996 |
| JP | 10-161600 | 6/1998 |
| JP | 10-274961 | 10/1998 |
| JP | 11-231827 | 8/1999 |
| JP | 11-352923 | 12/1999 |
| JP | 2000-29442 | 1/2000 |
| JP | 2001-56665 | 2/2001 |
| JP | 2001-60078 | 3/2001 |
| JP | 2001-184034 | 7/2001 |
| JP | 2001-281625 | 10/2001 |
| JP | 2001-296841 | 10/2001 |
| JP | 2001-350453 | 12/2001 |
| JP | 2002-23707 | 1/2002 |
| JP | 2002-091400 | 3/2002 |
| JP | 2002-108294 | 4/2002 |
| JP | 2002-131721 | 5/2002 |
| JP | 2002-229547 | 8/2002 |
| JP | 2002-236472 | 8/2002 |
| JP | 2003-22061 | 1/2003 |
| JP | 2003-058120 | 2/2003 |
| JP | 2003- 114648 | 4/2003 |
| JP | 2003-114648 | 4/2003 |
| JP | 2003-177719 | 6/2003 |
| JP | 2003-222790 | 8/2003 |
| JP | 2003-262846 | 9/2003 |
| JP | 2003-295160 | 10/2003 |
| JP | 2004-062146 | 2/2004 |
| JP | 2004-62146 | 2/2004 |
| JP | 2004-78157 | 3/2004 |
| JP | 2000-187469 | 7/2004 |
| JP | 2004-240317 | 8/2004 |
| JP | 2004-246312 | 9/2004 |
| JP | 2004-258139 | 9/2004 |
| JP | 2004-302270 | 10/2004 |
| JP | 2004-309622 | 11/2004 |
| JP | 2005-173387 | 6/2005 |
| JP | 2005-234552 | 9/2005 |
| JP | 2006-171749 | 6/2006 |
| JP | 2006-301563 | 11/2006 |
| WO | WO 03/098588 | 11/2003 |
| WO | WO 2006/030842 | 3/2006 |
| WO | WO 2006/030842 A1 | 3/2006 |
| WO | WO 2006/098194 | 9/2006 |
| WO | WO 2006/098246 | 9/2006 |
| WO | WO 2006/098328 | 9/2006 |
| WO | WO 2006/100906 | 9/2006 |
| WO | WO 2006/100988 | 9/2006 |
| WO | WO 2007/060783 | 5/2007 |

OTHER PUBLICATIONS

Handbook of Color Science, second edition, University of Tokyo Press, published on Jun. 10, 1998, pp. 92-93, pp. 362-367 (partial translation).

Sang Soo Kim, 15.4: Invited Paper: Super PVA Sets New State-of-the-Art for LCD-TV, SID 04 Digest, 2004, pp. 760-pp. 763.

Jang-Kun Song, et al., 48.2: DCCII: Novel Method for Fast Response Time in PVA Mode, SID 04 Digest, 2004, pp. 1344-pp. 1347.

International Search Report for Corresponding PCT Application PCT/JP2006/304792.

U.S. Office Action mailed Sep. 1, 2010 for corresponding U.S. Appl. No. 11/794,153.

U.S. Office Action mailed Aug. 18, 2010 for corresponding U.S. Appl. No. 11/884,230.

U.S. Office Action mailed Sep. 14, 2010 for corresponding U.S. Appl. No. 11/886,226.

U.S. Office Action mailed Sep. 23, 2010 for corresponding U.S. Appl. No. 11/794,948.

Written Opinion for PCT/JP2006/305039.

International Search Report for PCT/JP2006/304433.

International Search Report dated Apr. 25, 2006 issued in International Application No. PCT/JP2006/305172.

Written Opinion dated Jun. 1, 2006 issued in International Application No. PCT/JP2006/305172.

Written Opinion dated Dec. 12, 2006 issued in International Application No. PCT/JP2006/317619.

U.S. Office Action dated Sep. 27, 2010 issued in co-pending U.S. Appl. No. 11/883,941.

U.S. Office Action dated Mar. 15, 2011 for U.S. Appl. No. 11/883,941.

U.S. Office Action dated Mar. 11, 2011 for U.S. Appl. No. 11/794,948.

U.S. Office Action dated Feb. 18, 2011 for U.S. Appl. No. 11/884,230.

U.S. Office Action dated Jun. 15, 2011 for U.S. Appl. No. 11/884,230.

U.S. Office Action dated Aug. 17, 2011 for U.S. Appl. No. 12/085,461.

* cited by examiner

FIG. 14

| So1 | So2 | AVERAGE LUMINANCE | CONTRAST |
|---|---|---|---|
| 0.001 | 0.001 | 0.001 | 1000 |
| 0.002 | 0.001 | 0.001142 | 876 |
| 0.003 | 0.001 | 0.001283 | 779 |
| 0.004 | 0.001 | 0.001425 | 702 |
| 0.005 | 0.001 | 0.001567 | 638 |
| 0.006 | 0.001 | 0.001709 | 585 |
| 0.007 | 0.001 | 0.001850 | 540 |
| 0.008 | 0.001 | 0.001992 | 502 |
| 0.009 | 0.001 | 0.002134 | 469 |
| 0.010 | 0.001 | 0.002275 | 439 |
| 0.011 | 0.001 | 0.002417 | 414 |
| 0.012 | 0.001 | 0.002559 | 391 |
| 0.013 | 0.001 | 0.002701 | 370 |
| 0.014 | 0.001 | 0.002842 | 352 |
| 0.015 | 0.001 | 0.002984 | 335 |
| 0.016 | 0.001 | 0.003126 | 320 |
| 0.017 | 0.001 | 0.003267 | 306 |
| 0.018 | 0.001 | 0.003409 | 293 |
| 0.019 | 0.001 | 0.003551 | 282 |
| 0.020 | 0.001 | 0.003693 | 271 |
| 0.021 | 0.001 | 0.003834 | 261 |
| 0.022 | 0.001 | 0.003976 | 252 |
| 0.023 | 0.001 | 0.004118 | 243 |
| 0.024 | 0.001 | 0.004259 | 235 |
| 0.025 | 0.001 | 0.004401 | 227 |
| 0.026 | 0.001 | 0.004543 | 220 |
| 0.027 | 0.001 | 0.004684 | 213 |
| 0.028 | 0.001 | 0.004826 | 207 |
| 0.029 | 0.001 | 0.004968 | 201 |
| 0.030 | 0.001 | 0.005110 | 196 |
| 0.031 | 0.001 | 0.005251 | 190 |
| 0.032 | 0.001 | 0.005393 | 185 |
| 0.033 | 0.001 | 0.005535 | 181 |
| 0.034 | 0.001 | 0.005676 | 176 |
| 0.035 | 0.001 | 0.005818 | 172 |
| 0.036 | 0.001 | 0.005960 | 168 |
| 0.037 | 0.001 | 0.006102 | 164 |
| 0.038 | 0.001 | 0.006243 | 160 |

DRIVE METHOD OF LIQUID CRYSTAL DISPLAY DEVICE, DRIVER OF LIQUID CRYSTAL DISPLAY DEVICE, PROGRAM OF METHOD AND STORAGE MEDIUM THEREOF, AND LIQUID CRYSTAL DISPLAY DEVICE

TECHNICAL FIELD

The present invention relates to a drive method of a liquid crystal display device which is brighter, has a wider range of viewing angles, has a faster response speed, and has improved moving image quality, and the present invention also relates to a driver of the liquid crystal display device, a program of the method and a storage medium thereof, and the liquid crystal display device.

As described in, for example, the patent documents 1-5 below, there are commonly used display devices which divide a frame for one screen into plural sub frames in a time-sharing fashion. According to the documents, the quality of moving images is improved such that impulse-type light emission typified by CRTs (Cathode-Ray Tube) is simulated by a hold-type display device such as a liquid crystal display device by providing a black display or dark display period in one frame period.

Also, as taught by the patent document 6 below, the response speed of a liquid crystal display device is improved by modulating a drive signal in such a way as to emphasize grayscale transition between two frames.

In the meanwhile, the non-patent documents 1 and 2 below teach that an overshoot signal is supplied to a pixel after the supply of a pre-tilt signal thereto, in order to improve the response speed of a liquid crystal cell in the PVA (Patterned Vertical Alignment) mode.

[Patent Document 1]
Japanese Laid-Open Patent Application No. 4-302289 (published on Oct. 26, 1994)
[Patent Document 2]
Japanese Laid-Open Patent Application No. 5-68221 (published on Mar. 19, 1995)
[Patent Document 3]
Japanese Laid-Open Patent Application No. 2001-281625 (published on Oct. 10, 2001)
[Patent Document 4]
Japanese Laid-Open Patent Application No. 2002-23707 (published on Jan. 25, 2002)
[Patent Document 5]
Japanese Laid-Open Patent Application No. 2003-22061 (published on Jan. 24, 2003)
[Patent Document 6]
Japanese Patent No. 2650479 (issued on Sep. 3, 1997)
[Patent Document 7]
Japanese Laid-Open Patent Application No. 2003-295160 (published on Oct. 15, 2003)
[Patent Document 8]
Japanese Laid-Open Patent Application No. 2004-62146 (published on Feb. 26, 2004)
[Patent Document 9]
Japanese Laid-Open Patent Application No. 2004-78157 (published on Mar. 11, 2004)
[Patent Document 10]
Japanese Laid-Open Patent Application No. 2004-258139 (published on Sep. 16, 2004)
[Non-Patent Document 1]
Sang Soo Kim, 15.4: Invited Paper: Super PVA Sets New State-of-the-Art for LCD-TV, SID 04 DIGEST, 2004, pp 760-pp 763

[Non-Patent Document 2]
Jang-Kun Song, et al., 48.2:DCCII: Novel Method for Fast Response Time in PVA Mode, SID 04 DIGEST, 2004, pp 1344-pp 1347
[Non-Patent Document 3]
Handbook of Color Science; second edition (University of Tokyo Press, published on Jun. 10, 1998)

DISCLOSURE OF INVENTION

However, the improvement in the quality of moving images is insufficient in all of the arrangements above. It is therefore required a liquid crystal display device which is brighter, has a wider range of viewing angles, has a faster response speed, and has improved moving image quality.

The present invention was done to solve the problem above, and the objective of the present invention is to provide a method of driving a liquid crystal display device which is brighter, has a wider range of viewing angles, has a faster response speed, and has improved moving image quality, a driver of the liquid crystal display device, its program and storage medium, and the liquid crystal display device.

To achieve the objective above, a drive method of a liquid crystal display device of the present invention, which drives a liquid crystal cell in a vertical alignment mode by a normally black mode (in which black display is performed when no voltage is applied), is characterized by comprising the step of: (i) generating predetermined plural sets of output video data supplied to a pixel, in response to each input cycle of inputting input video data to the pixel, said plural sets of output video data being generated for driving the pixel in a time-sharing fashion, the step (i) including the sub steps of: (I) in case where the input video data indicates luminance lower than a predetermined threshold, setting luminance of at least one of said plural sets of output video data to be at a value within a predetermined luminance range for dark display, and controlling a time integral value of the luminance of the pixel in periods in which the pixel is driven based on said plural sets of output video data, by increasing or decreasing at least one of the remaining sets of output video data; and (II) in case where the input video data indicates luminance higher than the predetermined threshold, setting at least one of said plural sets of output video data to be at a value within a predetermined luminance range for light display, and controlling a time integral value of the luminance of the pixel in periods in which the pixel is driven based on said plural sets of output video data, by increasing or decreasing at least one of the remaining sets of output video data, in the sub step (I), at least one of said plural sets of output video data indicating luminance other than black, when the input video data indicates black. When the input video data indicates black, at least two of said plural sets of output video data may be set at values different from one another. The value indicating the luminance within the predetermined range for dark display may be set at a value which does not indicate black. When the input video data indicates black, a set of output video data in the last period among periods in which the pixel is driven based on the respective sets of output video data may be set at a value indicating the luminance other than black, among said plural sets of output video data.

According to the arrangement above, when the input video data indicates luminance lower than a predetermined threshold (i.e. in the case of dark display), at least one of said plural sets of output video data is set at a value indicating luminance within a predetermined range for dark display (i.e. luminance for dark display), and at least one of the remaining sets of output video data is increased or decreased to control a time integral value of the luminance of the pixel in the periods in which the pixel is driven based on said plural output video data. Therefore, in most cases, the luminance of the pixel in the period (dark display period) in which the pixel is driven based on the output video data indicating luminance for dark display is lower than the luminance in the remaining periods.

On the other hand, when the input video data indicates luminance higher than the predetermined threshold (i.e. in the case of light display), at least one of said plural sets of output video data is set at a value indicating luminance within a predetermined range for light display (i.e. luminance for light display), and one of the remaining sets of output video data is increased or decreased to control a time integral value of the luminance of the pixel in the periods in which the pixel is driven based on said plural sets of output video data. Therefore, in most cases, the luminance of the pixel in the periods other than the period (light display period) in which the pixel is driven based on the output video data indicating luminance for light display is lower than the luminance in the light display period.

As a result, in most cases, it is possible to provide a period in which luminance of the pixel is lower than that of the other periods, at least once in each input cycle. It is therefore possible to improve the quality in moving images displayed on the liquid crystal display device. Also, when light display is performed, luminance indicated by the input video data increases as luminance of the pixel in the periods other than the light display period increases. On this account, it is possible to increase a time integral value of the luminance of the pixel in the whole input cycle as compared to a case where dark display is performed at least once in each input cycle. Therefore a liquid crystal display device which can perform brighter display can be realized.

Even if the luminance of the pixel in the periods other than the light display period is high, the quality in moving images can be improved on condition that the luminance in the light display period is sufficiently different from the luminance in the periods other than the light display period. It is therefore possible to improve the quality in moving images in most cases.

Even if the liquid crystal display device is in the vertical alignment mode, the range of viewing angles in which luminance is maintained at an allowable value is widened when the luminance of the pixel is close to the maximum or minimum, as compared to a case where the luminance of the pixel has an intermediate value. This is because, when the luminance is close to the maximum or minimum, the alignment of the liquid crystal molecules is simple and easily correctable on account of a requirement of contrast and because visually suitable results can be easily obtained, and hence a viewing angle at the maximum or minimum (in particular, a part close to the minimum luminance) is selectively assured. On this account, if time-sharing drive is not performed, a range of viewing angles in which intermediate luminance can be suitably reproduced is narrowed, and problems such as whitish appearance may occur when the display device is viewed at an angle out of the aforesaid range.

According to the arrangement above, in the case of dark display, one of the sets of output video data is set at a value indicating luminance for dark display. It is therefore possible to widen the range of viewing angles in which the luminance of the pixel falls within an allowable range. Similarly, in the case of light display, one of the sets of output video data is set at a value indicating luminance for light display. It is therefore possible to widen the range of viewing angles in which the luminance of the pixel falls within an allowable range, in the light display period. As a result, problems such as whitish appearance can be prevented in comparison with the arrangement in which the time-sharing drive is not performed, and hence the range of viewing angles can be increased.

When a liquid crystal cell in a vertical alignment mode is driven by a normally black mode, the orientation (in-plane component, of the alignment direction, which is in parallel to the substrate) and the tilt angle (angle between the direction orthogonal to the substrate and the alignment direction) of liquid crystal molecules must be determined, in order to tilt the liquid crystal molecules which are substantially vertically aligned, by applying an electric field. On the other hand, the tilt angle of the liquid crystal molecules whose orientation has been determined is determined in accordance with an electric field. As a result, when a liquid crystal cell in a vertical alignment mode is driven by a normally black mode, a response speed from a state where the pixel indicates black to intermediate luminance is slower than a response speed from a state of dark display brighter than black to the intermediate luminance.

In this connection, according to the arrangement above, in the step (I), at least one of said plural output video data generated when the input video data indicates black indicates luminance other than black. As a result, the speed to respond to intermediate luminance is significantly improved as compared to a case where all sets of video data are set so as to have a value indicating black when the input video data indicates black, and hence the quality of moving images is significantly improved. It is noted that, when the luminance other than black is sufficiently dark, the user recognizes black color on the pixel even if the pixel does not actually display black color.

As a result, it is possible to realize a method of driving a liquid crystal display device which is brighter, has a wider range of viewing angles, has a faster response speed, and has improved moving image quality.

To achieve the objective above, a drive method of a liquid crystal display device of the present invention, which drives a liquid crystal cell in a vertical alignment mode by a normally black mode, is characterized by comprising the steps of: (i) in case where input video data which is input to a pixel of a liquid crystal panel indicates luminance lower than a predetermined threshold value, setting luminance of the pixel in at least one divided periods at luminance falling within a predetermined range for dark display, and controlling luminance of the pixel in the remaining divided periods so as to control a time integral value of luminance of the pixel in a unit period for drive based on the input video data, the divided periods being generated by dividing the unit period into plural periods; and (ii) in case where the input video data indicates luminance higher than the predetermined threshold value, setting luminance of the pixel in at least one of the divided periods at luminance falling within a predetermined range for light display, and controlling luminance of the pixel in the remaining divided periods so as to control a time integral value of luminance of the pixel in the unit period, in the step (i), in at least one of said divided periods, luminance of the pixel being controlled so as to be luminance other than black, when the input video data indicates black. When the input video data indicates black, at least two of said plural sets of output video data may be set at values different from one another. The value indicating the luminance within the predetermined range for dark display may be set at a value which does not indicate black. When the input video data indicates black, a set of output video data in the last divided period among the plural divided periods may be set at a value indicating the luminance other than black.

According to this arrangement, being similar to the aforesaid drive method of the liquid crystal display device, in most cases, it is possible to provide a divided period in which luminance of the pixel is lower than that of the other divided periods, at least once in each unit period. It is therefore possible to improve the quality in moving images displayed on the liquid crystal display device. Also, when light display is performed, luminance indicated by the input video data increases as luminance of the pixel in the periods other than the divided period in which luminance is set within the predetermined range for light display (i.e. in the periods other than the light display period) increases. On this account, a liquid crystal display device which can perform brighter display can be realized.

Also, according to this arrangement, being similar to the aforesaid drive method of the liquid crystal display device, when the input video data indicates black, luminance other than black is obtained in at least one of the divided periods. As a result, the speed to respond to intermediate luminance is significantly increased as compared to a case where black display is performed in all divided periods when the input video data indicates black, and hence the quality in moving images is significantly improved.

As a result, it is possible to realize a method of driving a liquid crystal display device which is brighter, has a wider range of viewing angles, has a faster response speed, and has improved moving image quality.

To achieve the objective above, a driver of the liquid crystal display device of the present invention, which drives a liquid crystal cell in a vertical alignment mode by a normally black mode, is characterized by comprising generation means for generating predetermined plural sets of output video data supplied to a pixel and corresponding to respective input cycles, in response to each of the input cycles of inputting input video data to the pixel, said plural sets of output video data being generated for driving the pixel in a time-sharing fashion, the generation means performing control so as to: (i) in case where the input video data indicates luminance lower than a predetermined threshold, set luminance of at least one of said plural sets of output video data at a value within a predetermined luminance range for dark display, and control a time integral value of the luminance of the pixel in periods in which the pixel is driven based on said plural sets of output video data, by increasing or decreasing at least one of the remaining sets of output video data; and (ii) in case where the input video data indicates luminance higher than the predetermined threshold, set luminance of at least one of said plural sets of output video data at a value within a predetermined luminance range for light display, and control a time integral value of the luminance of the pixel in periods in which the pixel is driven based on said plural sets of output video data, by increasing or decreasing at least one of the remaining sets of output video data, and the generation means setting at least one of said plural sets of output video data at a value indicating luminance other than black, when the input video data indicates black.

In addition to the above, the generation means may set at least two of said plural output video data at values different from one another, when the input video data indicates black. Also, in addition to the above, the value indicating luminance within the predetermined range for dark display may be set at a value not indicating black. Also, in addition to the above, when the input video data indicates black, the generation means sets, among said plural sets of output video data, a set of output video data of the last period of the periods in which the pixel is driven based on said plural sets of output video data is set at a value indicating luminance other than black.

In these arrangements, being similar to the aforesaid driver of the liquid crystal display device, in most cases, it is possible to provide a period in which luminance of the pixel is lower than that of the other periods, at least once in each input cycle. It is therefore possible to improve the quality in moving images displayed on the liquid crystal display device. Also, when light display is performed, luminance indicated by the input video data increases as luminance of the pixel in the periods other than the light display period increases. On this account, a liquid crystal display device which can perform brighter display can be realized.

Also, according to the arrangement above, being similar to the aforesaid drive method of the liquid crystal display device, at least one of said plural sets of output video data generated when the input video data indicates black indicates luminance other than black. As a result, the speed to respond to intermediate luminance is significantly improved as compared to an arrangement in which all output video data is set at a value indicating black, and hence the quality in moving images is significantly improved.

As a result, it is possible to realize a liquid crystal display device which is brighter, has a wider range of viewing angles, has a faster response speed, and has improved moving image quality.

Also, in addition to the above, the generation means may control the time integral value by increasing or decreasing particular output video data which is a particular one of the remaining sets of output video data, and may set the remaining sets of output video data other than the particular output video data at either a value indicating luminance falling within the predetermined range for dark display or a value indicating luminance falling within the range for light display.

According to this arrangement, among said plural sets of output video data, the sets of video data other than the particular output video data are set either at a value indicating luminance within the predetermined range for dark display or a value indicating luminance within the predetermined range for light display. On this account, problems such as whitish appearance are further prevented and the range of viewing angles is further increased, as compared to a case where the sets of video data other than the particular output video data are set at values included neither one of the aforesaid ranges.

Also, in addition to the above, provided that the periods in which the pixel is driven by said plural sets of output video data are divided periods whereas a period constituted by the divided periods and in which the pixel is driven by said plural sets of output video data is a unit period, the generation means may select, as the particular output video data, a set of output video data corresponding to a divided period which is closest to a temporal central position of the unit period, among the divided periods, in a region where luminance indicated by the input video data is lowest, and when luminance indicated by the input video data gradually increases and hence the particular output video data enters the predetermined range for light display, the generation means may set the set of video data in that divided period at a value falling within the range for light display, and may select, as new particular output video data, a set of output video data in a divided period which is closest to the temporal central position of the unit period, among the remaining divided periods.

According to the arrangement above, the temporal barycentric position of the luminance of the pixel in the unit period is set at around the temporal central position of the unit period, irrespective of the luminance indicated by the input video data. On this account, the following problem can be prevented: on account of a variation in the temporal varycentric position, needless light or shade, which is not viewed in a still image, appears at the anterior end or the posterior end of a moving image, and hence the quality of moving images is deteriorated. It is therefore possible to improve the quality of moving images.

Also, in addition to the above, a ratio between the periods in which the pixel is driven based on said plural sets of output video data may be set so that a timing to determine which set of output video data is selected as the particular output video data is closer to a timing at which a range of brightness that the pixel can reproduce is equally divided than a timing at which luminance that the pixel can reproduce is equally divided.

According to this arrangement, it is possible to determine which luminance of the output video data is mainly used for controlling the time integral value of the luminance of the pixel in the periods in which the pixel is driven based on said plural sets of output video data, with appropriate brightness. On this account, it is possible to further reduce human-recognizable whitish appearance as compared to a case where the determination is made at a timing to equally dividing a range of luminance, and hence the range of viewing angles is further increased.

Also, in addition to the above, the driver may be further provided with correction means which is provided prior to or subsequent to the generation means, corrects correction target data which is either the input video data or said plural output video data, and predicts luminance at which the pixel reaches at the end of a drive period of the correction target data, the drive period being a period in which the pixel is driven based on the corrected correction target data, the correction means correcting correction target data of a present time based on a prediction result, among past prediction results, which indicates luminance that the pixel reaches at the beginning of a drive period of the correction target data of the present time, and predicts luminance at the end of the drive period of the correction target data of the present time, at least based on the correction target data of the present time, among the past prediction results, past correction target data, and the correction target data of the present time.

The luminance at the end of the drive period may be luminance indicated by the correction target data of the present time. In this case, although an error occurs to a certain extent when the response speed of the pixel is slow, an arrangement for the prediction can be simplified because the correction target data of the present time can be used as a prediction result. On the other hand, although an arrangement for the prediction is complicated as compared to the case where the correction target data of the present time is used as a prediction result, luminance at the end can be precisely predicted even if the response speed of the pixel is slow, when the prediction is carried out based on at least two of the followings: past prediction results, past correction target data, and correction target data of the present time.

According to the arrangement above, among the past prediction results, the correction target data of the present time is corrected based on the prediction result indicating the luminance at which the pixel reaches at the beginning of the drive period of the correction target data of the present time. It is therefore possible to increase the response speed of the pixel and increase the types of liquid crystal display devices which can be driven by the aforesaid driver.

More specifically, when the pixel is time-shared, the pixel is required to have a faster response speed than a case of no time sharing. If the response speed of the pixel is sufficient, the luminance of the pixel at the end of the drive period of the present time reaches the luminance indicated by the correction target data of the present time, even if the correction target data of the present time is output without referring to the prediction result. However, if the response speed of the pixel is insufficient, it is difficult to cause the luminance of the pixel at the end to reach the luminance indicated by the correction target data of the present time, if the correction target data of the present time is output without referring to the prediction result. On this account, the types of liquid crystal display devices that the time-sharing driver can drive are limited in comparison with the case where no time sharing is performed.

In this regard, according to the arrangement above, the correction target data of the present time is corrected in accordance with the prediction result. On this account, when, for example, the response speed seems insufficient, a process in accordance with the prediction result, e.g. increase in the response speed of the pixel by emphasizing the grayscale transition, is possible. It is therefore possible to increase the response speed of the pixel.

A liquid crystal display device of the present invention is characterized by comprising any one of the aforesaid drivers of the liquid crystal display device and a liquid crystal display device driven by that driver. Therefore, being similar to the aforesaid driver of the liquid crystal display device, it is possible to realize a liquid crystal display device which is brighter, has a wider range of viewing angles, has a faster response speed, and has improved moving image quality.

A liquid crystal display device of the present invention includes a liquid crystal cell in a vertical alignment mode and a driver which is driven by a normally black mode, and the liquid crystal display device is characterized in that the driver performs control so as to: (i) in case where input video data which is input to a pixel of a liquid crystal panel indicates luminance lower than a predetermined threshold value, set luminance of at least one divided periods at luminance falling within a predetermined range for dark display, and control luminance of the pixel in the remaining divided periods so as to control a time integral value of luminance of the pixel in a unit period for drive based on the input video data, the divided periods being generated by dividing the unit period into plural periods; and (ii) in case where the input video data indicates luminance higher than the predetermined threshold value, set luminance of the pixel in at least one of the divided periods at luminance falling within a predetermined range for light display, and control luminance of the pixel in the remaining divided periods so as to control a time integral value of luminance of the pixel in the unit period, in the control (i), in at least one of said divided periods, luminance of the pixel being controlled so as to be luminance other than black, when the input video data indicates black.

In this arrangement, being similar to the aforesaid drive method of the liquid crystal display device, in most cases, it is possible to provide a period in which luminance of the pixel is lower than that of the other divided periods, at least once in each unit period. It is therefore possible to improve the quality in moving images displayed on the liquid crystal display device. Also, when light display is performed, luminance indicated by the input video data increases as luminance of the pixel in the periods other than the divided period in which luminance is set within the predetermined range for light display (i.e. the periods other than the light display period) increases. Therefore a liquid crystal display device which can perform brighter display can be realized. Also, according to the arrangement above, being similar to the aforesaid drive method of the liquid crystal display device, when the input video data indicates black, luminance other than black is obtained in at least one of the divided periods. As a result, the speed to respond to intermediate luminance is significantly increased as compared to a case where black display is performed in all divided periods when the input video data indicates black, and hence the quality in moving images is significantly improved.

In addition to the above, the driver may control the time integral value by increasing or decreasing luminance in a particular divided period which is particular one of the remaining divided periods, and may set luminance in the divided periods other than the particular divided periods either at a value indicating luminance falling within the predetermined range for dark display or at a value indicating luminance falling within the predetermined range for light display.

According to this arrangement, in the divided periods other than the particular divided period, the luminance of the pixel is set either at a value indicating luminance falling within the predetermined range for dark display or at a value indicating luminance falling within the predetermined range for light display. It is therefore possible to further prevent problems such as whitish appearance and widen the range of viewing angles, as compared to a case where luminance which is included in neither of the ranges above is obtained in the divided periods other than the particular divided period.

In addition to the above, in a region where the luminance indicated by the input video data is lowest, the driver selects, as the particular divided period, a divided period which is closest to a temporal central position of the unit period, among the divided periods, and when luminance indicated by the input video data gradually increases and hence the luminance of the particular divided period enters the predetermined range for light display, the driver sets the luminance of the particular divided period at a value falling within the range for light display, and selects, as new particular divided period, a divided period which is closest to the temporal central position of the unit period, among the remaining divided period According to the arrangement above, the temporal barycentric position of the luminance of the pixel in the unit period is set at around the temporal central position of the unit period, irrespective of the luminance indicated by the input video data. On this account, the following problem can be prevented: on account of a variation in the temporal varycentric position, needless light or shade, which is not viewed in a still image, appears at the anterior end or the posterior end of a moving image, and hence the quality of moving images is deteriorated. It is therefore possible to improve the quality of moving images.

In addition to the above, a ratio between the divided periods may be set so that a timing to determine which divided period is selected as the particular divided period is closer to a timing at which a range of brightness that the pixel can reproduce is equally divided than a timing at which luminance that the pixel can reproduce is equally divided.

According to this arrangement, it is possible to determine in which sub frame the luminance to be mainly used for controlling the time integral value of the luminance of the pixel in the unit time is attained, with appropriate brightness. On this account, it is possible to further reduce human-recognizable whitish appearance as compared to a case where the determination is made at a timing to equally dividing a range of luminance, and hence the range of viewing angles is further increased.

In addition to the above, the liquid crystal display device may further include image receiving means which receives television broadcast and sends, to the driver of the liquid crystal display device, a video signal indicating an image transmitted by the television broadcast, and the liquid crystal display device may function as a liquid crystal television receiver. Also, in addition to the above, the driver of the liquid crystal display device may receive a video signal from outside, and the liquid crystal display device may function as a liquid crystal monitor device which displays an image indicated by the video signal.

According to these arrangements, the liquid crystal display device functions as a liquid crystal television receiver or a liquid crystal monitor device. On this account, it is possible to realize a liquid crystal television receiver or a liquid crystal monitor device which is brighter, has a wider range of viewing angles, has a faster response speed, and has improved moving image quality.

The device for controlling the liquid crystal display device may be realized by hardware or by causing a computer to execute a program. More specifically, a program of the present invention causes a computer, which controls a liquid crystal display device including a liquid crystal cell which is in a vertical alignment mode and driven by a normally black mode, to execute the steps of any one of the aforesaid drive methods. A storage medium of the present invention stores this program.

When such a program is executed by a computer, the computer can control the liquid crystal display device in accordance with the above-described drive method of the liquid crystal display device. Therefore, being similar to the aforesaid drive method of the liquid crystal display device, it is possible to provide a liquid crystal television receiver or a liquid crystal monitor device which is brighter, has a wider range of viewing angles, has a faster response speed, and has improved moving image quality.

As described above, according to the present invention, luminance other than black is attained in at least one of the divided periods when the input video data indicates black. On this account, it is possible to provide a liquid crystal television receiver or a liquid crystal monitor device which is brighter, has a wider range of viewing angles, has a faster response speed, and has improved moving image quality. The present invention can therefore be adopted as a driver of various liquid crystal display devices such as a liquid crystal television receiver and a liquid crystal monitor.

Additional objects, features, and strengths of the present invention will be made clear by the description below. Further, the advantages of the present invention will be evident from the following explanation in reference to the drawings.

BRIEF DESCRIPTION OF DRAWINGS

FIG. 3(*b*) is a block diagram showing the substantial part of a liquid crystal monitor device provided with the foregoing image display device.

FIG. 8 is a graph showing the difference in luminance between a case where a pixel which is driven in non-time-sharing fashion is obliquely viewed and a case where that pixel is viewed head-on.

FIG. 9 is a graph showing the difference in luminance between a case where a pixel which is driven in response to a video signal from the signal processing circuit is obliquely viewed and a case where that pixel is viewed head-on.

FIG. 14 shows results of evaluations of average luminance and contrast ratios in black display, while luminance of a sub frame in dark display is variously changed.

FIG. 21(*b*) illustrates another method of reversing the polarity of an interelectrode voltage in each frame.

FIG. 22(*b*) is provided for illustrating the response speed of liquid crystal and shows an interelectrode voltage.

FIG. 22(*c*) is provided for illustrating the response speed of liquid crystal, and shows an interelectrode voltage when the response speed of the liquid crystal is low.

FIG. 24(*b*) is a graph showing transition of a liquid crystal voltage in case where the polarity of the voltage (liquid crystal voltage) applied to liquid crystal is changed in each sub frame.

FIG. 25(*b*) illustrates a method of reversing the polarity of an interelectrode voltage in each frame, and shows a case where the polarity of the liquid crystal voltage is opposite between two sub frames in one frame, and the second sub frame and the first sub frame of the directly subsequent frame have the same polarity.

FIG. 26(*b*) is another explanatory drawing of four sub pixels in a liquid crystal panel and polarities of liquid crystal voltages of the respective pixels.

FIG. 26(*c*) is another explanatory drawing of four sub pixels in a liquid crystal panel and polarities of liquid crystal voltages of the respective pixels.

FIG. 26(*d*) is another explanatory drawing of four sub pixels in a liquid crystal panel and polarities of liquid crystal voltages of the respective pixels.

FIG. 28(*b*) is a graph showing a voltage (liquid crystal voltage) applied to the liquid crystal capacity of a partial pixel when a negative (≦Vcom) display signal is applied to a source line S, and illustrates a case where an auxiliary signal on an auxiliary capacity line CS1 falls.

FIG. 28(*c*) is a graph showing a voltage (liquid crystal voltage) applied to the liquid crystal capacity of a partial pixel when a positive (≧Vcom) display signal is applied to a source line S, and illustrates a case where an auxiliary signal on an auxiliary capacity line CS2 falls.

FIG. 28(*d*) is a graph showing a voltage (liquid crystal voltage) applied to the liquid crystal capacity of a partial pixel when a negative (≦Vcom) display signal is applied to a source line S, and illustrates a case where an auxiliary signal on an auxiliary capacity line CS2 rises.

FIG. 30(*b*) is a graph showing a liquid crystal voltage in a partial pixel (light pixel) whose luminance increases in the pixel division drive.

FIG. 30(*c*) is a graph showing a liquid crystal voltage in a partial pixel (dark pixel) whose luminance decreases in the pixel division driving.

FIG. 31(*b*) is a graph showing the luminance of the dark pixel of FIG. 30(*c*).

FIG. 32(*b*) is a graph showing the luminance of the dark pixel in case where polarity reversal is carried out in each frame.

FIG. 34(*b*) is a graph showing the luminance of a dark pixel in case where polarity reversal is carried out in a sub frame cycle.

BEST MODE FOR CARRYING OUT THE INVENTION

First Embodiment

The following will describe an embodiment of the present invention with reference to FIGS. 1-38. An image display device of the present embodiment is a liquid crystal display device which is brighter, has a wider range of viewing angles, has a faster response speed, and can improve the quality of moving images, because luminance is controlled so as not to be black in at least one of divided periods (e.g. sub frames) even if input video data indicates black. The image display device of the present embodiment may be suitably used as, for example, an image display device of a television receiver. Examples of television broadcasts that the television receiver can receive include terrestrial television broadcast, satellite broadcasts such as BS (Broadcasting Satellite) digital broadcast and CS (Communication Satellite) digital broadcast, and cable television broadcast.

The overall arrangement of the image display device of the present embodiment will be briefed, before discussing a signal processing circuit for setting the luminance not to be black in at least one of sub frames even if input video data indicates black.

Figure 2:
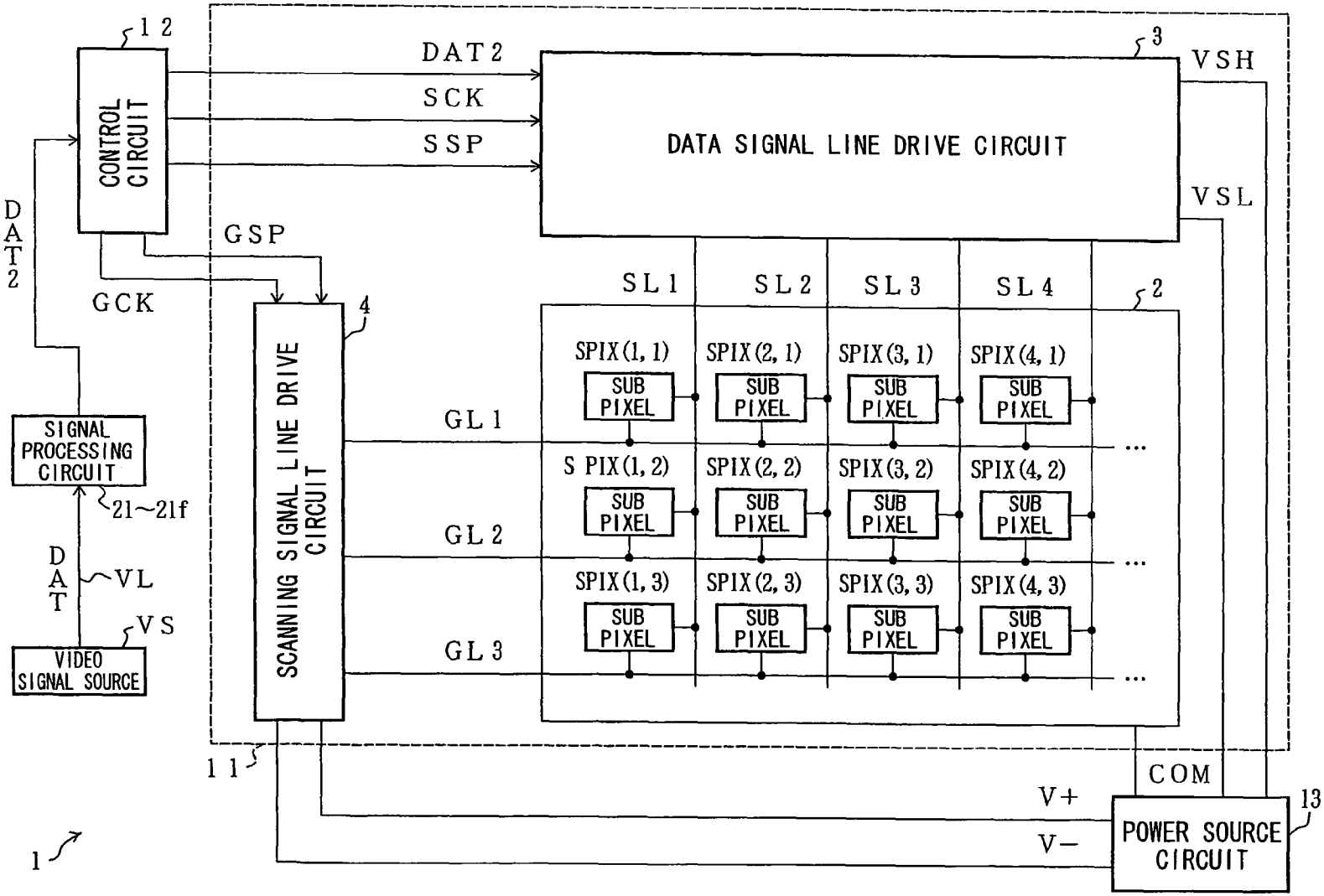
FIG. 2 is a block diagram showing the substantial part of the image display device.

A panel 11 of the image display device (display device) 1 can display color images in such a manner that, for example, one pixel is constituted by three sub pixels corresponding to R, G, and B, respectively, and the luminance of each sub pixel is controlled. The panel 11 includes, for example, as shown in FIG. 2, a pixel array (display section) 2 having sub pixels SPIX (1, 1) to SPIX (n, m) provided in a matrix manner, a data signal line drive circuit 3 which drives data signal lines SL1-SLn on the pixel array 2, and a scanning signal line drive circuit 4 which drives scanning signal lines GL1-GLm on the pixel array 2. The image display device 1 is also provided with a control circuit 12 which supplies control signals to the drive circuits 3 and 4; and a signal processing circuit 21 which generates, based on a video signal DAT supplied from a video signal source VS, a video signal DAT2 which is supplied to the control circuit 12. These circuits operate thanks to power supply from a power source circuit 13. In the present embodiment, furthermore, one pixel PIX is constituted by three sub pixels SPIX which are provided side-by-side along the scanning signal lines GL1-GLm. It is noted that the sub pixel SPIX (1, 1) and the subsequent pixels correspond to the pixels in claims.

Any type of device may be used as the video signal source VS on condition that the video signal DAT can be generated. An example of the video signal source VS in case where a device including the image display device 1 is a television receiver is a tuner (image receiving means) which receives television broadcast so as to generate images of that television broadcast. In such a case, the video signal source as a tuner selects a channel of a broadcast signal, and sends a television video signal of the selected channel to the signal processing circuit 21. In response, the signal processing circuit 21 generates a video signal DAT2 after signal processing based on the television video signal. In case where a device including the video display device 1 is a liquid crystal monitor device, the video signal source VS may be a personal computer, for example.

Figure 3:
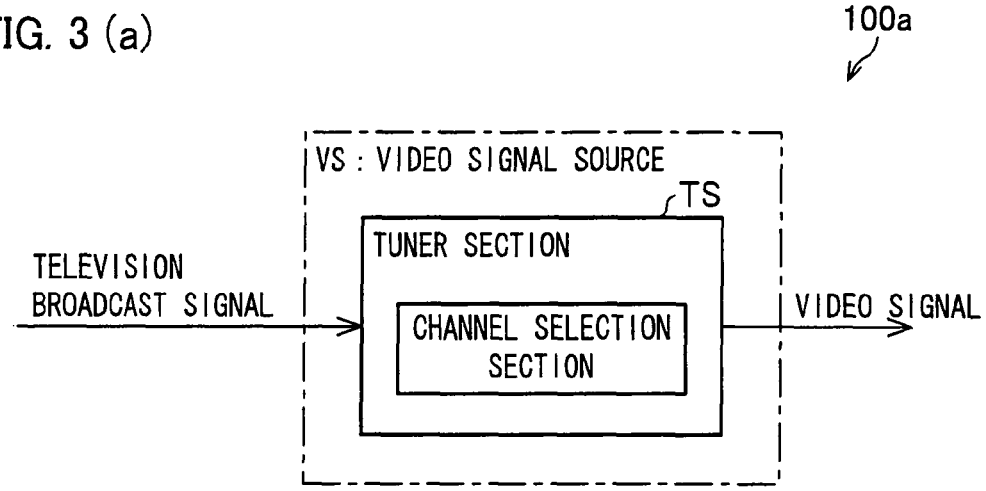
FIG. 3(*a*) is a block diagram showing the substantial part of a television receiver provided with the foregoing image display device.
Figure 3:
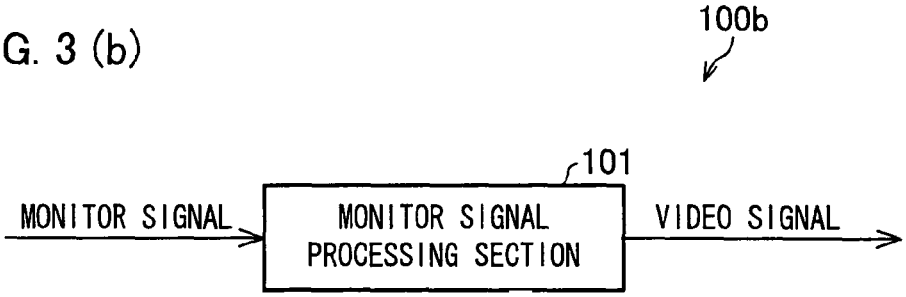

More specifically, in case where the image display device 1 is included in a television receiver 100*a*, the television receiver 100*a* includes the video signal source VS and the image display device 1 and, as shown in FIG. 3(*a*), the video signal source VS receives a television broadcast signal, for example. This video signal source VS is further provided with a tuner section TS which selects a channel with reference to the television broadcast signal and outputs, as a video signal DAT, a television video signal of the selected channel.

On the other hand, in case where the image display device 1 is included in a liquid crystal monitor device 100*b*, the liquid crystal monitor device 100*b* includes, as shown in FIG.

3(*b*), a monitor signal processing section 101 which outputs, for example, a video monitor signal from a personal computer or the like, as a video signal supplied to the liquid crystal panel 11. The signal processing circuit 21 or the control circuit 12 functions as the monitor signal processing section 101, or the monitor signal processing section 101 may be provided at the stage prior to or subsequent to the signal processing circuit 21 or the control circuit 12.

In the descriptions below, a number or alphabet is added such as the i-th data signal line SLi only when it is required to specify the position, for convenience' sake. When it is unnecessary to specify the position or when a collective term is shown, the number or alphabet is omitted.

The pixel array 2 has plural (in this case, n) data signal lines SL1-SLn and plural (in this case, m) scanning signal lines GL1-GLm which intersect with the respective data signal lines SL1-SLn. Assuming that an arbitrary integer from 1 to n is i whereas an arbitrary integer from 1 to m is j, a sub pixel SPIX (i, j) is provided at the intersection of the data signal line SLi and the scanning signal line GLj.

In the present embodiment, a sub pixel SPIX (i, j) is surrounded by two adjacent data signal lines SL (i−1) and SLi and two adjacent scanning signal lines GL (j−1) and GLj.

Figure 4:
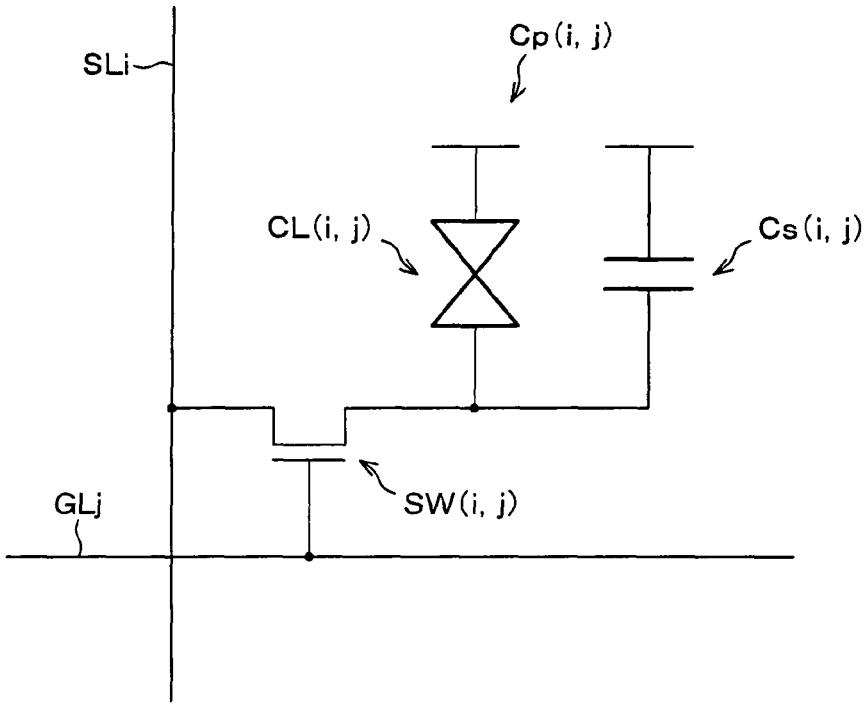
FIG. 4 is a circuit diagram showing an example of a pixel in the image display device.

The sub pixel SPIX (i, j) is, for example as shown in FIG. 4, provided with: as a switching element, a field-effect transistor SW (i, j) whose gate is connected to the scanning signal line GLj and whose source is connected to the data signal line SLj; and a pixel capacity Cp (i, j), one of whose electrodes is connected to the drain of the field-effect transistor SW (i, j). The other electrode of the pixel capacity Cp (i, j) is connected to the common electrode line which is shared among all sub pixels SPIX. The pixel capacity Cp (i, j) is constituted by a liquid crystal capacity CL (i, j) and an auxiliary capacity Cs (i, j) which is added as necessity arises.

In the above-described sub pixel SPIX (i, j), the field-effect transistor SW (i, j) is switched on in response to the selection of the scanning signal line GLj, and a voltage on the data signal line SLi is supplied to the pixel capacity Cp (i, j). On the other hand, while the selection of the scanning signal line GLj ends and the field-effect transistor SW (i, J) is turned off, the pixel capacity Cp (i, j) keeps the voltage before the turnoff. The transmittance or reflectance of liquid crystal varies in accordance with a voltage applied to the liquid crystal capacity CL (i, j). It is therefore possible to change the display state of the sub pixel SPIX (i, j) in accordance with video data for the sub pixel SPIX (i, j), by selecting the scanning signal line GLj and supplying, to the data signal line SLi, a voltage corresponding to the video data.

The image display device 1 of the present embodiment adopts a liquid crystal cell in a vertical alignment mode, i.e. a liquid crystal cell which is arranged such that liquid crystal molecules with no voltage application are aligned to be substantially vertical to the substrate, and the vertically-aligned liquid crystal molecules tilt in accordance with the voltage application to the liquid crystal capacity CL (i, j) of the sub pixel SPIX (i, x). The liquid crystal cell in the present embodiment is in normally black mode.

Figure 5:
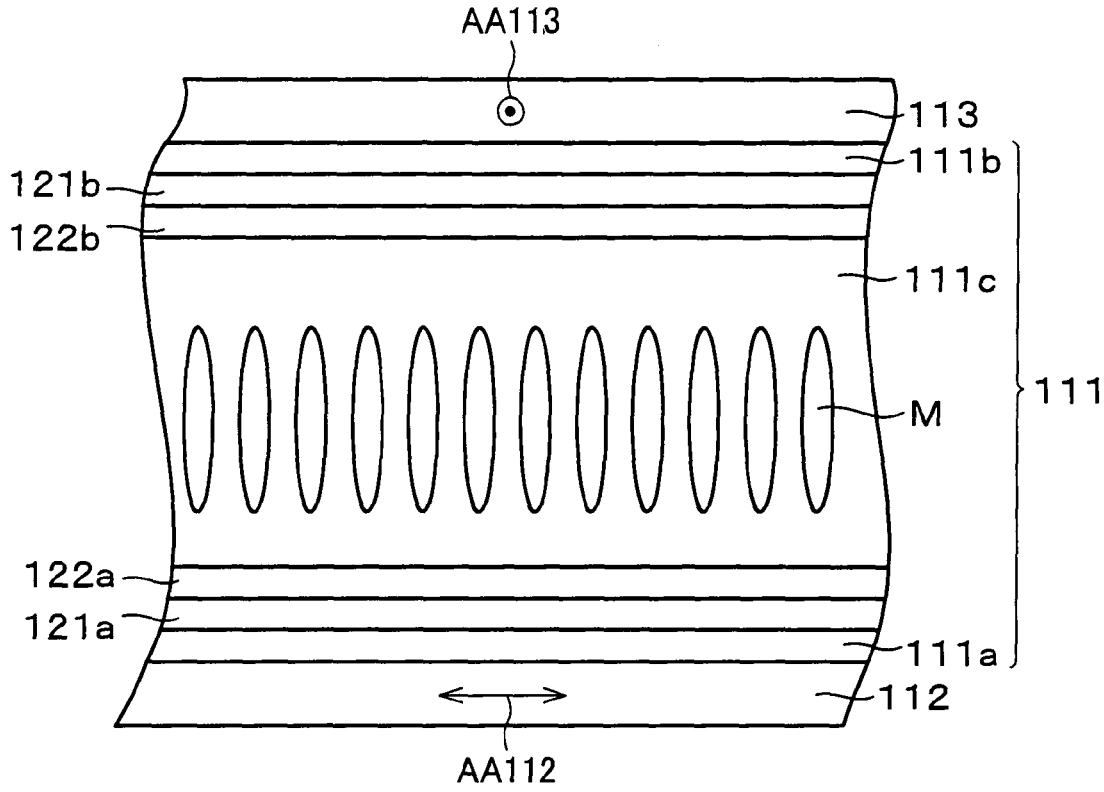
FIG. 5 schematically shows a liquid crystal cell in the image display device, to which no voltage is applied.

More specifically, as shown in FIG. 5, the pixel array 2 of the present embodiment is arranged such that a vertically-aligned (VA) liquid crystal cell (liquid crystal display device) 111 is sandwiched between polarization plates 112 and 113.

The liquid crystal cell 111 includes: a TFT (Thin Film Transistor) substrate 111*a* with pixel electrodes 121*a* corresponding to the respective sub pixels SPIX; an opposing substrate 111*b* with an opposing electrode 121*b*; and a liquid crystal layer 111*c* which is sandwiched between the substrates 111*a* and 111*b* and is made of negative dielectric anisotropic nematic liquid crystal. The image display device 1 of the present embodiment can display color images, and hence the opposing substrate 111*b* is provided with color filters (not illustrated) corresponding to the respective colors of the sub pixels SPIX.

The TFT substrate 111*a* is further provided with a vertical alignment film 122*a* on the liquid crystal layer 111*c* side. Similarly, on the liquid crystal layer 111*c* side of the opposing substrate 111*b*, a vertical alignment film 122*b* is provided. Therefore, when no voltage is applied to the space between the electrodes 121*a* and 121*b*, the liquid crystal molecules M in the liquid crystal layer 111*c* between the substrates 111*a* and 111*b* are aligned to be substantially vertical to the surfaces of the substrates 111*a* and 111*b*.

Figure 6:
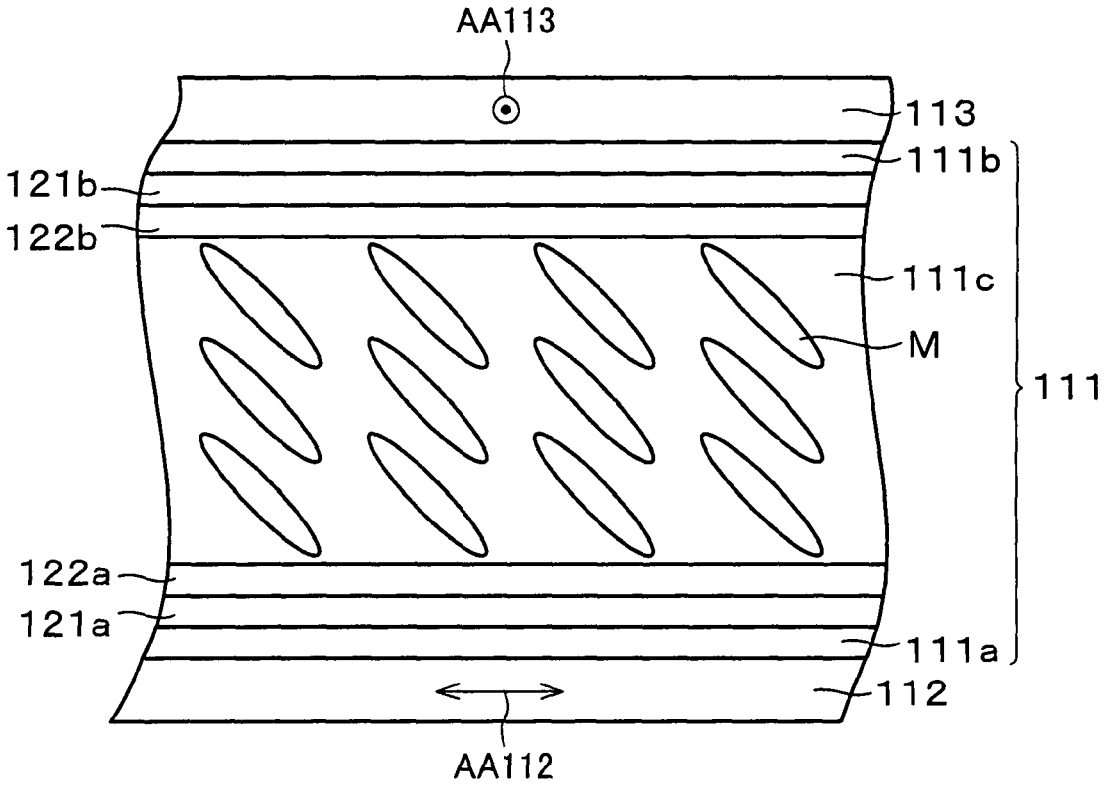
FIG. 6 schematically shows a liquid crystal cell in the image display device, to which a voltage is applied.

On the other hand, when a voltage is applied to the space between the electrodes 121*a* and 121*b*, the liquid crystal molecules M which are in parallel to the normal of the substrates 111*a* and 111*b* (when no voltage is applied) tilt so as to have an angle in accordance with the applied voltage (see FIG. 6). Since the substrates 111*a* and 111*b* oppose to one another, the normal and in-plane direction of each substrate will be simply referred to as normal and in-plane direction, unless required to make distinction.

The liquid crystal cell 111 of the present embodiment has multi-domain alignment. Each of the sub pixels SPIX is therefore divided into plural domains, and the orientation, i.e. the direction (in-plane component of the orientation) of the tilt of the liquid crystal molecules M with voltage application is different among the domains.

Figure 7:
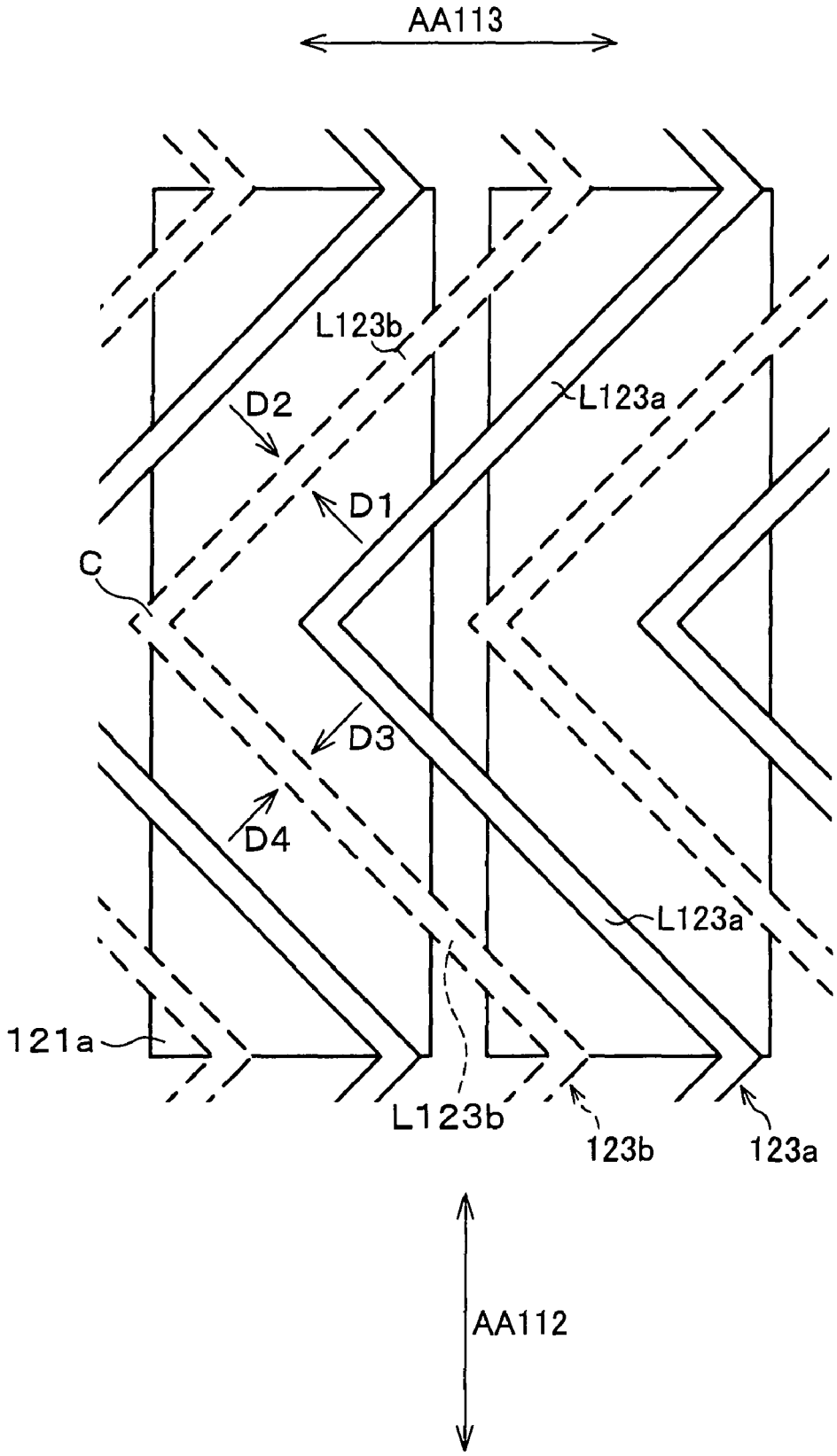
FIG. 7 is a plan view of the surrounding of a pixel electrode, and shows an example of the liquid crystal cell.

More specifically, as shown in FIG. 7, the pixel electrode 121*a* has striped protrusions 123*a* each of which is angled upwards in cross section and zigzagged with substantially right angles in plane. On the other hand, the opposing electrode 121*b* has striped slits (openings where no electrode is formed) each of which is zigzagged with substantially right angles in plane. The distance between each pair of protrusion 123*a* and slit 123*b* is predetermined. The protrusions 123*a* are formed by applying photosensitive resin to the pixel electrode 121*a* and processing the same by photolithography. The electrodes 121*a* and 121*b* are formed in such a manner that ITO (Indium Tin Oxide) films are formed on the respective substrates 111*a* and 111*b*, photo resist is applied thereon, electrode patterns are exposed to light and developed, and the patterns are etched. The slits 123*b* are formed by carrying out patterning with the exception of the parts to be the slits 123*b*, when the opposing electrode 121*b* is formed.

Around the protrusions 123*a*, liquid crystal molecules are aligned so as to be vertical to the inclined surfaces of the protrusions 123*a*. With voltage application, an electric field around each of the protrusions 123*a* tilts so as to be in parallel to the inclined surface of the protrusion 123*a*. Since the liquid crystal molecules tilt so that the longitudinal axes thereof are vertical to the electric field, the liquid crystal molecules are aligned so as to be oblique to the substrate surface. Moreover, on account of the continuity of liquid crystal, the liquid crystal molecules remote from the inclined surfaces of the protrusions 123*a* are aligned in the same manner as those around the inclined surfaces.

In a similar manner, in a region around the edge (border between the slit 123*b* and the opposing electrode 121*b*) of the slit 123*b*, an electric field tilted with respect to the substrate surface is formed when a voltage is applied. On this account, the liquid crystal molecules are aligned so as to be oblique to the substrate surface. In addition, on account of the continuity of liquid crystal, the liquid crystal molecules remote from the region around the edge are aligned in the same manner as those around the edge.

Because of the above, provided that a part between two corners C is termed line part in the protrusions 123*a* and the slits 123*b*, the in-plane component of the orientation of liquid crystal molecules with voltage application is identical with the in-plane component of the direction from the line section L123*a* of the protrusion 123*a* to the line part L123*b* of the slit 123*b*.

Each of the protrusions 123*a* and the slits 123*b* curves at a corner C at a substantially right angle. On this account, the liquid crystal molecules have four different orientations in one sub pixel SPIX, and hence one sub pixel SPIX has domains D1-D4 each having different orientation of liquid crystal molecules.

On the polarization plates 112 and 113 shown in FIG. 5, an absorption axis AA112 of the polarization plate 112 and an absorption axis AA113 of the polarization plate 113 are provided so as to be orthogonal to one another (see FIG. 7). The polarization plates 112 and 113 are arranged so that the absorption axes AA112 and AA113 form an angle of 45° with the in-plane components of the orientations of the liquid crystal molecules in the domains D1-D4, when a voltage is applied (see FIG. 7). As an example of the absorption axes AA112 and AA113 orthogonal to one another, FIG. 5 shows that the absorption axis AA112 is in parallel to the paper whereas the absorption axis AA113 is orthogonal to the paper. Alternatively, these axes may be rotated for 90° so that the absorption axis AA112 is orthogonal to the paper whereas the absorption axis AA113 is in parallel to the paper.

In the above-described pixel array 2, while a voltage is applied to the pixel electrode 121*a* and the opposing electrode 121*b*, the liquid crystal molecules in the liquid crystal cell 111 are, as shown in FIG. 6, tilt for an angle in accordance with the voltage, with respect to the normal of the substrates. Light passing through the liquid crystal cell 111 therefore has a phase difference corresponding to the voltage.

The absorption axes AA112 and AA113 of the polarization plates 112 and 113 are arranged so as to be orthogonal to one another. For this reason, the light entering the outgoing-side polarization plate (112, for example) is elliptically-polarized light with the phase difference caused by the liquid crystal cell 111, and a part of this incoming light passes through the polarization plate 112. As a result, an amount of light outgoing from the polarization plate 112 is controllable in accordance with the applied voltage, and hence grayscale display is achieved.

Furthermore, in the liquid crystal cell 111, the domains D1-D4 having different orientations of liquid crystal molecules are formed in each sub pixel. On this account, in case where the liquid crystal cell 111 is viewed in the direction in parallel to the orientation of liquid crystal molecules in one domain (e.g. D1) and the liquid crystal molecules do not give a phase difference to passing light, the liquid crystal molecules in the remaining domains (D2-D4 in this case) give a phase difference to the passing light. On this account, these domains can optically compensate one another. In this way the quality of image display when the liquid crystal cell 111 is obliquely viewed is improved and the range of viewing angles is increased.

On the other hand, while no voltage is applied to the pixel electrode 121*a* and the opposing electrode 121*b*, the liquid crystal molecules of the liquid crystal cell 111 are vertically aligned as shown in FIG. 5. In this state (no voltage application), the light entering the liquid crystal cell 111 in the normal direction does not obtain a phase difference by the liquid crystal molecules, and passes through the liquid crystal cell 111 with the polarization state of the light being maintained. As a result, the light entering the outgoing-side polarization plate (112, for example) is linearly-polarized light. Since this linearly-polarized light is substantially in parallel to the absorption axis AA112 of the polarization plate 112, it cannot pass through the polarization plate 112. The pixel array 2 therefore displays black in this case.

In this way, in the pixel array 2 of the present embodiment, a voltage is applied to the pixel electrode 121*a* and the opposing electrode 121*b* so that an electric field oblique to the substrate surface is generated and hence the liquid crystal molecules are obliquely aligned. As a result, the transmittance of each sub pixel SPIX is changeable in accordance with the level of voltage applied to the pixel electrode 121*a*, with the result that grayscale display is achieved.

In the arrangement above, the scanning signal line drive circuit 4 shown in FIG. 2 outputs, to each of the scanning signal lines GL1-GLm, a signal indicating whether the signal line is selected, for example a voltage signal. Also, the scanning signal line driver circuit 4 determines a scanning signal line GLj to which the signal indicating the selection is supplied, based on a timing signal such as a clock signal GCK and a start pulse signal GSP supplied from the control circuit 12, for example. The scanning signal lines GL1-GLm are therefore serially selected at predetermined timings.

As video signals, the data signal line drive circuit 3 extracts sets of video data which are supplied in a time-sharing fashion to the respective sub pixels SPIX, by, for example, sampling the sets of data at predetermined timings. Also, the data signal line drive circuit 3 outputs, to the respective sub pixels SPIX (1, j) to SPIX (n, j) corresponding to the scanning signal line GLJ being selected by the scanning signal line drive circuit 4, output signals corresponding to the respective sets of video data. These output signals are supplied via the data signal lines SL1-SLn.

The data signal line drive circuit 3 determines the timings of sampling and timings to output the output signals, based on a timing signal such as a clock signal SCK and a start pulse signal SSP.

In the meanwhile, while the corresponding scanning signal line GLj is being selected, the sub pixels SPIX (1, j) to SPIX (n, j) adjust the luminance, transmittance and the like of light emission based on the output signals supplied to the data signal lines SL1-SLn corresponding to the respective sub pixels SPIX (1, j) to SPIX (n, j), so that the brightness of each sub pixel is determined.

Since the scanning signal line drive circuit 4 serially selects the scanning signal lines GL1-GLm, the sub pixels SPIX (1, 1) to SPIX (n, m) constituting the entire pixels of the pixel array 2 are set so as to have brightness (grayscale) indicated by the video data. An image displayed on the pixel array 2 is therefore refreshed.

The video data D supplied to each sub pixel SPIX may be a grayscale level or a parameter for calculating a grayscale level, on condition that the grayscale level of each sub pixel SPIX can be specified. In the following description, the video data D indicates a grayscale level of a sub pixel SPIX, as an example.

In the image display device 1, the video signal DAT supplied from the video signal source VS to the signal processing circuit 21 may be an analog signal or a digital signal, as described below. Also, a single video signal DAT may correspond to one frame (entire screen) or may correspond to each of fields by which one frame is constituted. In the following description, for example, a digital video signal DAT corresponds to one frame.

The video signal source VS of the present embodiment transmits video signals DAT to the signal processing circuit 21 of the image display device 1 via the video signal line VL.

In doing so, video data for each frame is transmitted in a time-sharing fashion, by, for example, transmitting video data for the subsequent frame only after all of video data for the current frame have been transmitted.

The aforesaid frame is constituted by plural horizontal lines. In the video signal line VL, for example, video data of the horizontal lines of each frame is transmitted in a time-sharing manner such that data of the subsequent line is transmitted only after all video data of the current horizontal line is transmitted. The video signal source VS drives the video signal line VL in a time-sharing manner, also when video data for one horizontal line is transmitted. Sets of video data are serially transmitted in predetermined order.

Sets of video data are required to allow a set of video data D supplied to each sub pixel to be specified. That is to say, sets of video data D may be individually supplied to the respective sub pixels and the supplied video data D may be used as the video data D supplied to the sub pixels. Alternatively, sets of video data D may be subjected to a data process and then the data as a result of the data process may be decoded to the original video data D by the signal processing circuit 21. In the present embodiment, for example, sets of video data (e.g. RGB data) indicating the colors of the pixels are serially transmitted, and the signal processing circuit 21 generates, based on these sets of video data for the pixels, sets of video data D for the respective sub pixels. For example, in case where the video signal DAT conforms to XGA (eXtended Graphics Array), the transmission frequency (dot clock) of the video data for each pixel is 65 (MHz).

In the meanwhile, the signal processing circuit 21 subjects the video signal DAT transmitted via the video signal line V1 to a process to emphasize grayscale transition, a process of division into sub frames, and a gamma conversion process. As a result, the signal processing circuit 21 outputs a video signal DAT2.

The video signal DAT2 is constituted by sets of video data after the processes, which are supplied to the respective sub pixels. A set of video data supplied to each sub pixel in a frame is constituted by sets of video data supplied to each sub pixel in the respective sub frames. In the present embodiment, the sets of video data constituting the video signal DAT2 are also supplied in a time-sharing fashion.

More specifically, to transmit the video signal DAT2, the signal processing circuit 21 transmits sets of video data for respective frames in a time-sharing fashion in such a manner that, for example, video data for a subsequent frame is transmitted only after all video data for a current frame is transmitted. Each frame is constituted by plural sub frames. The signal processing circuit 21 transmits video data for sub frames in a time-sharing fashion, in such a manner that, for example, video data for a subsequent sub frame is transmitted only after all video data for a current sub frame is transmitted. Similarly, video data for the sub frame is made up of plural sets of video data for horizontal lines. Each set of video data for a horizontal line is made up of sets of video data for respective sub pixels. Furthermore, to send video data for a sub frame, the signal processing circuit 21 sends sets of video data for respective horizontal lines in a time-sharing fashion in such a manner that, for example, video data for a subsequent horizontal line is transmitted only after all video data for a current horizontal line is transmitted. To send sets of video data for respective horizontal lines, for example, the signal processing circuit 21 serially sends the sets of video data for respective sub pixels, in a predetermined order.

The following will describe a case where a process of division into sub frames and a gamma conversion process are carried out after emphasizing grayscale transition. It is noted that the grayscale transition emphasizing process may be carried out later as described below.

Figure 1:
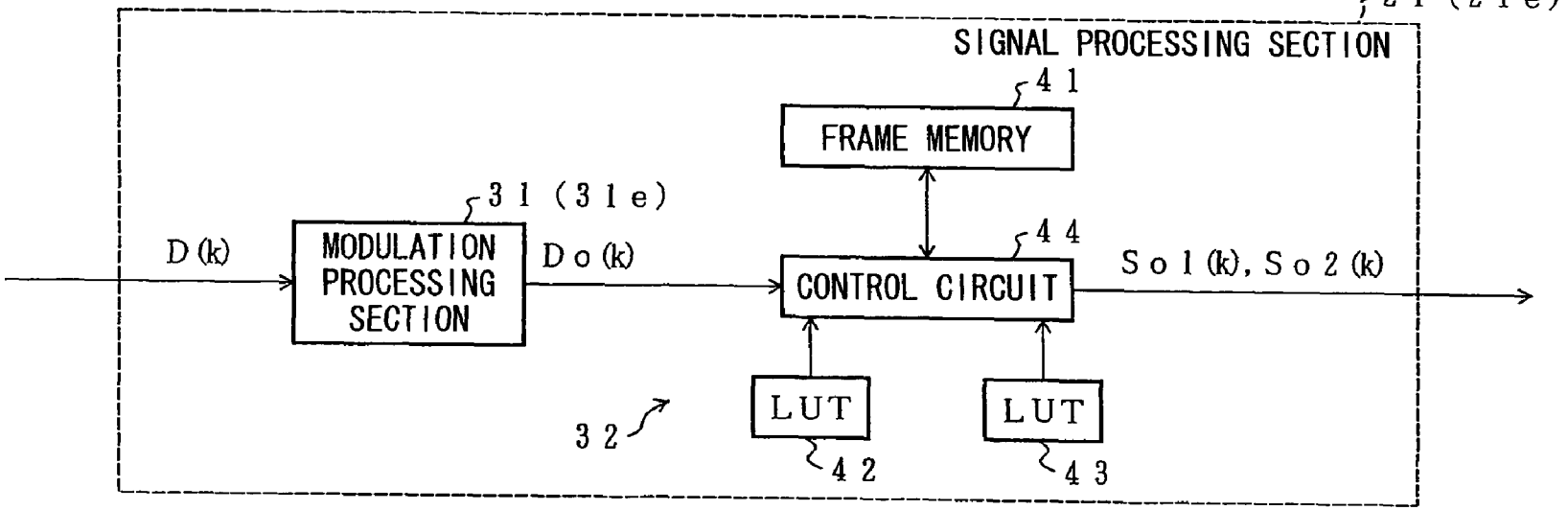
FIG. 1 relates to an embodiment of the present invention and is a block diagram showing the substantial part of a signal processing circuit in an image display device.

That is to say, as shown in FIG. 1, the signal processing circuit 21 of the present embodiment includes: a modulation processing section (correction means) 31 which corrects a video signal DAT so as to emphasize grayscale transition in each sub pixel SPIX and outputs a video signal DATo as a result of the correction; and a sub frame processing section 32 which performs division into sub frames and gamma conversion based on the video signal DATo and outputs the above-described corrected video signal DAT2. The image display device 1 of the present embodiment is provided with R, G, and B sub pixels for color image display and hence the modulation processing section 31 and the sub frame processing section 32 are provided for each of R, G, and B. These circuits 31 and 32 for the respective colors are identically constructed irrespective of the colors, except video data D (i, j, k) to be input. The following therefore only deals with the circuits for R, with reference to FIG. 1.

As detailed later, the modulation processing section 31 corrects each set of video data (video data D (i, j, k) in this case) for each sub pixel, which data is indicated by a supplied video signal, and outputs a video signal DATo constituted by corrected video data (video data Do (i, j, k) in this case). In FIG. 1 and also in below-mentioned FIGS. 15, 16, 39, 40, 42, 44, and 45, only video data concerning a particular sub pixel SPIX (i, j) is illustrated. It is also noted that a sign such as (i, j) indicating a position is not suffixed to the video data, e.g. video data Do (k).

In the meanwhile, the sub frame processing section 32 divides one frame period into plural sub frames, and generates, based on video data Do (i, j, k) of a frame FR (k), sets of video data S (i, j, k) for the respective sub frames of the frame FR (k).

In the present embodiment, for example, one frame FR (k) is divided into two sub frames, and for each frame, the sub frame processing section 32 outputs sets of video data So1 (*i, j, k*) and So2 (*i, j, k*) for the respective sub frames based on the video data Do (i, j, k) of the frame (e.g. FR (k)).

The following assumes that, sub frames constituting a frame FR (k) are termed SFR1 (*k*) and SFR2 (*k*) which are temporally in this order, and the signal processing circuit 21 sends video data for the sub frame SFR2 (*k*) after sending video data for the sub frame SFR1 (*k*). The sub frame SFR1 (*k*) corresponds to video data So1 (*i, j, k*) whereas the sub frame SFR2 (*k*) corresponds to video data So2 (*i, j, k*). It is possible to optionally determine a time period from the input of video data D (i, j, k) of a frame FR (k) to the signal processing circuit 21 to the application of a voltage corresponding to the video data D (i, j, k) to the sub pixel SPIX (i, j). Irrespective of the length of this time period, the following (i), (ii), and (iii) are assumed to correspond to the same frame FR (k): (i) video data D (i, j, k) of a frame FR (k); (ii) data (sets of corrected data So1 (*i, j, k*) and SO2 (*i, j, k*)) after the grayscale transition emphasizing process, frame division process, and gamma correction process; and (iii) voltages (V1 (*i, j, k*) and V2 (*i, j, k*)) corresponding to the corrected data. Also, a period corresponding to these sets of data and voltages is termed frame FR (k). These sets of data, the voltages, and the frame have the same frame number (k, for example).

To be more specific, the period corresponding to the sets of data and the voltages is one of the following periods: a period from the input of video data D (i, j, k) of a frame FR (k) to the sub pixel SPIX (i, j) to the input of video data D (i, j, k+1) of the next frame FR (k+1); a period from the output of the first one of (in this case, So1 (*i, j, k*)) the sets of corrected data So1 (*i, j, k*) and So2 (*i, j, k*) which are produced by conducting the aforesaid processes with respect to the video data D (i, j, k) to the output of the first one of (in this case, So1 (*i, j, k*+1)) the sets of corrected data So1 (*i, j, k*+1) and So2 (*i, j, k*+1) which are produced by conducting the aforesaid processes with respect to the video data D (i, j, k+1); and a period from the application of a voltage V1 (*i, j, k*) to the sub pixel SPIX (i, j) in accordance with the video data SO1 (*i, j, k*) to the application of a voltage V1 (*i, j, k*+1) to the sub pixel SPIX (i, j, k+1) in accordance with the next video data So1 (*i, j, k*+1).

To simplify the description, when collectively termed, the suffixed number indicating the number of a sub frame is omitted from a sub frame and video data and voltages corresponding thereto, e.g. sub frame SFR (x). In such a case, sub frames SFR1 (*k*) and SFR2 (*k*) are termed as sub frames SFR (x) and SFR (x+1).

The aforesaid sub frame processing section 32 includes: a frame memory 41 which stores video data D for one frame, which is supplied to each sub pixel SPIX; a lookup table (LUT) 42 which indicates how video data corresponds to video data So1 for a first sub frame; an LUT 43 which indicates how video data corresponds to video data So2 for a second sub frame; and a control circuit 44 which controls the aforesaid members. It is noted that the LUTs 42 and 43 correspond to storage means in claims, whereas the control circuit 44 corresponds to generation means in claims.

The control circuit 44 can write, once in each frame, sets of video data D (1, 1, k) to D (n, m, k) of the frame (e.g. FR (k)) into the frame memory 41. Also, the control circuit 44 can read out the sets of video data D (1, 1, k) to D (n, m, k) from the frame memory 41. The number of times the control circuit 44 can read out in each frame corresponds to the number of sub frames (2 in this case).

In association with possible values of the sets of video data D (1, 1, k) to D (n, m, k) thus read out, the LUT 42 stores values indicating sets of video data So1 each of which is output when the video data D has the corresponding value. Similarly, in association with the possible values, the LUT 43 stores values indicating sets of video data So2 each of which is output when the video data D has the corresponding value.

Referring to the LUT 42, the control circuit 44 outputs video data So1 (*i, j, k*) corresponding to the video data D (i, j, k) thus read out. Also, referring to the LUT 43, the control circuit 44 outputs video data So2 (*i, j, k*) corresponding to the video data D (i, j, k) thus read out. The values stored in the LUTs 42 and 43 may be differences from the possible values, on condition that the sets of video data So1 and So2 can be specified. In the present embodiment, the values of the sets of video data So1 and So2 are stored, and the control circuit 44 outputs, as sets of video data So1 and So2, the values read out from the LUTs 42 and 43.

The values stored in the LUTs 42 and 43 are set as below, assuming that a possible value is g whereas stored values are P1 and P2. Although the video data So1 for the sub frame SFR1 (*k*) may be set so as to have higher luminance, the following assumes that the video data SO2 for the sub frame SFR2 (*k*) has higher luminance than the video data So1.

In case where g indicates a grayscale not higher than a predetermined threshold (i.e. indicates luminance not higher than the luminance indicated by the threshold), the value P1 falls within a range determined for dark display, whereas the value P2 is set so as to correspond to the value P1. The upper limit of the range for dark display is a grayscale determined in advance for dark display, whereas the lower limit of the range is higher than the grayscale indicating the minimum luminance (i.e. black). It is noted that the upper and lower limits are included in the aforesaid range. The predetermined grayscale for dark display is preferably set so that below-mentioned whitish appearance is restrained to a desired amount or below.

On the other hand, in case where g indicates a grayscale higher than a predetermined threshold (i.e. indicates higher luminance than the luminance indicated by the threshold), the value P2 is set so as to fall within a predetermined range for light display whereas the value P1 is set so as to correspond to the value P2 and the value g. The range for light display is not lower than a grayscale for light display, which is determined in advance. If the grayscale determined in advance for light display indicates the maximum luminance (white), the range is at the grayscale with the maximum luminance (i.e. white). The predetermined grayscale is preferably set so that whitish appearance is restrained to a desired amount or below.

As a result, in case where the video data D (i, j, k) supplied to the sub pixel SPIX (i, j) in a frame (FR (k) indicates a grayscale not higher than the aforesaid threshold, i.e., in a low luminance region, the magnitude of the luminance of the sub pixel SPIX (i, j) in the frame FR (k) mainly depends on the magnitude of the value P2. On this account, the state of the sub pixel SPIX (i, j) is dark display, at least in the sub frame SFR1 (*k*) in the frame FR (k). Therefore, in case where the video data D (i, j, k) in a frame indicates a grayscale in a low luminance region, the sub pixel SPIX (i, j) in the frame FR (k) can simulate impulse-type light emission typified by CRTs, and hence the quality of moving images on the pixel array 2 is improved.

In case where the luminance of the video data D (i, j, k) supplied to the sub pixel PIX (i,j) in a frame FR (k) is higher than the aforesaid threshold, i.e., in a high luminance region, the magnitude of the luminance of the sub pixel SPIX (i, j) in the frame FR (k) mainly depends on the magnitude of the value P1. Therefore, in comparison with the arrangement in which the luminances of the respective sub frames SFR1 (*k*) and SFR2 (*k*) are substantially equal, it is possible to greatly differentiate the luminance of the sub pixel SPIX (i, j) in the sub frame SFR1 (*k*) from the luminance of the sub pixel SPIX (i, j) in the sub frame SFR2 (*k*). As a result, the sub pixel SPIX (i, j) in the frame FR (k) can simulate impulse-type light emission in most cases, even if the video data D (i, j, k) in the frame FR (k) indicates grayscale in a high luminance region. The quality of moving images on the pixel array 2 is therefore improved.

According to the arrangement above, in case where the video data (i, j, k) indicates a grayscale in a high luminance region, the video data So2 (*i, j, k*) for the sub frame SFR2 (*k*) indicates a value within the range for light display, and the value of the video data So1 (*i, j, k*) for the sub frame SFR1 (*k*) increases as the luminance indicated by the video data D (i, j, k) increases. Therefore, the luminance of the sub pixel SPIX (i, j) in the frame FR (k) is high in comparison with an arrangement in which a period of dark display is always provided even when white display is required. As a result, while the quality of moving images is improved because the sub pixel SPIX simulates impulse-type light emission as above, the maximum value of the luminance of the sub pixel SPIX (i, j) is greatly increased. The image display device 1 can therefore produce brighter images.

Incidentally, even in a VA panel which has a wide range of viewing angles, it is not possible to completely eliminate the variation in grayscale characteristics caused by a change in the viewing angle. For example, the grayscale characteristics deteriorate as, for example, a range of viewing angles in the horizontal direction is increased.

Figure 8:
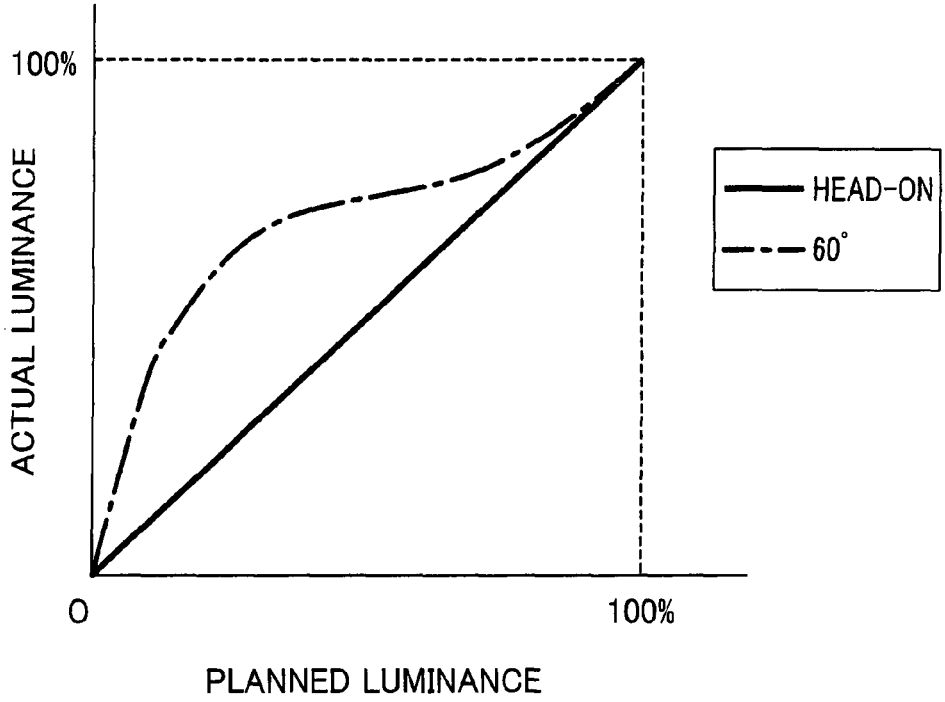

For example, as shown in FIG. 8, the grayscale gamma characteristic at the viewing angle of 60° is different from the grayscale gamma characteristic when the panel is viewed head-on (at the viewing angle of 0°), and hence whitish appearance, which is excessive brightness in intermediate luminance, occurs at the viewing angle of 60°.

On the other hand, according to the arrangement above, one of the sets of video data So1 (*i, j, k*) and So2 (*i, j, k*) is set so as to fall within the range for dark display or within the range for light display, both in case where the video data D (i, j, k) indicates a grayscale in a high luminance region and in case where the video data D (i, j, k) indicates a grayscale in a low luminance region. Also, the magnitude of the luminance of the sub pixel SPIX (i, j) in the frame FR (k) mainly depends on the magnitude of the other video data.

As shown in FIG. 8, an amount of the whitish appearance (deviance from the desired luminance) is maximized around intermediate luminance, whereas an amount of the whitish appearance is relatively restrained when the luminance is sufficiently low or high.

Figure 9:
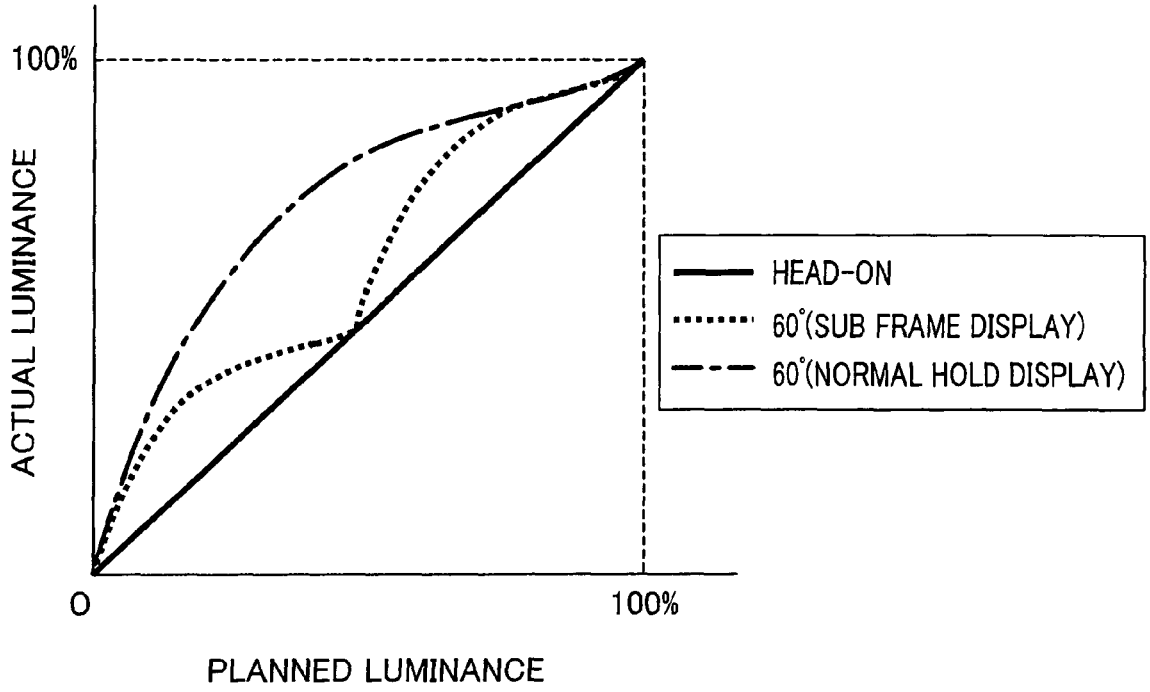

Therefore, as shown in FIG. 9, a total amount of generated whitish appearance is greatly restrained in comparison with a case where both of the sub frames SFR1 (*k*) and SFR2 (*k*) are substantially equally varied so that the aforesaid luminance is controlled (i.e. intermediate luminance is attained in both sub frames and a case where an image is displayed without dividing a frame. It is therefore possible to greatly improve the viewing angle characteristics of the image display device 1.

In the present embodiment, the pixel array 2 has liquid crystal cells in the vertical alignment mode. Therefore, a response speed when the state of liquid crystal molecules changes from substantially vertical alignment (black display) to tilted alignment (intermediate luminance or white display) is slower than a response speed when the angle of liquid crystal molecules in tilted alignment (non-black display) is changed in accordance with a desired grayscale. For this reason, when the value within the range for dark display indicates black, the aforesaid improvement in the response speed for drive with division into sub frames or the improvement in the brightness of the sub pixels SPIX tend to be restricted.

More specifically, as shown in FIG. 5, when a voltage is applied to the pixel electrode 121*a* while liquid crystal molecules are substantially vertically aligned (i.e. black display), the liquid crystal molecules around the protrusions 123*a* and around the slits 123*b* as shown in FIG. 7 are tilted under the influence of a tilted electric field formed by the aforesaid voltage application. In the meanwhile, the alignment of the liquid crystal molecules away from the regions above is determined on account of the continuity of liquid crystal, after the alignment of the liquid crystal molecules around the protrusions and slits is determined.

When the liquid crystal molecules are substantially vertically aligned, the alignment orientation (in-plane component, of the alignment direction, which is in parallel to the substrate) has not been determined. On this account, when a liquid crystal molecule determines its alignment direction in accordance with the continuity of an electric field or liquid crystal, not only the tilting angle (a component, of the alignment direction, which is in the normal direction of the substrate) of the liquid crystal molecule but also the alignment orientation of the molecules must be determined. This is the reason why the response speed of the liquid crystal molecules tend to be slow in comparison with a case where the alignment of liquid crystal molecules with a particular alignment orientation is changed. In particular, in regions away from the protrusions and slits, the alignment of the liquid crystal molecules is determined after the alignment of the liquid crystal molecules around the protrusions and slits is determined, and hence the response speed of the liquid crystal molecules away from the protrusions and slits is slower. As a result, the response speed of the luminance (transmittance) of the sub pixels SPIX is slow when the state of substantially vertically aligned liquid crystal molecules (black display) is changed into a tilted state (intermediate luminance or white display), in comparison with a case where the angle of tilted liquid crystal molecules (i.e. non-black display) is changed in accordance with a desired grayscale. The response speed can be shortened to some extent by emphasizing grayscale transition. However, overemphasizing the grayscale transition causes a problem such that regions with different luminance are viewed in the sub pixel SPIX because of the difference between the response speed in the region around the protrusions and slits and the response speed in the region away from the protrusions and slits. It is therefore required to restrain the degree of the gray scale transition emphasis to the extent that regions with different luminance are not viewable or the difference is negligible, and hence there is a limit on the improvement in a response speed by grayscale transition emphasis.

Figure 10:
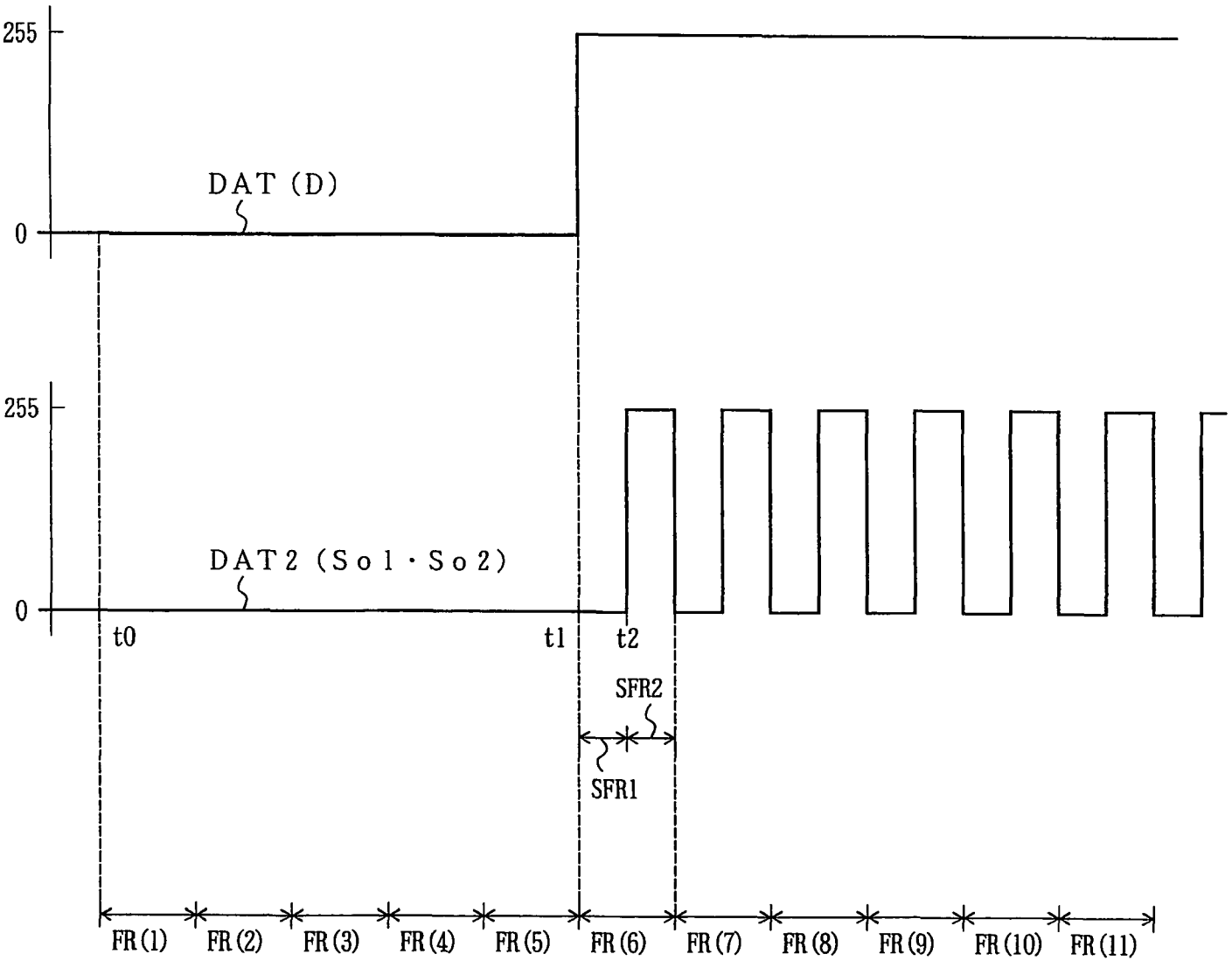
FIG. 10 relates to a comparative example and is a timing chart showing a temporal change in video data input/output to/from the signal processing section.

For example, assume that the value in the range for dark display indicates black (i.e. first comparative example), and also assume that, as shown in FIG. 10, a grayscale which slightly falls short of the above-described threshold is attained at a time t1, after a time period (from t0 to t1) in which the video data D indicates black.

In this case, provided that the frame in the time period t0-t1 is constituted by frames FR (1) to FR (5), the video data D (i, j, 1-5) has a value (e.g. 0) indicating black in each of the frames FR (1-5). Also, the video data So1 (*i, j*, 1-5) in the sub frames SFR1 (1-5) and the video data So2 (*i, j*, 1-5) in the sub frames SFR2 (1-5) are set so as to have a value indicating black.

On the other hand, in the frames FR (6 and subsequent numbers) after the time t1, the video data D (i, j, 6 and subsequent numbers) does not exceed the aforesaid threshold. On this account, the sub frame processing section 32 sets the video data So1 (*i, j*, 6 and subsequent numbers) in the sub frames SFR1 (6 and subsequent numbers) at the value (which indicates black in this case) within the range for dark display, with the result that the value of the video data So2 (*i, j*, 6 and subsequent numbers) in the sub frames SFR2 (6 and subsequent numbers) is increased or decreased and hence the time integral value of the luminance of the sub pixel SPIX (i, j) in the frames FR (6 and subsequent numbers) is controlled. As described above, the video data D (i, j, 6 and subsequent numbers) has a value which does not exceed the threshold but is immediately before exceeding the threshold. The video data So2 (*i, j*, 6 and subsequent numbers) is set at a value indicating white or nearly white.

In this case, at the time point (t2 in the figure) when a period in which the sub pixel SPIX (i, j) is driven by the video data SO1 (*i, j*, 6) is switched to a period in which the sub pixel SPIX (i, j) is driven by the video data So2 (*i, j*, 6), the sub pixel SPIX (i, j) is instructed to switch from black display to white display. However, as discussed above, in case where liquid crystal cells in the vertical alignment mode are driven in a normally black mode, the response speed at the time of the aforesaid switch is slow, and hence the sub pixel SPIX (i, j) cannot suitably respond to the instruction. In practice, there is a time difference between a time period when the sub frame processing section 32 produces the sets of video data So1 (*i, j, k*) and So2 (*i, j, k*) and a time period when the sub pixel SPIX (i, j) starts to drive based on the video data So1 (*i, j, k*) and So2 (*i, j, k*). However, FIG. 10, FIG. 12 (mentioned later), and the descriptions thereof assume that the aforesaid time difference is 0, for the sake of convenience.

Figure 11:
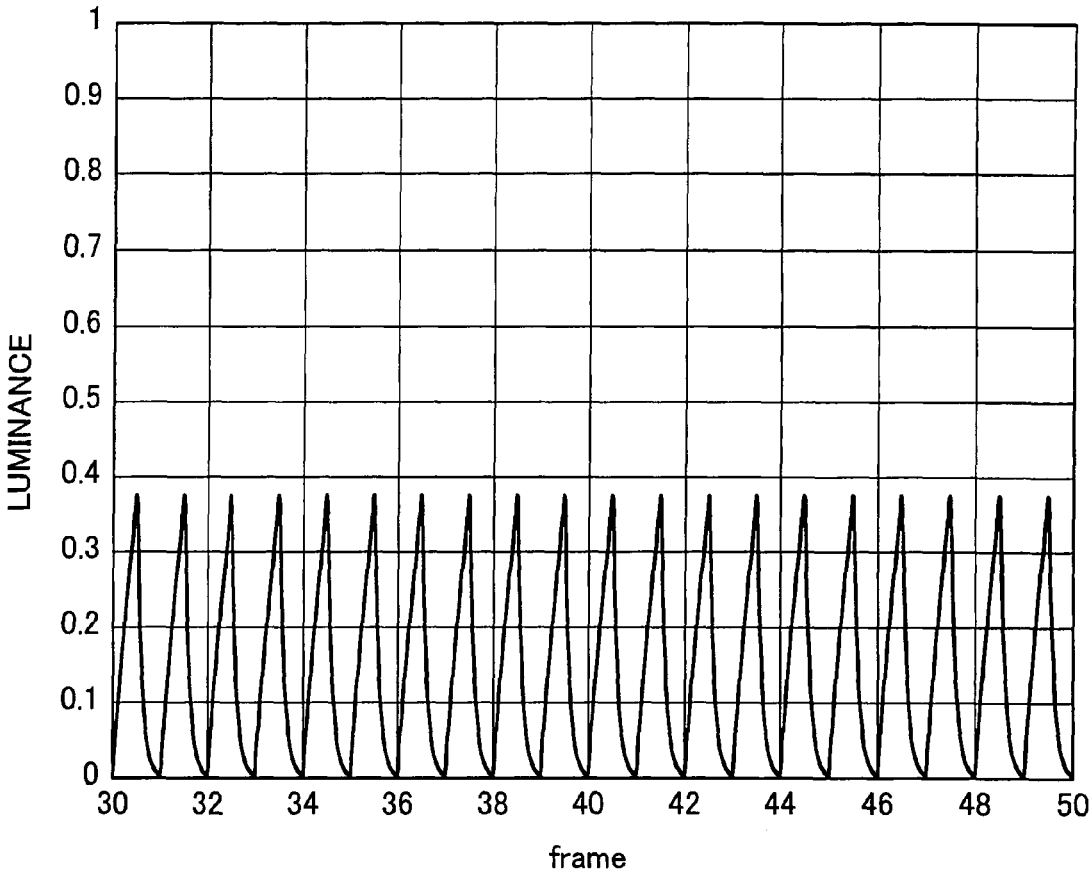
FIG. 11 is a graph showing a variation in luminance in case where the image display device is driven by the signal processing section.

FIG. 11 shows temporal changes in the luminance of the sub pixel SPIX (i, j) when a grayscale immediately before exceeding the threshold and black color are alternately required. FIG. 11 assumes that the threshold has luminance of 0.5 if the luminance of white display is 1, and the speed of grayscale transition (rising grayscale transudation) to increase the luminance is 10 times slower than the speed of grayscale transition (decaying grayscale transition) to decrease the luminance.

In this case, as shown in FIG. 11, the maximum luminance of the sub pixel SPIX (i, j) should ideally reach the luminance of white display. However, in reality the maximum luminance is only 40% of the luminance of white display. Also, the average luminance of the sub pixel SPIX (i, j), which should ideally be 50% of the luminance of white display, is only 14% of the luminance of white display, in reality.

In this manner, when a value within the range for dark display is set so as to indicate black, the response speed of the sub pixel SPIX (i, j) may deteriorate and the brightness of the sub pixel SPIX may be decreased.

In the meanwhile, in the sub frame processing section 32 of the present embodiment, the value in the range for dark display is set at a dark grayscale (e.g. grayscale 24 when grayscales are represented by gamma 2.2. and 8 bits) which is lighter than black.

Figure 12:
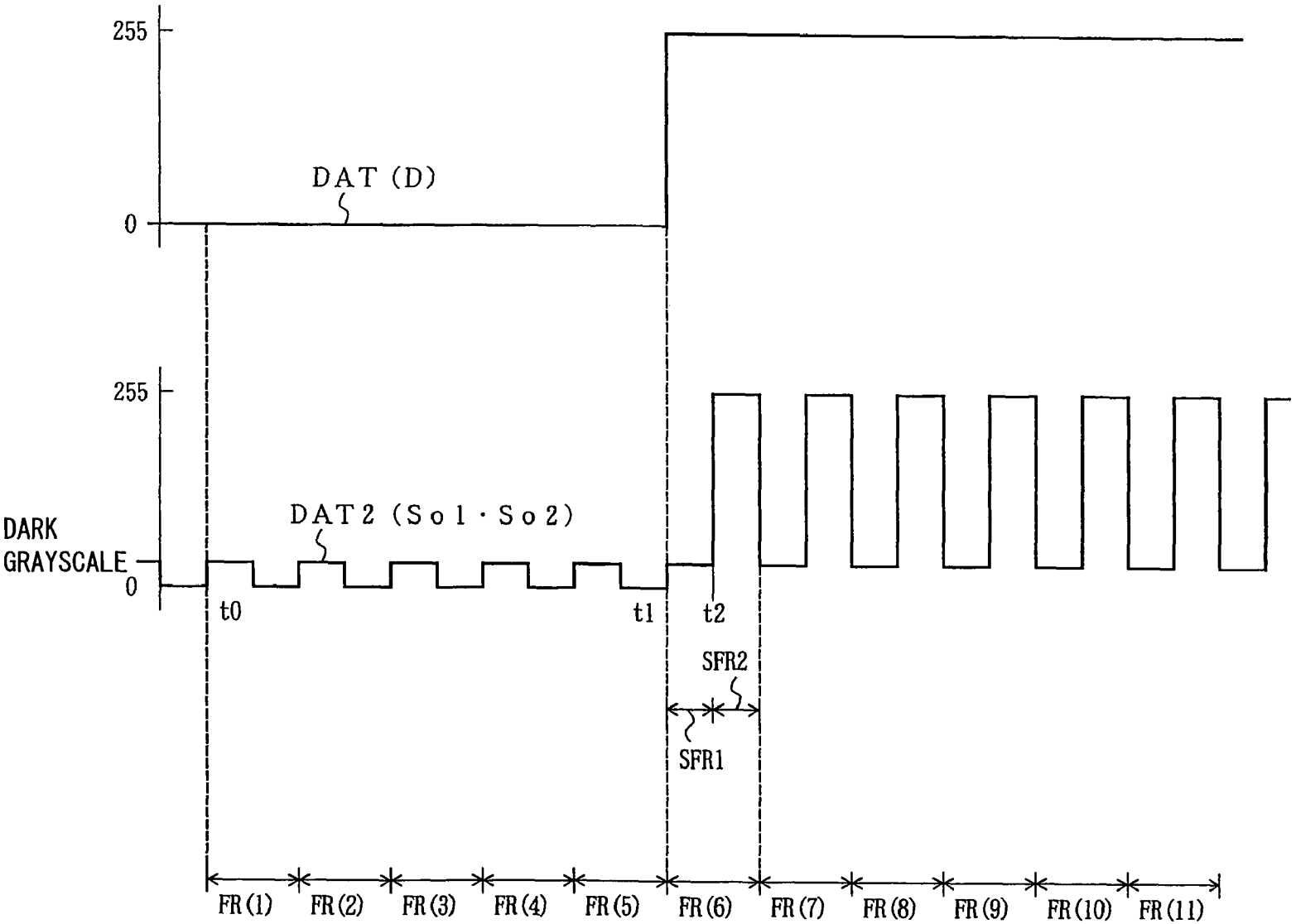
FIG. 12 is a timing chart showing a temporal change in video data input/output to/from the signal processing section of the present embodiment.

As a result, when video data (i, j, 1 and subsequent numbers) similar to the video data shown in FIG. 10 is input, the sets of video data So1 (*i, j,* 1 and subsequent numbers) and So2 (*i, j,* 1 and subsequent numbers) generated by the sub frame processing section 32 in each of the frames FR (1 and subsequent numbers) is as shown in FIG. 12. The video data So1 (*i, j,* 1 and subsequent numbers) in each of the frames FR (1 and subsequent numbers) is set at the aforesaid dark grayscale which is not black.

In this case, similarly with FIG. 10, the video data So2 (*i, j,* 6 and subsequent numbers) is set at a value indicating white or nearly white. However, the video data So1 (*i, j,* 1 and subsequent numbers) is set at a dark grayscale which is not black. Therefore, after being instructed at a time t1 to transit from black to a dark grayscale, the sub pixel SPIX (i, j) is instructed to transit from the dark grayscale to the aforesaid white or nearly white.

The grayscale transition at the time t1 is transition from black. However, since this is transition to a dark grayscale, the sub pixel SPIX (i, j) can respond within a sub frame period without any problem, even if the liquid crystal cells in the vertical alignment mode are driven in the normally black mode. On the other hand, the grayscale transition at the time t2 is not from black but from a dark grayscale. The response speed is therefore greatly improved as compared to the case of FIG. 10 where grayscale transition from black is carried out.

When the value within the range for dark display is set at a dark grayscale which is not black, the time integral value of the luminance of the sub pixel SPIX (i, j) increases (i.e. the sub pixel becomes brighter) as compared to a case where the value is set so as to indicate black. On the other hand, in case of grayscale transition to black from a dark grayscale which is sufficiently close to black, since a response speed $\tau$rise at the time of rising grayscale transition is significantly longer than a response speed $\tau$d at the time of decaying grayscale transition, a temporal average value of the luminance in an entire frame period is kept at a value indicating sufficiently dark color, and hence the viewer recognizes black color.

Figure 13:
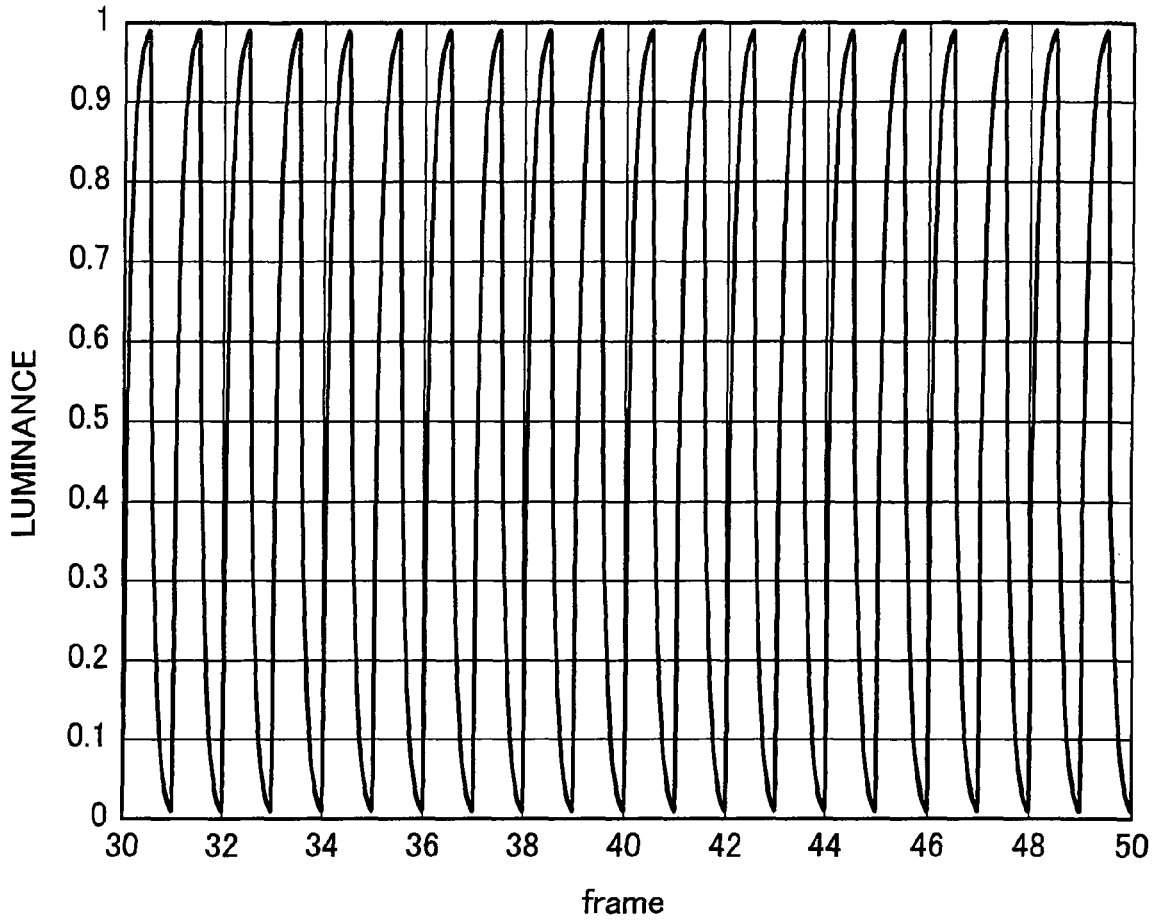
FIG. 13 is a graph showing a variation in brightness in case where the image display device is driven by the signal processing section.

Therefore, when, for example, a grayscale immediately before exceeding the threshold and black color are alternately required as in the case of FIG. 11, temporal changes in the luminance of the sub pixel SPIX (i, j) is as shown in FIG. 13, and hence the maximum luminance of the sub pixel SPIX (i, j) can reach the luminance of white display. Also, average luminance of the sub pixel SPIX (i, j) can be set at a desired value (50%). In this case, the average luminance of the sub pixel SPIX (i, j) is more than three times higher than that of the case of FIG. 11.

As a result, in comparison with the case where the value in the range for dark display is set so as to indicate black, the response speed of the sub pixel SPIX (i, j) driven with the division into sub frames is improved as above, and hence the time integral value of the luminance of the sub pixels SPIX is increased. It is therefore possible to realize an image display device 1 which is brighter and can produce moving images with better quality.

Referring to FIG. 14, the following will discuss what kind of value is preferable in typical use as the value in the range for dark display. When no voltage is applied, the liquid crystal cells are arranged such that liquid crystal molecules around the alignment film are substantially vertically aligned. Therefore the contrast ratio of the liquid crystal cells is significantly better than the TN (Twisted Nematic) type. There are many types of liquid crystal cells having the contrast ratio of around 1000. In the meanwhile, in terms of typical use, liquid crystal monitor devices, liquid crystal television receivers or the like only requires the contrast ratio of about 400.

As an example, the result shown in FIG. 14 was obtained by an examination such that, in a liquid crystal cell with the contrast ratio of about 1000, average luminance and a contrast ratio in black display were evaluated with different luminance in a sub frame SFR1 (*k*). In the figure, the luminance is normalized with the assumption that the luminance of white display is 1. As shown in the figure, the contrast ratio of about 400 was obtained when the luminance in the sub frame SFR1 (*k*) was 0.012. Therefore, with a grayscale of not greater than 32, the response speed of the sub pixel SPIX (i, j) was improved while a sufficient contrast ratio was maintained, on condition that the luminance in hold display was a grayscale of not higher than about 1% of white display, i.e. on condition that the gamma value was 2.2 and video data was represented by 8 bits, in terms of a grayscale.

In the discussion above, among the sets of video data So1 and SO2 for the respective sub frames SFR1 and SFR2, the video data SO1 which is set at a value in the range for dark display is switched to a dark grayscale which is not black, whereas the other video data SO2 is not switched from black. The video data So2, however, may be set at a dark display which is not black, as in a similar manner as the video data So1. For example, when the video data D indicates black, both sets of video data So1 and So2 may be set so as to indicate a dark grayscale.

In case where the gamma characteristic of a video signal DAT to be input is different from the gamma characteristic of the pixel array 2 (see FIG. 2) of the image display device 1, it is necessary to conduct gamma correction during a period from the input of the video signal DAT to the application of a voltage corresponding to the video signal DAT to the panel 11. Even if the video signal DAT and the pixel array 2 have the same gamma characteristics, it is necessary to conduct gamma correction during a period from the input of the video signal DAT to the application of a voltage corresponding to the video signal DAT to the panel 11, if, for example, an image will be displayed with gamma characteristic different from the original because of an instruction from the user.

In a second comparative example, gamma correction is conducted by not changing the signal supplied to the panel 11 but by controlling the voltage supplied to the panel 11. In this example, since a circuit for controlling a reference voltage is required, the circuit size may increase. In particular, if circuits for controlling reference voltages for respective color components (e.g. R, G, B) are provided for color image reproduction such as the present embodiment, the circuit size significantly increases.

Figure 15:
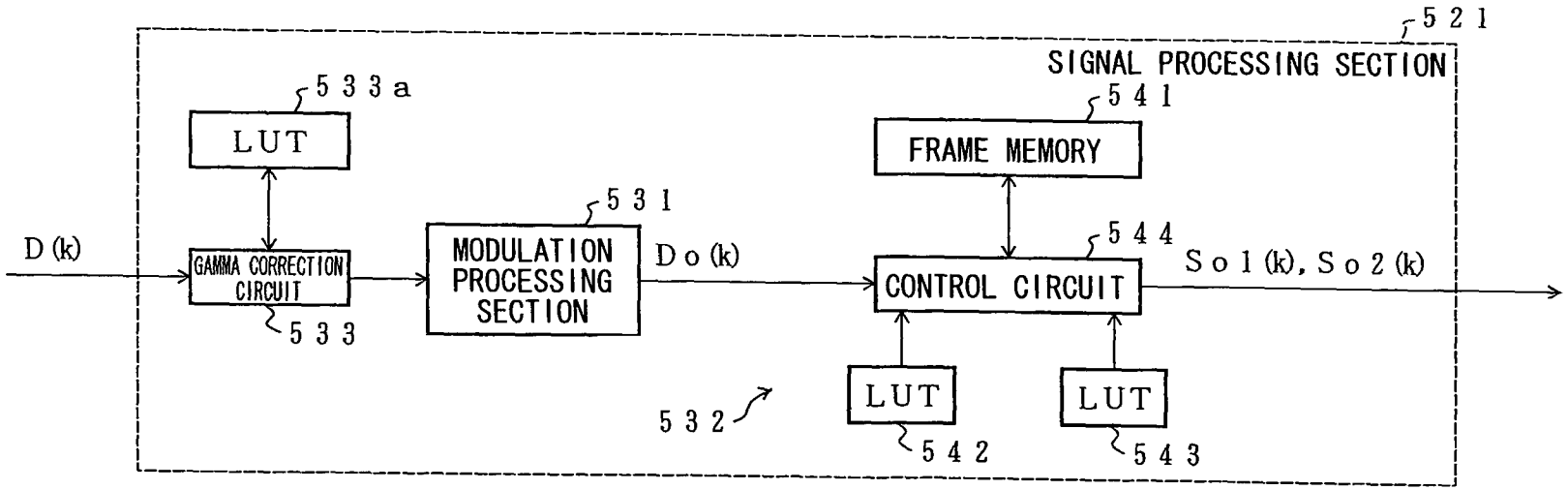
FIG. 15 relates to a comparative example and is a block diagram in which a gamma correction circuit is provided on the stage prior to a modulation processing section in the signal processing circuit.

In a third comparative example, as shown in a signal processing circuit 521 in FIG. 15, in addition to the circuits 531-544 similar to those shown in FIG. 1, a gamma correction circuit 533 for gamma correction is provided on the stage directly prior to or subsequent to (in the figure, prior to) the modulation processing section 31, so that a signal supplied to the panel 11 is changed. In this arrangement, the gamma correction circuit 533 is required in place of a circuit for controlling a reference voltage, and hence the circuit size may not be reducible. In the example shown in FIG. 15, the gamma correction circuit generates video data after gamma correction, with reference to an LUT 533*a* which stores, in association with values which may be input, output values after gamma correction.

On the other hand, in the signal processing circuit 21 of the present embodiment, the LUTs 42 and 43 store values indicating video data for each sub frame after gamma correction, so that the LUTs 42 and 43 function as the LUTs 542 and 543 for time-sharing drive and also the LUT 533*a* for gamma correction. As a result, the circuit size is reduced because the LUT 533*a* for gamma correction is unnecessary, and hence the circuit size required for the signal processing circuit 21 is significantly reduced.

Also, in the present embodiment, pairs of the LUTs 42 and 43 are provided for the respective colors (R, G, and B in this case) of the sub pixel SPIX (i, j). It is therefore possible to output different sets of video data S1*o* and S2*o* for the respective colors, and hence an output value is more suitable than a case where the same LUT is shared between different colors.

In particular, in case where the pixel array 2 is a liquid crystal display panel, gamma characteristic is different among colors because birefringence varies in accordance with a display wavelength. The aforesaid arrangement is particularly effective in this case, because independent gamma correction is preferable when grayscales are expressed by responsive integral luminance in case of time-sharing drive.

In case where a gamma value is changeable, a pair of LUTs 42 and 43 is provided for each changeable gamma value. When an instruction from, for example, the user to change a gamma value, the control circuit 44 selects a pair of LUTs 42 and 43 suitable for the instruction among the pairs of LUTs 42 and 43, and refers to the selected pair of LUTs 42 and 43. In this way the sub frame processing section 32 can change a gamma value to be corrected.

In response to an instruction to change a gamma value, the sub frame processing section 32 may change the time ratio between the sub frames SFR1 and SFR2. In such a case, the sub frame processing section 32 instructs the modulation processing section 31 to also change the time ratio between the sub frames SFR1 and SFR2 in the modulation processing section 31. Since the time ratio between the SFR1 and SFR2 is changeable in response to an instruction to change a gamma value, as detailed below, it is possible to change, with appropriate brightness, a sub frame (SFR1 or SFR2) whose luminance is used for mainly controlling the luminance in one frame period, no matter which gamma value is corrected in response to an instruction.

Figure 16:
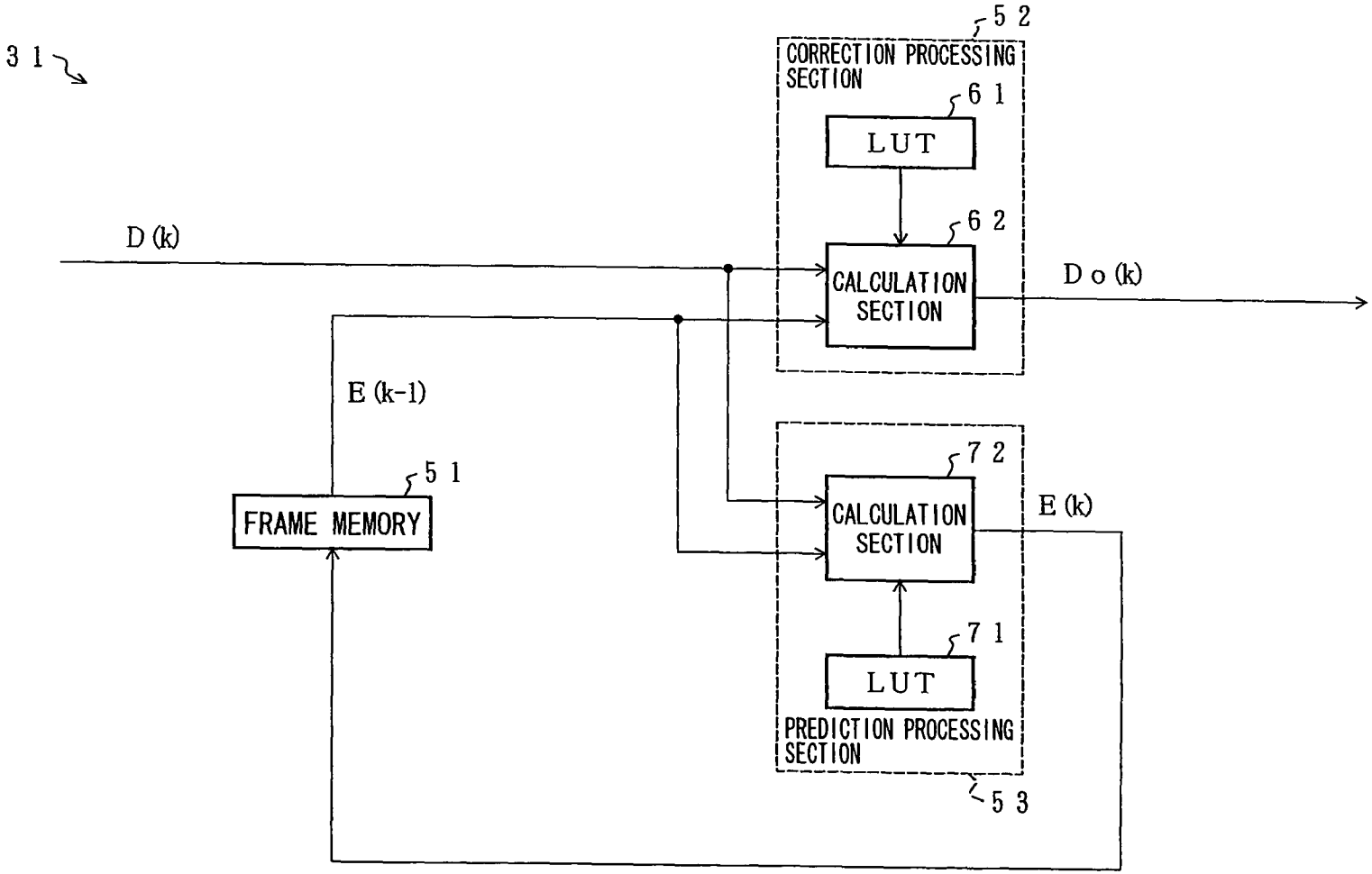
FIG. 16 shows an example of the modulation processing section in the signal processing circuit of the embodiment and is a block diagram showing the substantial part of the modulation processing section.

The following will discuss details of the modulation processing section 31, with reference to FIG. 16. The modulation processing section 31 of the present embodiment performs a predictive grayscale transition emphasizing process, and includes: a frame memory (predicted value storage means) 51 which stores a predicted value (i, j, k) of each sub pixel SPIX (i, j) until the next frame FR (k+1) comes; a correction processing section 52 which corrects video data D (i, j, k) of the current frame FR (k) with reference to the predicted value E (i, j, k−1) of the previous frame FR (k−1), which value has been stored in the frame memory 51, and outputs the corrected value as video data Do (i, j, k); and a prediction processing section 53 which updates the predicted value E (i, j, k−1) of the sub pixel SPIX (i, j), which value has been stored in the frame memory 51, to a new predicted value E (i, j, k), with reference to the video data D (i, j, k) supplied to the sub pixel (i, j) in the current frame FR (k).

The predicted value E (i, j, k) in the current frame FR (k) indicates a value of a grayscale corresponding to predicted luminance to which the sub pixel (SPIX (i, j) driven with the corrected video data Do (i, j, k) is assumed to reach at the start of the next frame FR (k+1), i.e. when the sub pixel SPIX (i, j) starts to be driven with the video data Do (i, j, k+1) in the next frame FR (k+1). Based on the predicted value E (i, j, k−1) in the previous frame FR (k−1) and the video data D (i, j, k) in the current frame FR (k), the prediction processing section 53 predicts the predicted value E (i, j, k).

As discussed above, the present embodiment is arranged as follows: frame division and gamma correction are conducted to corrected video data Do (i, j, k) so that two sets of video data So1 (*i, j, k*) and So2 (*i, j, k*) are generated in one frame, and voltages V1 (*i, j, k*) and V2 (*i, j, k*) corresponding to the respective sets of data are applied to the sub pixel SPIX (i, j) within one frame period. It is noted that, as discussed below, corrected video data Do (i, j, k) is specified by specifying a predicted value E (i, j, k−1) in the previous frame FR (k−1) and video data D (i, j, k) in the current frame FR (k), and the sets of video data So1 (*i, j, k*) and So2 (*i, j, k*) and the voltages V1 (*i, j, k*) and V2 (*i, j, k*) are specified by specifying the video data Do (i, j, k).

Since the aforesaid predicted value E (i, j, k−1) is a predicted value in the previous frame FR (k−1), the predicted value E (i, j, k−1) indicates, from the perspective of the current frame FR (k), a grayscale corresponding to predicted luminance to which the sub pixel SPIX (i, j) is assumed to reach at the start of the current frame FR (k), i.e. indicates the display state of the sub pixel SPIX (i, j) at the start of the current frame FR (k). In case where the sub pixel SPIX (i, j) is a liquid crystal display element, the aforesaid predicted value also indicates the alignment of liquid crystal molecules in the sub pixel SPIX (i, j).

Therefore, provided that the prediction by the prediction processing section 53 is accurate and the predicted value E (i, j, k−1) of the previous frame FR (k−1) has been accurately predicted, the prediction processing section 53 can precisely predict the aforesaid predicted value E (i, j, k) based on the predicted value E (i, j, k−1) of the previous frame FR (k−1) and the video data D (i, j, k) of the current frame FR (k).

In the meanwhile, the correction processing section 52 can correct video data D (i, j, k) in such a way as to emphasize the grayscale transition from the grayscale indicated by a predicted value E (i, j, k−1) in the previous frame FR (k−1) to the grayscale indicated by the video data D (i, j, k), based on (i) the video data D (i, j, k) in the current frame FR (k) and (ii) the predicted value E (i, j, k−1), i.e. the value indicating the display state of the sub pixel SPIX (i, j) at the start of the current frame FR (k).

The processing sections 52 and 53 may be constructed solely by LUTs, but the processing sections 52 and 53 of the present embodiment are constructed by using both reference process and interpolation process of the LUTs.

More specifically, the correction processing section 52 of the present embodiment is provided with an LUT 61. The LUT 61 stores, in association with respective pairs of sets of video data D (i, j, k) and predicted values (i, j, k−1), values of video data Do each of which is output when a corresponding pair is input. Any types of values may be used as the values of video data Do on condition that the video data Do can be specified by the same, as in the aforesaid case of the LUTs 42 and 43. The following description assumes that video data Do itself is stored.

The LUT 61 may store values corresponding to all possible pairs. The LUT 61 of the present embodiment, however, stores only values corresponding to predetermined pairs, in order to reduce the storage capacity. In case where a pair which is not stored in the LUT 61 is input, a calculation section 62 provided in the correction processing section 52 reads out values corresponding pairs similar to the pair thus input, and performs interpolation of these values by conducting a predetermined calculation so as to figure out a value corresponding to the pair thus input.

Similarly, an LUT 71 provided in the prediction processing section 53 of the present embodiment stores, in association with respective pairs of sets of video data (i, j, k) and predicted values E (i, j, k−1), values each of which is output when a corresponding pair is input. The LUT 71 also stores values to be output (in this case, predicted values E (i, j, k)) in a similar manner as above. Furthermore, as in the case above, pairs of values stored in the LUT 71 are limited to predetermined pairs, and a calculation section 72 of the prediction processing section 53 figures out a value corresponding to a pair thus input, by conducting an interpolation calculation with reference to the LUT 71.

In the arrangement above, the frame memory 51 stores not video data D (i, j, k−1) of the previous frame FR (k−1) but a predicted value E (i, j, k−1). The correction processing section 52 corrects the video data D (i, j, k) of the current frame FR (k) with reference to the predicted value E (i, j, k−1) of the previous frame FR, i.e. a value indicating predicted display state of the sub pixel SPIX (i, j) at the start of the current frame FR (k). It is therefore possible to prevent inappropriate grayscale transition emphasis, even if transition from rise to decay frequently occurs as a result of improvement in the quality of moving images by simulating impulse-type light emission.

More specifically, in case where a sub pixel SPIX (i, j) with a slow response speed is adopted, grayscale transition from last but one sub frame to last sub frame is emphasized, the luminance of the sub pixel SPIX at the end of the last sub frame SFR (x−1) (i.e. the luminance at the start of the current sub frame FR (x)) may not reach the luminance indicated by the video data So (i, j, x) in the last sub frame SFR (x−1). This occurs, for example, when a difference between grayscales is great and when a grayscale before grayscale transition emphasis is close to the maximum or minimum value so that the grayscale transition cannot be sufficiently emphasized.

In the case above, if the signal processing circuit 21 emphasizes grayscale transition with the assumption that the luminance at the start of the current sub frame FR (x) has reached the luminance indicated by the video data So (i, j, x) in the previous sub frame SFR (x−1), the grayscale transition may be excessive or insufficient.

In particular, when (rising) grayscale transition to increase luminance and (decaying) grayscale transition to decrease luminance are alternately repeated, the grayscale transition is excessive and hence the luminance of the sub pixel SPIX (i, j) is inappropriately high. As a result, the user is likely to take notice of the inappropriate grayscale transition emphasis and hence the image quality may be deteriorated.

On the other hand, as described above, the present embodiment is arranged in such a manner that voltages V1 (*i, j, k*) and V2 (*i, j, k*) corresponding to sets of video data So1 (*i, j, k*) and So2 (*i, j, k*) are applied to the sub pixel SPIX (i, j) so that the sub pixel SPIX (i, j) simulates impulse-type light emission. The luminance that the sub pixel SPIX (i, j) should have increased or decreased in each sub frame. Therefore the image quality may be deteriorated by inappropriate grayscale transition emphasis with the assumption above.

In this connection, in the present embodiment, prediction is highly precisely carried out with reference to a predicted value E (i, j, k), as compared to the assumption above. It is therefore possible, by simulating impulse-type light emission, to prevent grayscale transition emphasis from being inappropriate, even if transition from rise to decay frequently occurs. As a result, the quality of moving images is improved by simulating impulse-type light emission, without causing deterioration in image quality due to inappropriate grayscale transition emphasis. Other examples to carry out prediction with higher precision than the aforesaid assumption are as follows: prediction is carried out with reference to plural sets of video data which have been input; prediction is carried out with reference to plural results of previous predictions; and prediction is carried out with reference to plural sets of video data including at least a current set of video data, among sets of video data having been input and the current set of video data.

The response speed of a liquid crystal cell which is in the vertical alignment mode and the normally black mode is slow in decaying grayscale transition as compared to rising grayscale transition. Therefore, even if modulation and driving are performed in such a way as to emphasize grayscale transition, a difference between actual grayscale transition and desired grayscale transition tends to occur in grayscale transition from the last but one sub frame to the last sub frame. Therefore an exceptional effect is obtained when the aforesaid liquid crystal cell is used as the pixel array 2 as in the present embodiment.

The following will give details of division into sub frames by the sub frame processing section 32 (i.e. generation of sets of video data S1*o* and S2*o*) with reference to FIGS. 17-30(*c*), with the assumption that the pixel array 2 is a VA-mode active matrix (TFT) liquid crystal panel and each sub pixel SPIX is capable of expressing 8-bit grayscales. In the following, sets of video data S1*o* and S2*o* are termed a first display signal and a second display signal, respectively, for the sake of convenience.

First, typical display luminance (luminance of an image displayed on a liquid crystal panel) of a liquid crystal panel will be discussed.

In case where an image based on normal 8-bit data is displayed in one frame without using sub frames (i.e. normal hold display in which each of the scanning signal lines GL1-GLm of the liquid crystal panel is turned on only once in one frame period), the luminance grayscales (signal grayscales) of a signal (video signal DAT2) applied to the liquid crystal panel have 0 to 255 levels.

A signal grayscale and display luminance in the liquid crystal panel are approximated by the following equation (1).

$$((T-T0)/(T\max-T0))=(L/L\max)\hat{}\gamma \quad (1)$$

In the equation, L indicates a signal grayscale (frame grayscale) in case where an image is displayed in one frame (i.e., an image is displayed with normal hold display), Lmax indicates the maximum luminance grayscale (255), T indicates display luminance, Tmax indicates the maximum luminance (luminance when L=Lmax=255; white), T0 indicates the minimum luminance (luminance when L=0; black), and γ is a correction value (typically set at 2.2).

Although T0 is not 0 in an actual liquid crystal display panel, the following assumes that T0=0, for the sake of simplicity.

In addition, the display luminance T of the liquid crystal panel in the case above (normal hold display) is shown in above-mentioned FIG. 8.

In the graph in FIG. 8, the horizontal axis indicates luminance to be output (predicted luminance; which is a value corresponding to a signal grayscale and is equivalent to the display luminance T) whereas the vertical axis indicates luminance (actual luminance) which has actually been output.

As shown in the graph, in the case above, the aforesaid two sets of luminance are equal to one another when the liquid crystal panel is viewed head-on (i.e. the viewing angle is 0°).

On the other hand, in case where the viewing angle is 60°, actual luminance is unnecessarily bright around intermediate luminance, because of change in grayscale gamma characteristic.

Now, the display luminance of the image display device 1 of the present example will be discussed In the image display device 1, the control circuit 44 is designed to perform grayscale expression to meet the following conditions:

(a) a time integral value (integral luminance in one frame) of the luminance (display luminance) of an image displayed on the pixel array 2 in each of a first sub frame and a second sub frame is equal to the display luminance in one frame in the case of normal hold display; and (b) the aforesaid dark grayscale display or white display (maximum luminance) is conducted in either of the sub frames.

For that purpose, in the image display device 1 of the present example, the control circuit 44 is designed so that a frame is equally divided into two sub frames and luminance up to the half of the maximum luminance is attained in one sub frame.

That is to say, in case where luminance (threshold luminance; Tmax/2) up to the half of the maximum luminance is attained in one frame (i.e. in the case of low luminance), the control circuit 44 performs grayscale expression in such a way that dark grayscale display is performed in the first sub frame and display luminance is adjusted only in the second sub frame (in other words, grayscale expression is carried out by using only the second sub frame).

In this case, the integral luminance in one frame is expressed as (minimum luminance+luminance in the second sub frame)/2.

In case where luminance higher than the aforesaid threshold luminance is attained (in the case of high luminance), the control circuit 44 performs grayscale expression in such a manner that the maximum luminance (white) is attained in the second sub frame and the display luminance is adjusted in the first sub frame.

In this case, the integral luminance in one frame is represented as (luminance in the first sub frame+maximum luminance)/2.

The following will specifically discuss signal grayscale setting of display signals (first display signal and second display signal) for attaining the aforesaid display luminance.

The signal grayscale setting is carried out by the control circuit shown in FIG. 1.

Using the equation (1), the control circuit 44 calculates a frame grayscale corresponding to the threshold luminance (Tmax/2) in advance.

That is to say, a frame grayscale (threshold luminance grayscale; Lt) corresponding to the display luminance above is figured out by the following equation (2), based on the equation (1).

$$Lt=0.5\hat{}(1/\gamma)\times Lmax \quad (2)$$

In this equation, it is noted that $$Lmax=Tmax\hat{}\gamma \quad (2a)$$

To display an image, the control circuit 44 determines the frame grayscale L, based on the video signal supplied from the frame memory 41.

If L is not larger than Lt, the control circuit 44 minimizes (reduces to 0) the luminance grayscale (hereinafter, F) of the first display signal, by means of the first LUT 42.

On the other hand, based on the equation (1), the control circuit 44 determines the luminance grayscale (hereinafter, R) of the second display signal as follows, by means of the second LUT 43.

$$R=0.5\hat{}(1/\gamma)\times L \quad (3)$$

In case where the frame grayscale L is larger than Lt, the control circuit 44 maximizes (increases to 255) the luminance grayscale R of the second display signal.

At the same time, based on the equation (1), the control circuit 44 determines the luminance grayscale F in the first sub frame as follows.

$$F=(L\hat{}\gamma-0.5\times Lmax\hat{}\gamma)\hat{}(1/\gamma) \quad (4)$$

Now, the following gives details of how the image displayed device 1 of the present example outputs a display signal.

In the present case, the control circuit 44 send, to the control circuit 12 shown in FIG. 2, a video signal DAT2 after the signal processing, so as to cause, with a doubled clock, the data signal line drive circuit 3 to accumulate a first display signal supplied to (n) sub pixels SPIX on the first scanning signal line GL1.

The control circuit 44 then causes, via the control circuit 12, the scanning signal line drive circuit 4 to turn on (select) the first scanning signal line GL1, and also causes the scanning signal line drive circuit 4 to write a first display signal into the sub pixels SPIX on the scanning signal line GL1. Subsequently, the control circuit 44 similarly turns on second to m-th scanning signal lines GL2-GLm at a doubled clock, with first display signal to be accumulated being varied. With this, a first display signal is written into all sub pixels SPIX in the half of one frame (½ frame period).

The control circuit then similarly operates so as to write a second display signal into the sub pixels SPIX on all scanning signal lines GL1-GLm, in the remaining ½ frame period.

As a result, the first display signal and the second display signal are written into the sub pixels SPIX in the respective periods (½ frame periods) which are equal to each other.

The above-mentioned FIG. 9 is a graph showing, along with the results (dashed line and full line) in FIG. 2, the results (dotted line and full line) of sub frame display by which the first display signal and the second display signal are output in the respective first and second sub frames.

As shown in FIG. 8, the image display device 1 of the present example adopts a liquid crystal panel which is arranged such that, the difference between actual luminance and planned luminance (equivalent to the full line) in a large viewing angle is minimized when the display luminance is minimum or maximum, whereas the difference is maximized in intermediate luminance (around the threshold luminance).

Also, the image display device 1 of the present example carries out sub frame display with which one frame is divided into sub frames.

Further, two sub frames are set so as to have the same length of time, and in case of low luminance, dark grayscale display is carried out in the first sub frame and image display is carried out only by the second sub frame, to the extent that the integrated luminance in one frame is not changed.

Since the deviance in the first sub frame is minimized, the total deviance in the first and second sub frames is substantially halved as indicated by the dotted line in FIG. 9.

On the other hand, in the case of high luminance, white display is carried out in the second sub frame and image display is performed only by adjusting the luminance in the first sub frame, to the extent that the integrated luminance in one frame is not changed.

Since the deviance in the second sub frame is also minimized in this case, the total deviance in the first and second sub frames is substantially halved.

In this way, in the image display device 1 of the present example, overall deviance is substantially halved as compared to normal hold display (an image is displayed in one frame, without adopting sub frames).

It is therefore possible to restrain the problem that an image with intermediate luminance is excessively bright and appears whitish (whitish appearance) as shown in FIG. 8.

The first sub frame and the second sub frame are equal in time length in the present example. This is because luminance half as much as the maximum luminance is attained in one sub frame.

These sub frames, however, may have different lengths.

The whitish appearance, which is a problem in the image display device 1 of the present example, is a phenomenon that actual luminance has the characteristics shown in FIG. 8 in the case of a large viewing angle, and hence an image with intermediate luminance is excessively bright and appears whitish.

An image taken by a camera is typically converted to a signal generated based on luminance. To send the image in a digital form, the image is converted to a display signal by using "γ" in the equation (1) (in other words, the signal based on luminance is raised to (1/γ)th power and grayscales are attained by equal division).

An image which is displayed based on the aforesaid display signal on the image display device 1 such as a liquid crystal panel has display luminance expressed by the equation (1).

Human eyes perceive an image not as variation in luminance but as variation in brightness. Brightness (brightness index) M is expressed by the following equations (5) and (6) (see non-patent document 3).

$$M=116\times Y^{\wedge}(1/3)-16,\ Y>0.008856 \quad (5)$$

$$M=903.29\times Y,\ Y\leqq 0.008856 \quad (6)$$

In the equations, Y is equivalent to the aforesaid actual luminance and Y=(y/yn). It is noted that y indicates a "y" value of three stimulation values in an xyz color system of a color, whereas yn is a y value of standard light from a perfectly diffuse reflector and yn=100.

The equations above show that humans are sensitive to images with low luminance and gets insensitive to images with higher luminance.

It is therefore considered that not deviance in luminance but deviance in brightness is perceived by humans as whitish appearance.

Figure 17:
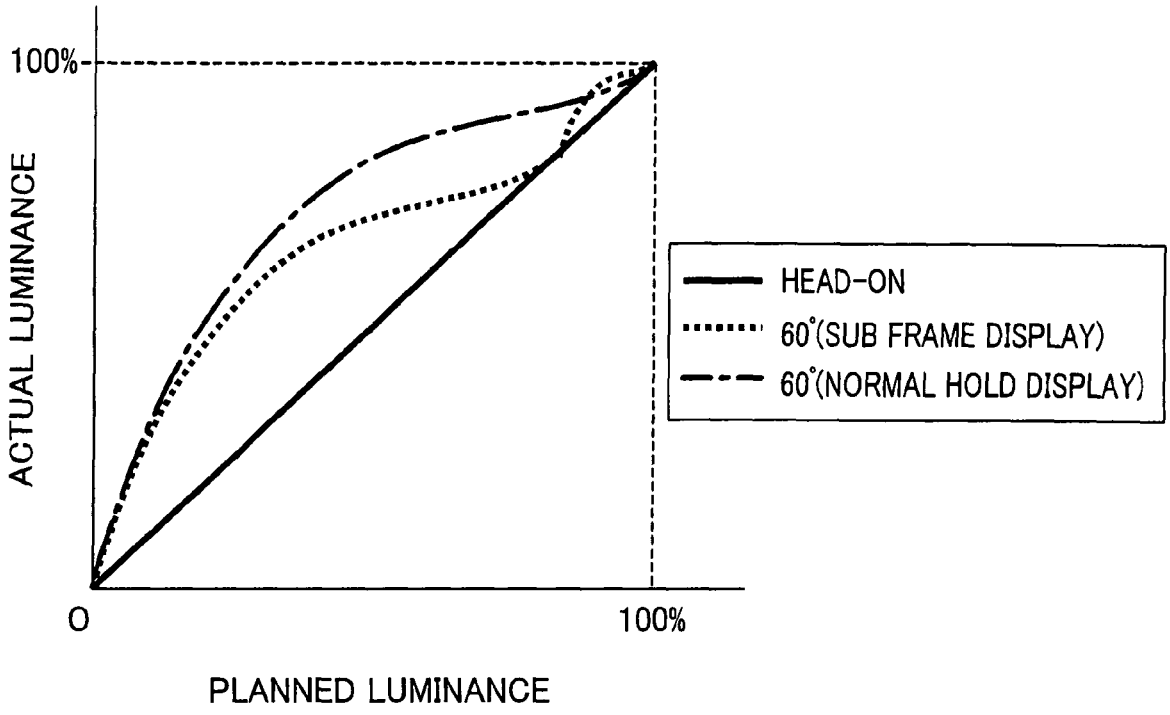
FIG. 17 is a graph in which the luminance in the graph of FIG. 14 is converted to brightness.

FIG. 17 is a graph in which the graph of luminance shown in FIG. 8 is converted to a graph of brightness.

In this graph, the horizontal axis indicates "brightness which should be attained (planned brightness; a value corresponding to a signal grayscale and equivalent to the aforesaid brightness M)" whereas the vertical axis indicates "brightness which is actually attained (actual brightness)"

As indicated by the full line in the graph, the above-described two sets of brightness are equal when the liquid crystal panel is viewed head-on (i.e. viewing angle of 0°).

On the other hand, in case where the viewing angle is 60° and sub frames are equal to each other (i.e. luminance up to the maximum value is attained in one sub frame), as indicated by the dotted line in the graph, the difference between the actual brightness and the planned brightness is restrained as compared to the conventional normal hold display. Whitish appearance is therefore restrained to some degree.

To further restrain whitish appearance in accordance with visual perception of humans, it is considered that the ratio of frame division is preferably determined in accordance with not luminance but brightness.

Difference between actual brightness and planned brightness is maximized at the brightness which is half as much as the maximum value of the planned brightness, as in the case of luminance.

For this reason, deviance (i.e. whitish appearance) perceived by humans is restrained when a frame is divided so that brightness up to the half of the maximum value is attained in one sub frame, as compared to the case where a frame is divided so that luminance up to the half of the maximum value is attained in one sub frame.

The following will discuss how a frame should preferably be divided.

To simplify calculations, the above-mentioned equations (5) and (6) are approximated into an equation (6a) (which is similar to the equation (1)).

$$M=Y^{\wedge}(1/\alpha) \quad (6a)$$

With this conversion, a in this equation is about 2.5.

It is considered that the relationship between the luminance Y and the brightness M is appropriate (i.e. suitable for visual perception of humans), if the value of α is in a range between 2.2. and 3.0.

To attain the brightness M which is half as much as the maximum value in one sub frame, it has been known that two sub frames are set so as to be in the ration of about 1:3 when y=2.2 or about 1:7 when γ=3.0.

In dividing a frame in this way, the sub frame for image display in the case of low luminance is set so as to be shorter than the other sub frame (in the case of high luminance, the sub frame in which the maximum luminance is maintained is set so as to be shorter than the other sub frame).

The following will discuss a case where the first sub frame and the second sub frame are in the ratio of 3:1 in time length.

First, display luminance in this case is discussed.

In this case, to perform low-luminance display with which luminance up to ¼ of the maximum luminance (i.e. threshold luminance; Tmax/4) is attained in one frame, the control circuit 44 performs dark grayscale display in the first sub frame and expresses a grayscale by only adjusting the display luminance in the second sub frame. (In other words, grayscale expression is carried out only by the second sub frame.)

On this occasion, the integrated luminance in one frame is figured out by (minimum luminance+luminance in the second sub frame)/4.

In case where luminance higher than the threshold luminance (Tmax/4) is attained in one frame (i.e. in case of high luminance), the control circuit 44 operates so that the maximum luminance (white) is attained in the second sub frame whereas grayscale expression is performed by only adjusting the display luminance in the first sub frame.

In this case, the integrated luminance in one frame is figured out by (luminance in the first sub frame+maximum luminance)/4.

Now, the following will specifically describe signal grayscale setting of display signals (first display signal and second display signal) for attaining the aforesaid display luminance.

Also in this case, the signal grayscale (and below-mentioned output operation) is (are) set so that the above-described conditions (a) and (b) are satisfied.

First, using the equation (1), the control circuit 44 calculates a frame grayscale corresponding to the threshold luminance (Tmax/4) in advance.

The frame grayscale (threshold luminance grayscale; Lt) corresponding to the display luminance is calculated by the following equation, based on the equation (1):

$$Lt=(1/4)\hat{}(1/\gamma)\times L\max \quad (7)$$

To display an image, the control circuit 44 works out a frame grayscale L based on a video signal supplied from the frame memory 41.

If L is not higher than Lt, the control circuit 44 minimizes (to 0) the luminance grayscale (F) of the first display signal, by using the first LUT 42.

In the meanwhile, the control circuit 44 sets the luminance grayscale (R) of the second display signal as follows, based on the equation (1).

$$R=(1/4)\hat{}(1/\gamma)\times L \quad (8)$$

In doing so, the control circuit 44 uses the second LUT 43.

If the frame grayscale L is higher than Lt, the control circuit 44 maximizes (to 255) the luminance grayscale R of the second display signal.

In the meanwhile, the control circuit 44 sets the luminance grayscale F of the first sub frame as follows, based on the equation (1).

$$F=((L\hat{}\gamma-(1/4)\times L\max\hat{}\gamma))\hat{}(1/\gamma) \quad (9)$$

Now, the following will discuss how the above-mentioned first display signal and second display signal are output.

As discussed above, in the arrangement of equally dividing a frame, a first-stage display signal and a second-stage display signal are written into a sub pixel SPIX, for respective periods (½ frame periods) which are equal to one another.

This is because, since the second-stage display signal is written after all of the first-stage display signal is written at a doubled clock, periods in which the scanning signal lines GL are turned on are equal for the respective display signals.

Therefore, the ratio of division is changeable by changing the timing to start the writing of the second-stage display signal (i.e. timing to turns on the scanning signal lines GL for the second-stage display signal).

Figure 18:
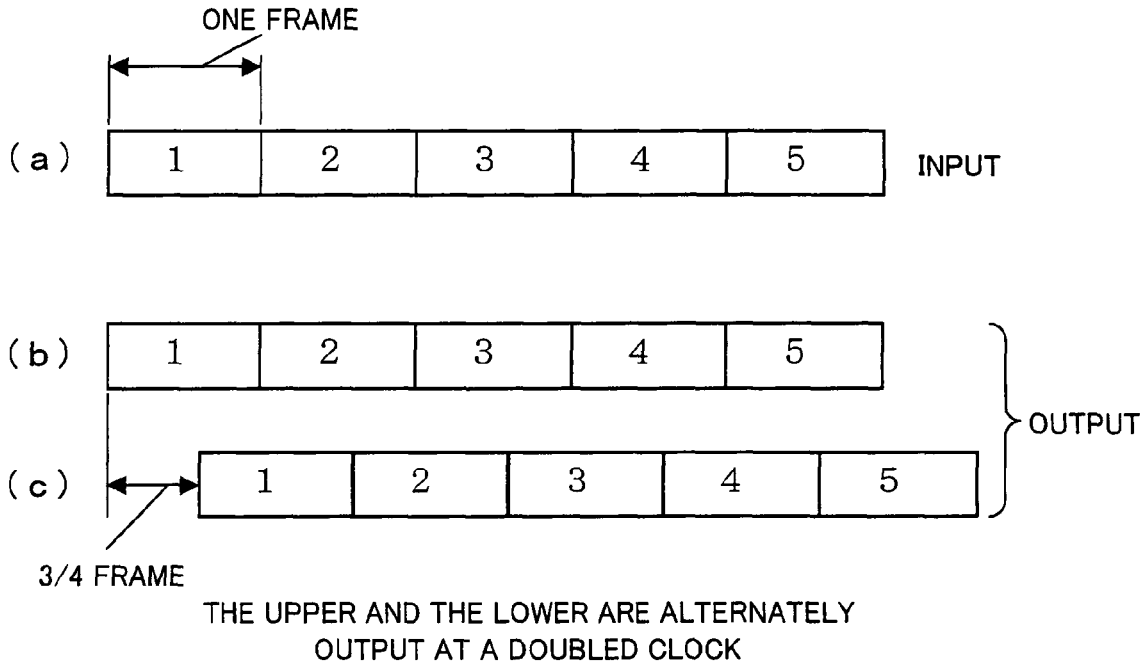
FIG. 18 illustrates a video signal supplied to the frame memory shown in FIG. 1 and video signals supplied from the frame memory to a first LUT and a second LUT.

In FIG. 18, (a) indicates a video signal supplied to the frame memory 41 shown in FIG. 1, (b) indicates a video signal supplied from the frame memory 41 to the first LUT 42 when the division is carried out at the ratio of 3:1, and (c) indicates a video signal supplied to the second LUT 43.

Figure 19:
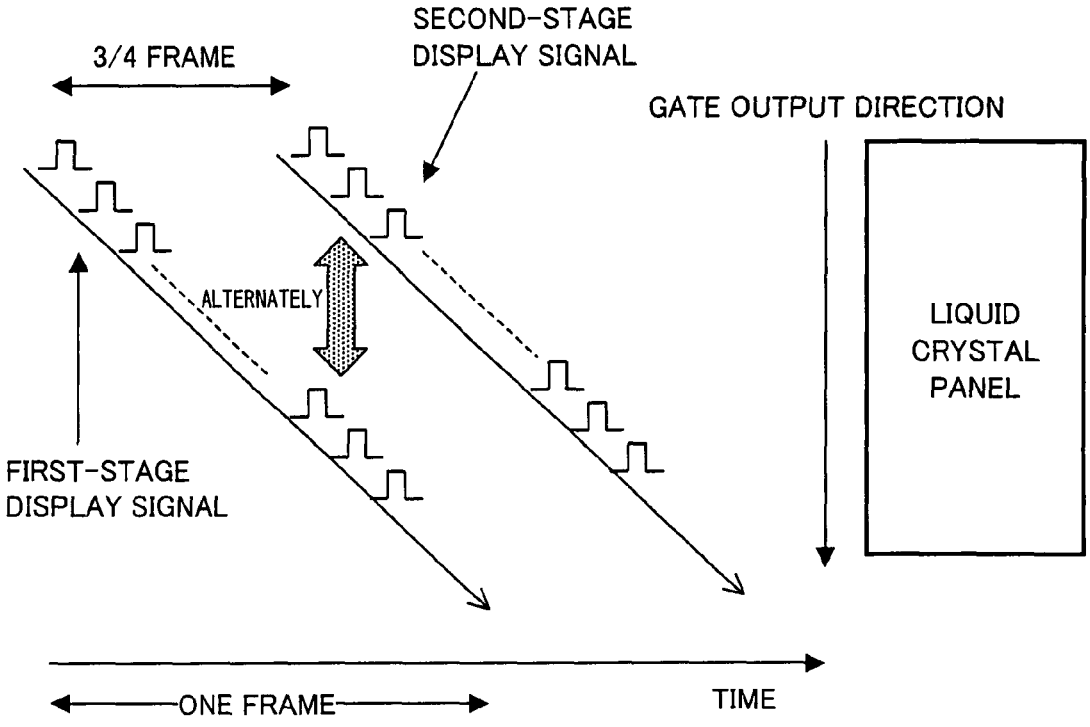
FIG. 19 relates to the embodiment and illustrates timings to turn on scanning signal lines in relation to a first display signal and a second display signal, in case where a frame is divided into 3:1.

FIG. 19 illustrates timings to turn on the scanning signal lines GL for the first-stage display signal and for the second-stage display signal, also in case where the division is carried out at the ratio of 3:1.

As shown in these figures, the control circuit 44 in this case writes the first-stage display signal for the first frame into the sub pixels SPIX on the respective scanning signal lines GL, at a normal clock.

After a ¾ frame has passed, the writing of the second-stage display signal starts. From this time, the first-stage display signal and the second-stage display signal are alternately written at a doubled clock.

That is to say, after the first-stage display signal is written into the (¾ of all scanning signal lines GL1-GLm)th GL(m*¾) sub pixel SPIX, the second-stage display signal regarding the first scanning signal GL1 is accumulated in the data signal line drive circuit 3, and this scanning signal line GL1 is turned on.

In this way, after ¾ of the first frame, the first-stage display signal and the second-stage display signal are alternately output at a doubled clock, with the result that the ratio between the first sub frame and the second sub frame is set at 3:1.

The time integral value (integral summation of the display luminance in these two sub frames indicates integral luminance of one frame.

The data stored in the frame memory 41 is supplied to the data signal line drive circuit 3, at timings to turn on the scanning signal lines GL.

Figure 20:
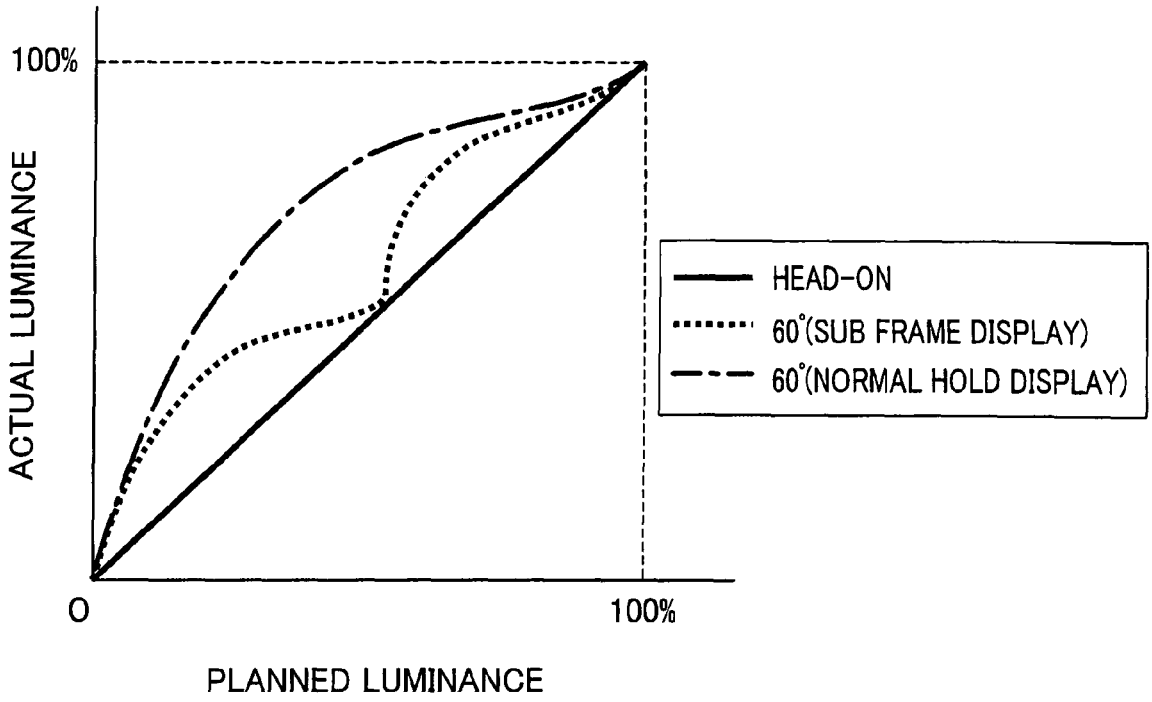
FIG. 20 is a graph showing relations between planned brightness and actual brightness in case where a frame is divided into 3:1.

FIG. 20 is a graph showing the relationship between planned brightness and actual brightness in case where a frame is divided at a ratio of 3:1.

As shown in the figure, in the arrangement above, the frame is divided at the point where the difference between planned brightness and actual brightness is maximized. For this reason, the difference between planned brightness and actual brightness at the viewing angle of 60° is very small as compared to the result shown in FIG. 17.

More specifically, in the image display device 1 of the present example, in the case of low luminance (low brightness) up to Tmax/4, dark grayscale display is carried out in the first sub frame and hence image display is performed only in the second sub frame, to the extent that the integral luminance in one frame is not changed.

As such, the deviance in the first sub frame (i.e. the difference between actual brightness and planned brightness) is minimized. It is therefore possible to substantially halve the total deviance in the both sub frames, as indicated by the dotted line in FIG. 20.

On the other hand, in the case of high luminance (high brightness), white display is carried out in the second sub frame and hence image display is carried out by adjusting the luminance in the first sub frame, to the extent that the integral luminance in one frame is not changed.

Therefore, since the deviance in the second sub frame is also minimized in this case, the total deviance in the both sub frames is substantially halved as indicated by the dotted line in FIG. 20.

In this manner, in the image display device 1 of the present example, the overall deviance of brightness is substantially halved as compared to normal hold display.

It is therefore possible to effectively restrain the problem that an image with intermediate luminance is excessively bright and appears whitish (whitish appearance) as shown in FIG. 8.

In the case above, until a ¾ frame period passes from the start of display, the first-stage display signal for the first frame is written into the sub pixels SPIX on all scanning signal lines GL, at a normal clock. This is because the timing to write the second-stage display signal has not come yet.

Alternatively, display with a doubled clock may be performed from the start of the display, by using a dummy second-stage display signal. In other words, the first-stage display signal and the (dummy) second-stage display signal whose signal grayscale is 0 may be alternately output until a ¾ frame period passes from the start of display.

The following will deal with a more general case where the ratio between the first sub frame and the second sub frame is n:1.

In this case, to attain luminance up to 1/(n+1) (threshold luminance; Tmax/(n+1)) of the maximum luminance in one frame (i.e. in the case of low luminance), the control circuit 44 performs grayscale expression in such a manner that dark grayscale display is performed in the first sub frame and hence grayscale expression is performed by only adjusting the luminance in the second sub frame (i.e. grayscale expression is carried out only by using the second sub frame).

In this case, the integral luminance in one frame is figured out by (minimum luminance+luminance in the second sub frame)/(n+1).

In case where luminance higher than a threshold luminance (Tmax/(n+1)) is output (i.e. in the case of high luminance), the control circuit 44 performs grayscale expression in such a manner that the maximum luminance (white) is attained in the second sub frame and the display luminance in the first sub frame is adjusted.

In this case, the integral luminance in one frame is figured out by (luminance in the first sub frame+maximum luminance)/(n+1).

The following will specifically discuss signal grayscale setting of signals (first-stage display signal and second-stage display signal) for attaining the aforesaid display luminance.

Also in this case, the signal grayscale (and below-mentioned output operation) is (are) set so as to satisfy the aforesaid conditions (a) and (b).

First, the control circuit calculates a frame grayscale corresponding to the above-described threshold luminance (Tmax/(n+1)), based on the equation (1) above.

Based on the equation (1), a frame grayscale (threshold luminance grayscale; Lt) corresponding to the display luminance is figured out as follows.

$$Lt=(1/(n+1))\hat{}(1/\gamma)\times L\max \quad (10)$$

To display an image, the control circuit 44 figures out a frame grayscale L based on a video signal supplied from the frame memory 41.

If L is not higher than Lt, the control circuit 44 minimizes (to 0) the luminance grayscale (F) of the first-stage display signal, by using the first LUT 42.

On the other hand, the control circuit 44 sets the luminance grayscale (R) of the second-stage display signal as follows, based on the equation (1).

$$R=(1/(n+1))\hat{}(1/\gamma)\times L \quad (11)$$

In doing so, the control circuit 44 uses the second LUT 43.

If the frame grayscale L is higher than Lt, the control circuit 44 maximizes (to 255) the luminance grayscale R of the second-stage display signal.

In the meanwhile, the control circuit 44 sets the luminance grayscale F in the first sub frame as follows, based on the equation (1).

$$F=((L\hat{}\gamma-(1/(n+1))\times L\max\hat{}\gamma))\hat{}(1/\gamma) \quad (12)$$

The operation to output the display signals is arranged such that, in case where one frame is divided in the ratio of 3:1, the first-stage display signal and the second-stage display signal are alternately output at a doubled clock, when a n/(n+1) frame period has passed from the start of one frame.

An arrangement of equally dividing a frame is generalized as follows: one frame is divided into 1+n (=1) sub frame periods, and the first-stage display signal is output at a clock multiplied 1+n (=1) times in the first sub frame whereas the second-stage display signal is serially output in the following n (=1) sub frames.

In this arrangement, however, the clock is required to be significantly increased when n is 2 or more, thereby resulting increase in device cost.

On this account, if n is 2 or more, the aforesaid arrangement in which the first-stage display signal and the second-stage display signal are alternately output is preferable.

In this case, since the ratio between the first sub frame and the second sub frame can be set at n: 1 by adjusting the timing to output the second-stage display signal, the required clock frequency is restrained to twice as fast as the normal clock.

The liquid crystal panel is preferably AC-driven, because, with AC drive, the electric field polarity (direction of a voltage (interelectrode voltage) between pixel electrodes sandwiching liquid crystal) of the sub pixel SPIX is changeable in each frame.

When the liquid crystal panel is DC-driven, a one-sided voltage is applied to the space between the electrodes and hence the electrodes are charged. If this state continues, an electric potential difference exists between the electrodes even if no voltage is applied (i.e. so-called burn-in occurs).

In case of sub frame display as in the case of the image display device 1 of the present example, voltage values (absolute values) applied to the space between the pixel electrodes are often different between sub frames.

Therefore, when the polarity of the interelectrode voltage is reversed in the cycle of sub frames, the interelectrode voltage to be applied is one-sided on account of the difference in voltage values between the first sub frame and the second sub frame. Therefore, the aforesaid burn-in, flicker, or the like may occur when the liquid crystal panel is driven for a long period of time, because the electrodes are charged.

Therefore, in the image display device 1 of the present example, the polarity of the interelectrode voltage is preferably reversed in the cycle of frames.

There are two methods to reverse the polarity of the interelectrode voltage in the cycle of frames. According to the first method, a voltage with the same polarity is applied for one frame.

According to the second method, the polarity of the interelectrode voltage is changed between two sub frames of one frame, and the second sub frame and the first sub frame of the directly subsequent frame are arranged so as to have the same polarity.

Figure 21:
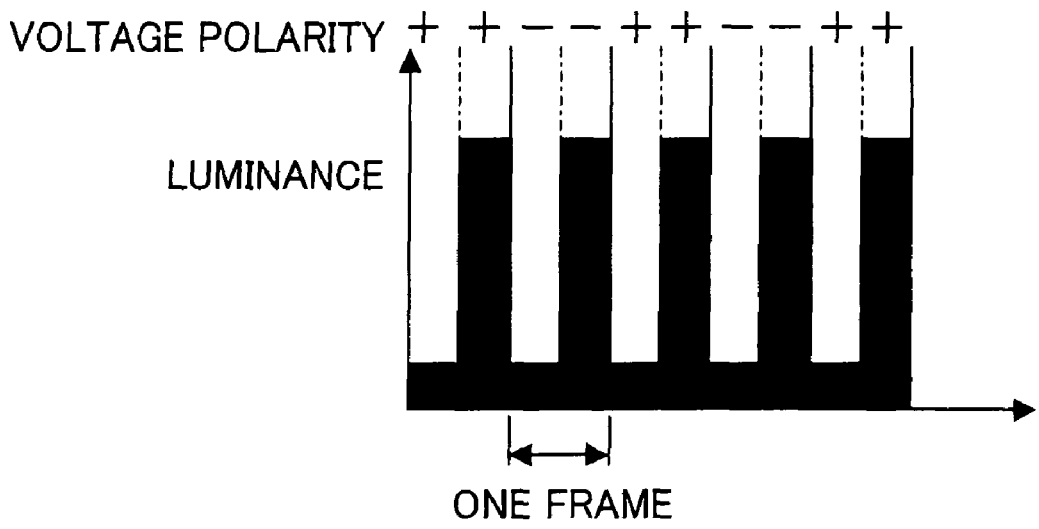
FIG. 21(*a*) illustrates a method of reversing the polarity of an interelectrode voltage in each frame.
Figure 21:
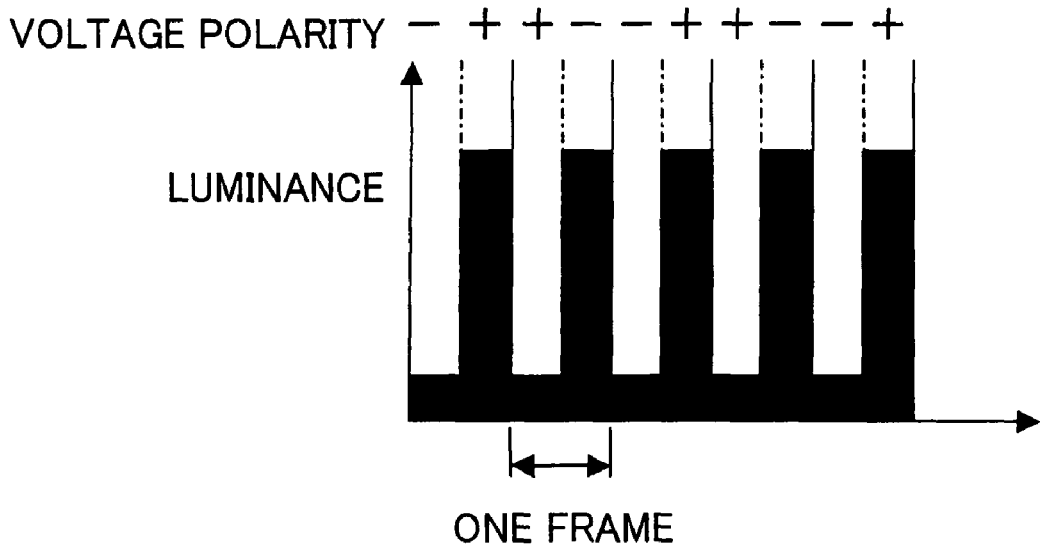

FIG. 21(*a*) shows the relationship between voltage polarity (polarity of the interelectrode voltage) and frame cycle, when the first method is adopted. FIG. 21 (*b*) shows the relationship between voltage polarity and frame cycle, when the second method is adopted.

Since the interelectrode voltage is alternated in the cycle of frames, burn-in and flicker do not occur even if interelectrode voltage is significantly changed between sub frames.

Both of the aforesaid two methods are useful for preventing burn-in and flicker. However, the method in which the same polarity is maintained for one frame is preferable in case where relatively brighter display is performed in the second sub frame. More specifically, in the arrangement of division into sub frames, since time to charge the TFT is reduced and hence a margin for the charging is undeniably reduced as compared to cases where division to sub frames is not conducted. Therefore, in commercial mass production, the luminance may be inconstant among the products because charging is insufficient due to reasons such as inconsistency in panel and TFT characteristics. On the other hand, according to the above-discussed arrangement, the second frame, in which luminance is mainly produced, corresponds to the second same-polarity writing, and hence voltage variation in the second frame in which luminance is mainly produced is restrained. As a result, an amount of required electric charge is reduced and display failure on account of insufficient charging is prevented.

As discussed above, the image display device 1 of the present example is arranged in such a manner that the liquid crystal panel is driven with sub frame display, and hence whitish appearance is restrained.

However, the sub frame display may be ineffective when the response speed of liquid crystal (i.e. time required to equalize a voltage (interelectrode voltage) applied to the liquid crystal and the applied voltage) is slow.

In the case of normal hold display, one state of liquid crystal corresponds to one luminance grayscale, in a TFT liquid crystal panel. The response characteristics of liquid crystal do not therefore depend on a luminance grayscale of a display signal.

Figure 22:
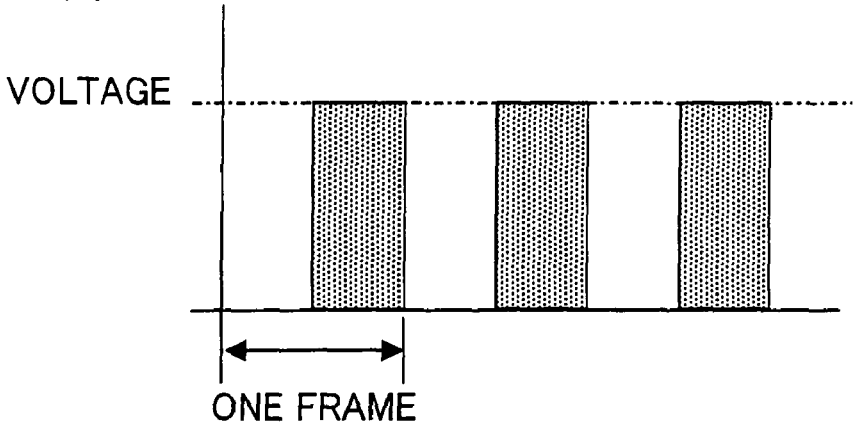
FIG. 22(*a*) is provided for illustrating the response speed of liquid crystal and shows a voltage applied to liquid crystal in one frame, in case where an intermediate luminance display signal reproduces an image.
Figure 22:
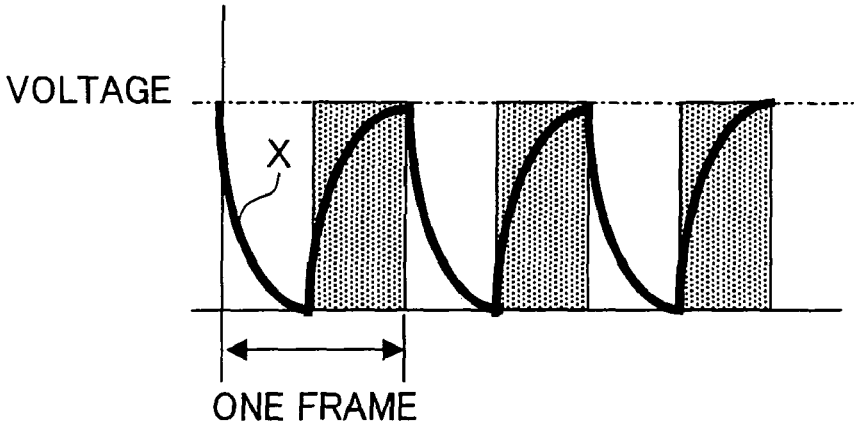
Figure 22:
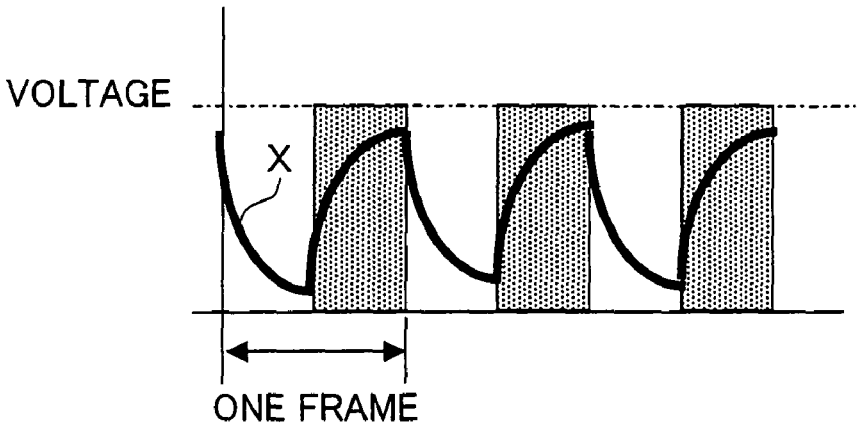

On the other hand, in the case of sub frame display such as the image display device 1 of the present example, a voltage applied to liquid crystal in one frame changes as shown in FIG. 22(*a*), in order to perform display based on a display signal of intermediate luminance, which indicates that the minimum luminance (white) is attained in the first sub frame whereas the maximum luminance is attained in the second sub frame, The interelectrode voltage changes as indicated by the full line X shown in FIG. 22(*b*), in accordance with the response speed (response characteristics) of liquid crystal.

In case where the response speed of liquid crystal is slow, the interelectrode voltage (full line X) changes as shown in FIG. 22(*c*) when display with intermediate luminance is carried out.

In this case, therefore, the display luminance in the first sub frame does not reach the minimum and the display luminance in the second sub frame does not reach the maximum.

Figure 23:
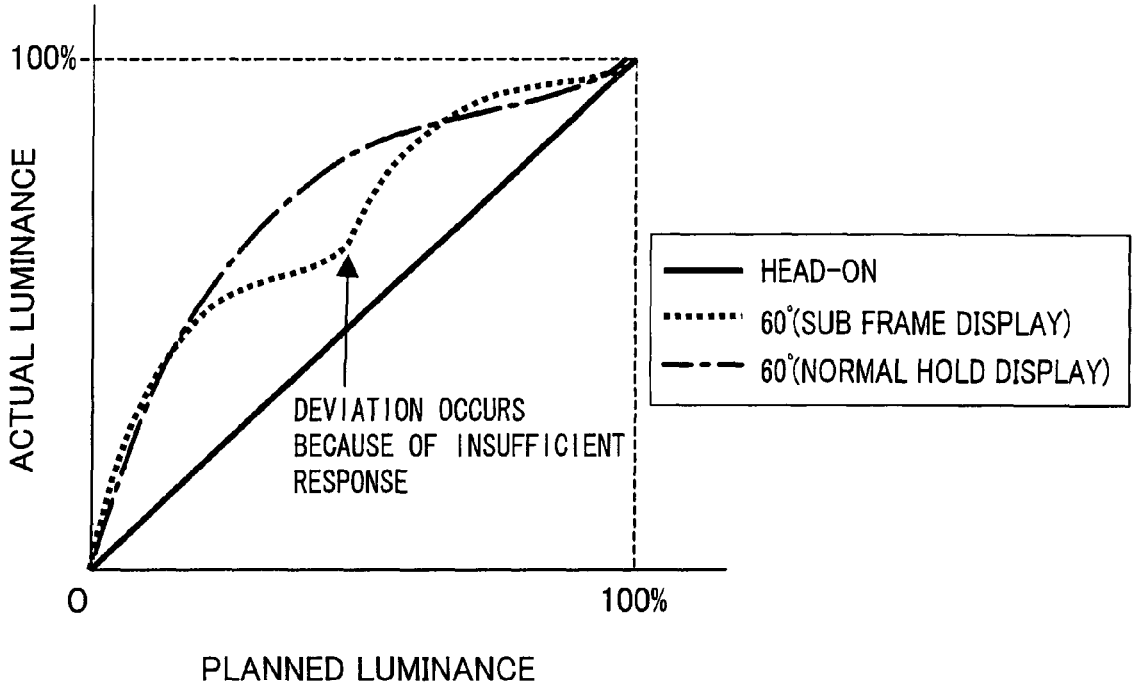
FIG. 23 is a graph showing the display luminance (relations between planned luminance and actual luminance) of a display panel when sub frame display is carried out by using liquid crystal with low response speed.

FIG. 23 shows the relationship between planned luminance and actual luminance in this case. As shown in the figure, even if sub frame display is performed, it is not possible to perform display with luminance (minimum luminance and maximum luminance) at which the difference (deviance) between planned luminance and actual luminance is small in the case of a large viewing angle.

The suppression of whitish appearance is therefore inadequate.

Therefore, to suitably conduct sub frame display as in the case of the image display device 1 of the present example, the response speed of liquid crystal in the liquid crystal panel is preferably designed to satisfy the following conditions (c) and (d).

(c) In case where a voltage signal (generated by the data signal line drive circuit 3 based on a display signal) indicating the maximum luminance (white; corresponding to the maximum brightness) is applied to liquid crystal which is in the state of the minimum luminance (black; corresponding to the minimum luminance), the voltage (interelectrode voltage) of the liquid crystal reaches a value not less than 90% of the voltage of the voltage signal (i.e. actual brightness when viewed head-on reaches 90% of the maximum brightness) in the shorter sub frame period.

(d) In case where a voltage signal indicating the minimum luminance (black) is applied to liquid crystal which is in the state of the maximum luminance (white), the voltage (interelectrode voltage) on the liquid crystal reaches a value which is not higher than 5% of the voltage of the voltage signal, in the shorter sub frame period (i.e. the actual brightness when viewed head-on reaches 5% of the minimum brightness).

The control circuit 44 is preferably designed to be able to monitor the response speed of liquid crystal.

If it is judged that the conditions (c) and (d) are no longer satisfiable because the response speed of liquid crystal is slowed down on account of change in an environmental temperature or the like, the control circuit 44 may suspend the sub frame display and start to drive the liquid crystal panel in normal hold display.

With this, the display method of the liquid crystal panel can be switched to normal hold display in case where whitish appearance is adversely conspicuous due to sub frame display.

In the present example, low luminance is attained in such a manner that dark grayscale display is performed in the first sub frame and grayscale expression is carried out only in the second sub frame.

Alternatively, similar image display is achieved when the anteroposterior relation between the sub frames is reversed (i.e. low luminance is attained in such a manner that dark grayscale display is carried out in the second sub frame and grayscale expression is carried out only in the first sub frame).

In the present example, the luminance grayscales (signal grayscales) of the display signals (first-stage display signal and second-stage display signal) are set based on the equation (1).

In an actual panel, however, luminance is not zero even when black display (grayscale of 0) is carried out, and the response speed of liquid crystal is limited. On this account, these factors are preferably taken into account for the setting of signal grayscale. In other words, the following arrangement is preferable: an actual image is displayed on the liquid crystal panel and the relationship between a signal grayscale and display luminance is actually measured, and LUT (output table) is determined to corresponds to the equation (1), based on the result of the actual measurement.

In the present example, $\alpha$ in the equation (6a) falls within the range of 2.2 to 3. Although this range is not strictly verified, it is considered to be more or less appropriate in terms of visual perception of humans.

When the data signal line drive circuit 3 of the image display device 1 of the present example is a data signal line drive circuit for normal hold display, a voltage signal is output to each pixel (liquid crystal) so that display luminance is attained by the equation (1) in which $\gamma=2.2$, in accordance with the signal grayscale (luminance grayscale of the display signal) to be input.

Even when sub frame display is adopted, the aforesaid data signal line drive circuit 3 outputs a voltage signal for normal hold display in each sub frame, in accordance with a signal grayscale to be input.

According to this method to output a voltage signal, however, the time integral value of luminance in one frame in the case of sub frame display may not be equal to the value in the case of normal hold display (i.e. a signal grayscale may not be properly expressed).

Therefore, for sub frame display the data signal line drive circuit 3 is preferably designed so as to output a voltage signal corresponding to divided luminance.

In other words, the data signal line drive circuit 3 is preferably designed so as to finely adjust a voltage (interelectrode voltage) applied to liquid crystal, in accordance with a signal grayscale.

It is therefore preferable that the data signal line drive circuit 3 is designed to be suitable for sub frame display so that the aforesaid fine adjustment is possible.

In the present example, the liquid crystal panel is a VA panel. Alternatively, a liquid crystal panel in a mode different from the VA mode may be used, on condition that whitish appearance can be restrained That is to say, sub frame display of the image display device 1 of the present example makes it possible to restrain whitish appearance in a liquid crystal panel in which actual luminance (actual brightness) deviates from planned luminance (planned brightness) when a viewing angle is large (i.e. a liquid crystal panel which is in a mode in which grayscale gamma characteristic change in accordance with viewing angles).

In particular, the sub frame display of the image display device 1 of the present example is effective for a liquid crystal panel in which display luminance increases as the viewing angle is increased.

Whitish appearance is restrained both in normally black and in normally white. Also, repression of whitish appearance can be achieved in a display panel (e.g. organic EL panel and plasma display panel) which is not a liquid crystal panel.

In the present example, one frame is preferably divided in the ratio of 1:3 to 1:7. Alternatively, the image display device 1 of the present example may be designed so that one frame is divided in the ratio of 1:n or n:1 (n is a natural number not less than 1).

In the present example, signal grayscale setting of display signals (first-stage display signal and second-stage display signal) is carried out by using the aforesaid equation (10).

This setting, however, assumes that the response speed of liquid crystal is 0 ms and T0 (minimum luminance)=0. The setting is preferably further refined for actual use.

The maximum luminance (threshold luminance) to be output in one sub frame (second sub frame) is Tmax/(n+1), if the liquid crystal response is 0 ms and T0=0. The threshold luminance grayscale Lt is equal to the frame grayscale of the maximum luminance.

$$Lt=((T\max/(n+1)-T0)/(T\max-T0))\hat{}(1/\gamma)$$

(γ=2.2, T0=0)

In case where the response speed of liquid crystal is not 0, the threshold luminance (luminance at Lt) is represented as follows, provided that response from black to white is Y % in a sub frame, response from white to black is Z % in a sub frame, and T0=T0.

$$Tt=((T\max-T0)\times Y/100+(T\max-T0)\times Z/100)/2$$

Therefore, the following equations holds true.

$$Lt=((Tt-T0)/(T\max-T0))\hat{}(1/\gamma)$$

(γ=2.2)

Lt may be little more complicated in practice, and the threshold luminance Tt may not be expressed by a simple equation. On this account, it is sometimes difficult to express Lt by Lmax.

To work out Lt in such a case, a result of measurement of luminance of a liquid crystal panel is preferably used. That is, luminance of a liquid crystal panel, in case where maximum luminance is attained in one sub frame whereas minimum luminance is attained in the other sub frame, is measured, and this measured luminance is set as Tt. Spilled luminance Lt is determined based on the following equations.

$$Lt=((Tt-T0)/(T\max-T0))\hat{}(1/\gamma)$$

(γ=2.2)

This Lt figured out by using the equation (10) is an ideal value, and is sometimes preferably used as a standard.

The above-described case is a model of display luminance of the present embodiment, and terms such as "Tmax/2", "maximum luminance", and "minimum luminance" are used for simplicity. Actual values may be varied to some extent, to realize smooth greyscale expression, user's preferred specific gamma characteristic, or the like. That is to say, the improvement in the quality of moving images and a viewing angle is obtained when display luminance is lower than threshold luminance, on condition that luminance in one frame is sufficiently darker than luminance in the other frame. Therefore, effects similar to the above can be obtained by an arrangement such that, at Tmax/2, for example, the ratios such as minimum luminance (10%) and maximum luminance (90%) and around these values appropriately change in series. The following descriptions also use similar expressions for the sake of simplicity, but the present invention is not limited to them.

In the image display device 1 of the present example, the polarity is preferably reversed in each frame cycle. The following will give details of this.

Figure 24:
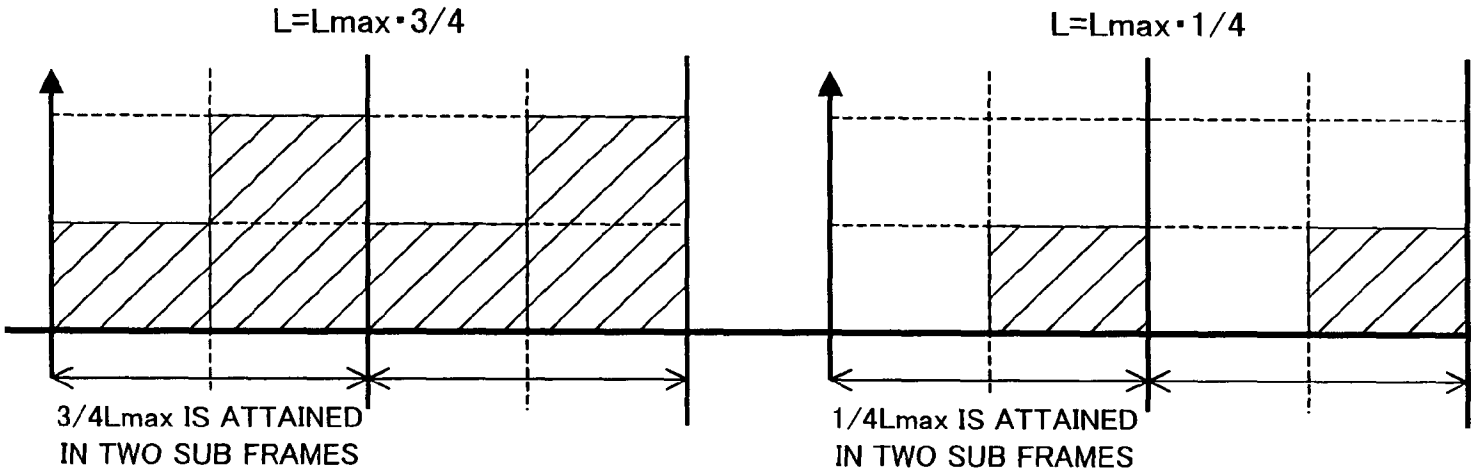
FIG. 24(*a*) is a graph showing the luminance generated in a first sub frame and a second sub frame, when the display luminance is ¾ and ¼ of Lmax.
Figure 24:
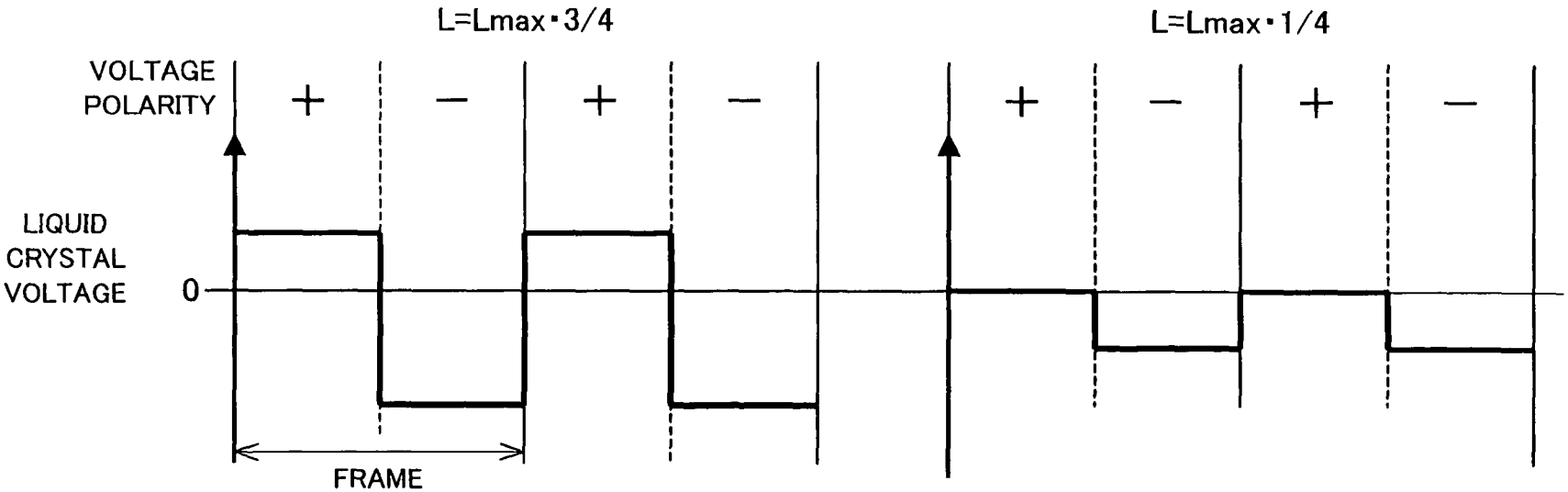

FIG. 24(*a*) is a graph showing the luminance attained in the first and second sub frames, in case where display luminance is ¾ and ¼ of Lmax.

As shown in the figure, in sub frame display as in the present example, voltages applied to liquid crystal (i.e. a value of voltage applied to the space between pixel electrodes; absolute value) are different between sub frames.

Therefore, in case where the polarity of the voltage (liquid crystal voltage) applied to liquid crystal is reversed in each sub frame, the applied liquid crystal voltage is one-sided (i.e. the total applied voltage is not 0V) because of the difference in voltage values in the first and second sub frames, as shown in FIG. 24(*b*). The DC component of the liquid crystal voltage cannot therefore be cancelled, and hence problems such as burn-in and flicker may occur when the liquid crystal panel is driven for a long period of time, because the electrodes are electrically charged.

For this reason, in the image display device 1 of the present example, the polarity of the liquid crystal voltage is preferably reversed in each frame cycle.

There are two ways to reverse the polarity of the liquid crystal voltage in each frame cycle. The first way is such that a voltage with a single polarity is applied for one frame.

According to the other way, the polarity of the liquid crystal voltage is reversed between two sub frames, and the polarity in the second sub frame is arranged to be identical with the polarity in the first sub frame of the directly subsequent frame.

Figure 25:
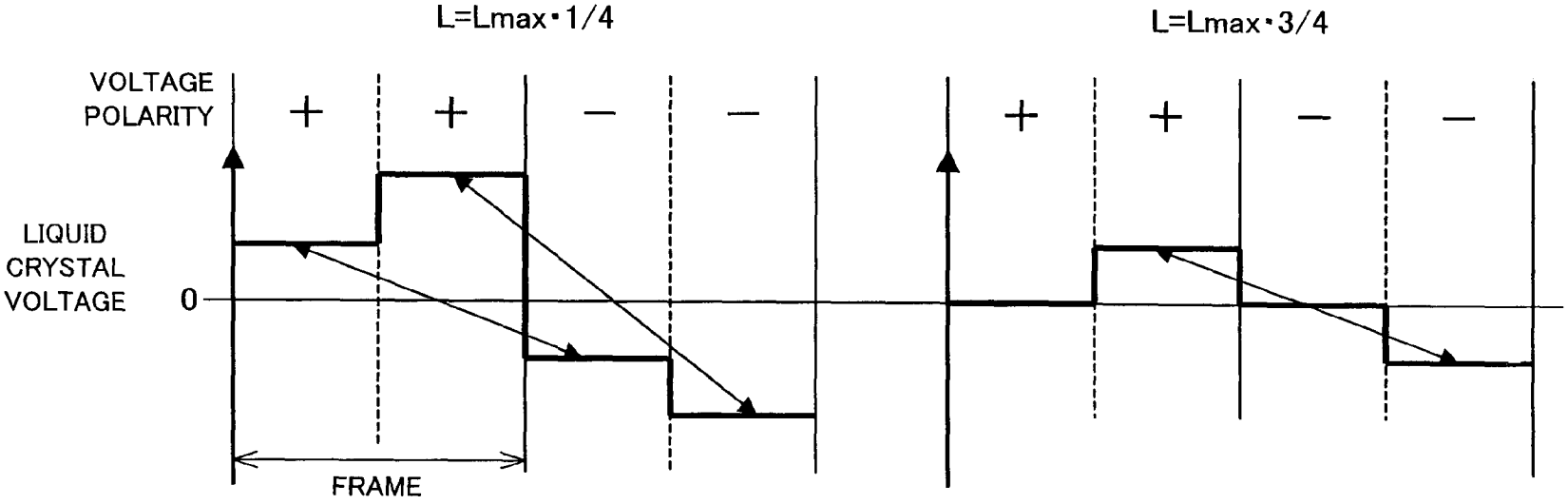
FIG. 25(*a*) illustrates a method of reversing the polarity of an interelectrode voltage in each frame, and shows a case where voltages of both polarities are applied in one frame.
Figure 25:
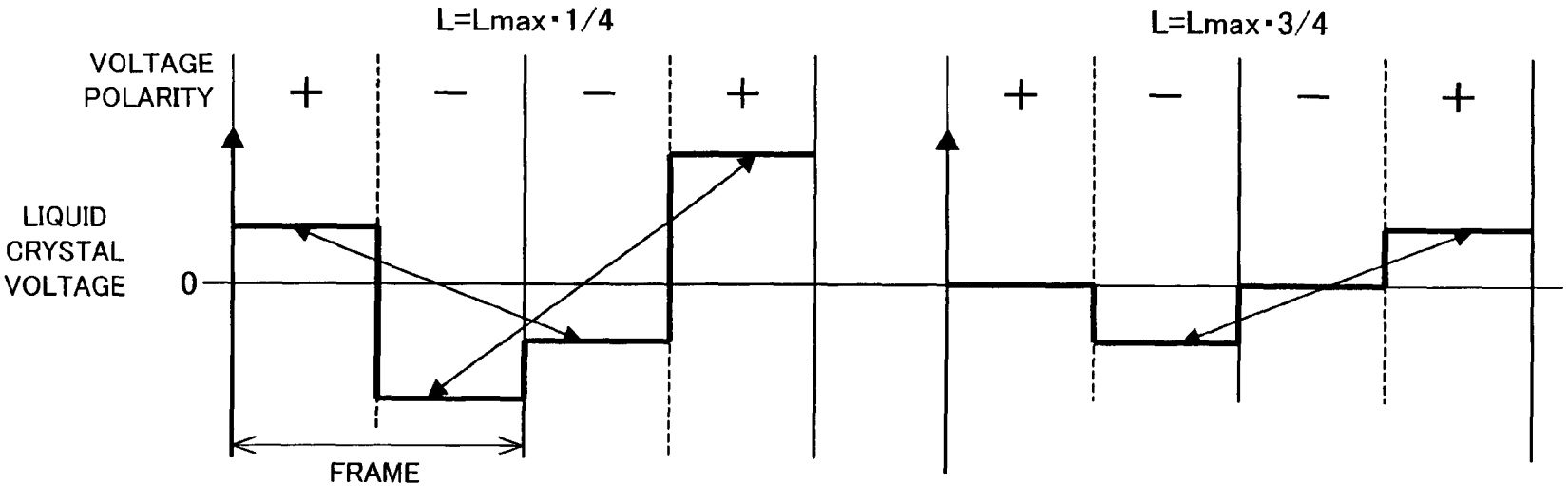

FIG. 25(*a*) is a graph showing the relationship among voltage polarities (polarities of liquid crystal voltage), frame cycles, and liquid crystal voltages, in case where the former way is adopted. On the other hand, FIG. 25(*b*) shows the same relationship in case where the latter way is adopted.

As these graphs show, in case where the liquid crystal voltage is reversed in each frame cycle, the total voltage in the first sub frames in neighboring two frames and the total voltage in the second sub frames in neighboring two frames can be set at 0V. Therefore, since the total voltage in two frames can be set at 0V, it is possible to cancel the DC component of the applied voltage.

In this manner, the liquid crystal voltage is alternated in each frame period. It is therefore possible to prevent burn-in, flicker or the like even if liquid crystal voltages in respective sub frames are significantly different from one another.

Figure 26:
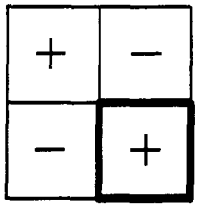
FIG. 26(*a*) is an explanatory drawing of four sub pixels in a liquid crystal panel and polarities of liquid crystal voltages of the respective pixels.
Figure 26:
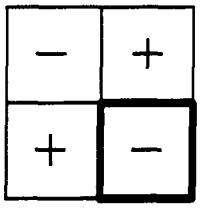
Figure 26:
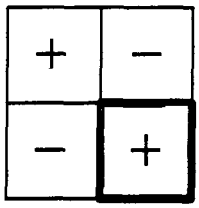
Figure 26:
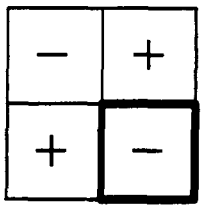

FIGS. 26(*a*)-26(*d*) show four sub pixels SPIX in the liquid crystal panel and polarities of liquid crystal voltages on the respective sub pixels SPIX.

As described above, the polarity of a voltage applied to one sub pixel SPIX is preferably reversed in each frame period. In the present case, the polarity of the liquid crystal voltage on each sub pixel SPIX varies, in each frame period, in the order of FIG. 26(*a*), FIG. 26(*b*), FIG. 26(*c*), and FIG. 26(*d*).

The sum total of liquid crystal voltages applied to all sub pixels SPIX of the liquid crystal panel is preferably controlled to be 0V. This control is achieved, for example, in such a manner that the voltage polarities between the neighboring sub pixels SPIX are set so as to be different as shown in FIGS. 26(*a*)-26(*d*).

The image display device 1 of the present example may be designed to perform pixel-division drive (halftone dot pixel drive).

Figure 27:
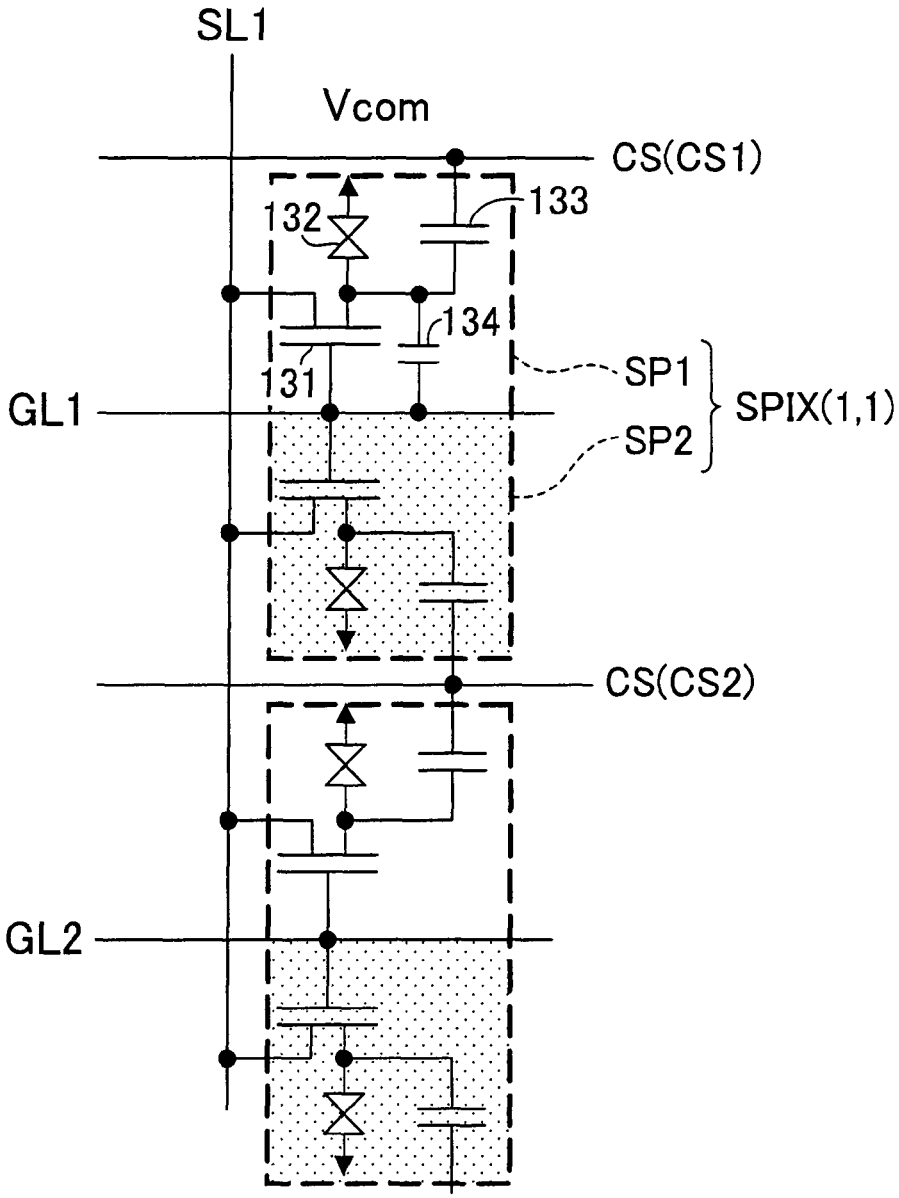
FIG. 27 illustrates a liquid crystal panel which is driven based on pixel division.

The following will describe the pixel-division drive of the image display device 1 of the present example. FIG. 27 shows a liquid crystal panel driven with pixel division.

As shown in the figure, according to the pixel-division drive, one sub pixel SPIX (1, 1) connected to a scanning signal line (e.g. GL1) and a data signal line (e.g. SL1) of a liquid crystal panel is divided into two auxiliary pixels SP1 (1,1) and SP2 (1,1). In the following, these pixels are termed partial pixels SP1 (1,1) and SP2 (1,1), in order to differentiate them from the sub pixels SPIX (1,1) provided for R, G, and B, respectively. Image display is carried out by changing voltages applied to the partial pixels SP1 (1,1) and SP2 (1,1). Such pixel-division drive is mentioned in, for example, the patent documents 7-10.

The following will outline the pixel-division drive.

As shown in FIG. 27, in an arrangement adopting the pixel-division drive, two different auxiliary capacity lines CS1 and CS2 are provided so as to sandwich one sub pixel SPIX (1,1). Each of the auxiliary capacity lines CS1 and CS2 is connected to one of the partial pixels SP1 and SP2.

In each of the partial pixels SP1 and SP2, a TFT 131, a liquid crystal capacity 132, and an auxiliary capacity 133 are provided.

The TFT 131 is connected to the scanning signal line GL1, the data signal line SL1, and the liquid crystal capacity 132. The auxiliary capacity 133 is connected to the TFT 131, the liquid crystal capacity 132, and one of the auxiliary capacity lines CS1 and CS2.

To the respective auxiliary capacity lines CS1 and CS2, auxiliary signals which are alternating voltage signals with predetermined frequencies are applied. The phases of the auxiliary signals applied to the respective capacity lines CS1 and CS2 are opposite to one another (different from one another for 180°).

The liquid crystal capacity 132 is connected to the TFT 131, a shared voltage Vcom, and the auxiliary capacity 133. The liquid crystal capacity 132 is connected to a parasitic capacity 134 generated between the liquid crystal capacity 132 and the scanning signal line GL1.

According to this arrangement, when the scanning signal line GL1 is turned on, the TFTs 131 of the respective partial pixels SP1 and SP2 in one sub pixel SPIX (1,1) are turned on.

Figure 28:
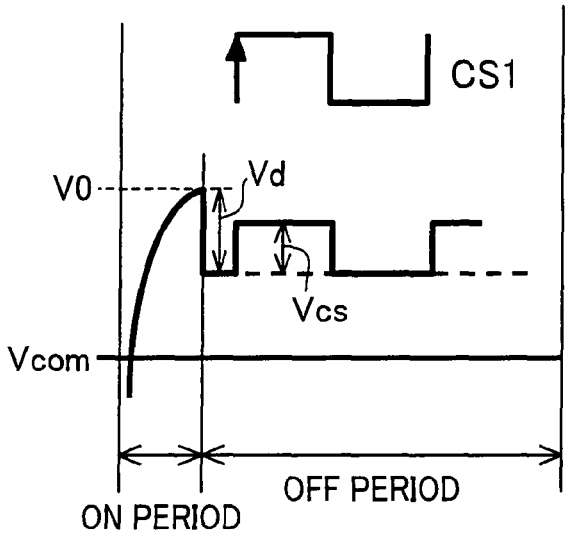
FIG. 28(*a*) is a graph showing a voltage (liquid crystal voltage) applied to the liquid crystal capacity of a partial pixel when a positive (≧Vcom) display signal is applied to a source line S, and illustrates a case where an auxiliary signal on an auxiliary capacity line CS1 rises.
Figure 28:
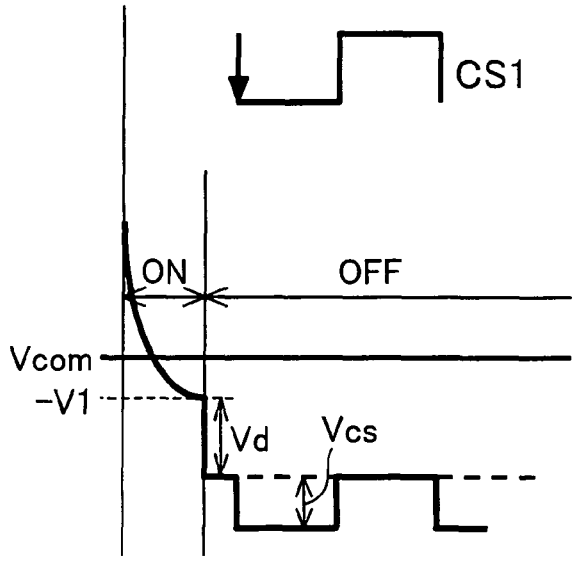
Figure 28:
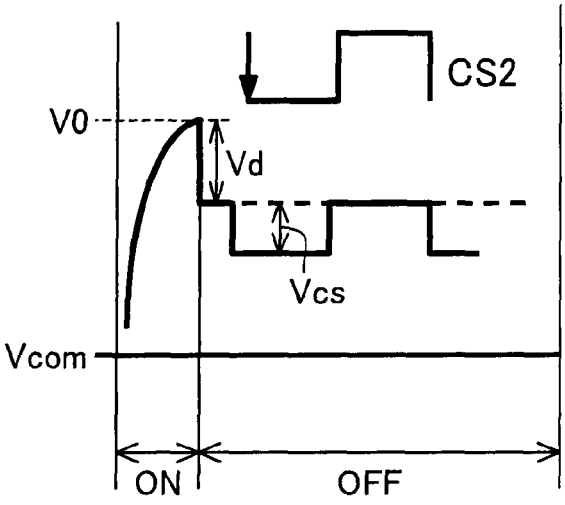
Figure 28:
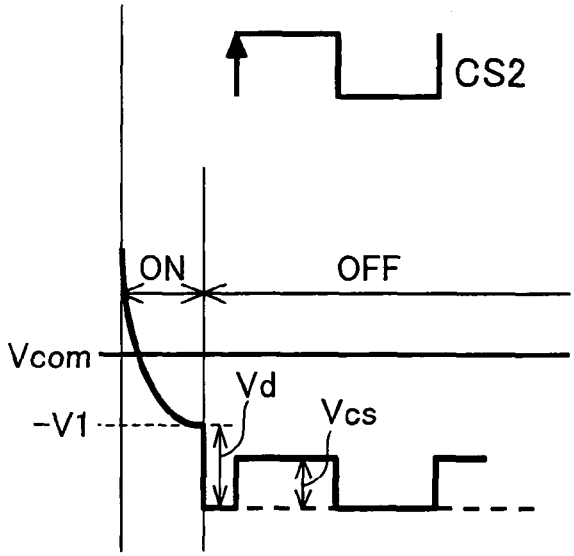

FIGS. 28(*a*) and 28(*c*) are graphs related to the case above and show voltages (liquid crystal voltages) applied to the liquid crystal capacities of the partial pixels SP1 and SP2, in case where a positive display signal (≧Vcom) is applied to the data signal line SL1.

In this case, as shown in FIGS. 28(*a*) and 28(*c*), the voltage values of the liquid crystal capacities 132 of the respective partial pixels SP1 and SP2 increase to a value (V0) corresponding to the display signal.

When the scanning signal line GL1 is turned off, the liquid crystal voltages decrease by Vd on account of gate drawing due to the parasitic capacity 134.

At this moment, as shown in FIG. 28(*a*), when the auxiliary signal on the auxiliary capacity line CS1 rises (is switched from low to high), the liquid crystal voltage of the partial pixel SP1 connected to the auxiliary capacity line CS1 increases by Vcs (a value corresponding to the amplitude of the auxiliary signal running on the auxiliary capacity line CS1). In accordance with the frequency of the auxiliary capacity line CS (frequency of the auxiliary signal), the liquid crystal voltage oscillates between Vo and V0−Vd, with an amplitude Vcs.

In the case above, as shown in FIG. 28(*c*), the auxiliary signal on the auxiliary line CS2 falls (is switched from high to low). The liquid crystal voltage of the partial pixel SP2 connected to the auxiliary line CS2 falls by Vcs which is a value corresponding to the amplitude of the auxiliary signal. Thereafter, the liquid crystal voltage oscillates between Vo−Vd and V0−Vd−Vcs.

FIGS. 28(*b*) and 28(*d*) are graphs showing the liquid crystal voltages on the partial pixels SP1 and SP2, in case where a negative display signal (voltage signal; ≦Vcom) is applied to the data signal line SL1 when the scanning signal line GL1 is turned on.

In the case above, as shown in the figures, the liquid crystal voltages on the partial pixels SP1 and SP2 fall to a value (−V1) corresponding to the display signal.

Thereafter, when the scanning signal line GL1 is turned off, the liquid crystal voltages are further decreased on account of the aforesaid gate drawing.

At this moment, as shown in FIG. 28(*b*), when the auxiliary signal on the auxiliary capacity line CS1 falls, the liquid crystal voltage of the partial pixel SP1 connected to the auxiliary capacity line CS1 is further decreased by Vcs. The liquid crystal voltage then oscillates between −V0−VD−Vcs and −V0−Vd.

In the meanwhile, as shown in FIG. 28(*d*), the auxiliary signal of the auxiliary capacity line CS2 rises in the case above. The liquid crystal voltage of the partial pixel SP2 connected to the auxiliary capacity line CS2 is increased by Vcs. Thereafter, the liquid crystal voltage oscillates between V0−Vd and V0−Vd−Vcs.

In this way, auxiliary signal whose phases are different from one another for 180° are applied to the respective auxiliary capacity lines CS1 and CS2, and hence the liquid crystal voltages of the partial pixels SP1 and SP2 are arranged to be different from one another.

That is to say, in case where the display signal applied to the data signal line SL1 is positive, the absolute value of the liquid crystal voltage is higher than the display signal voltage (FIG. 28(*a*)) in the partial pixel to which the auxiliary signal which rises immediately after the gate drawing is supplied.

On the other hand, in the partial pixel to which the auxiliary signal which falls in the case above is supplied, the absolute value of the liquid crystal voltage is lower than the display signal voltage (FIG. 28(*c*)).

In case where the display signal applied to the data signal line SL1 is negative, the absolute value of the voltage applied to the liquid crystal capacity 132 is higher than the display signal voltage (FIG. 28(*b*)) in the partial pixel to which the auxiliary signal which falls immediately after the gate drawing is supplied.

On the other hand, in the partial pixel to which the auxiliary signal which rises in the case above is supplied, the absolute value of the liquid crystal voltage is lower than the display signal voltage (FIG. 28(*d*)).

Therefore, in the case shown in FIGS. 28(*a*)-28(*d*), the liquid crystal voltage (absolute value) of the partial pixel SP1 is higher than that of the partial pixel SP2 (i.e. display luminance of the partial pixel SP1 is higher than that of the partial pixel SP2).

The difference (Vcs) between the liquid crystal voltages of the respective partial pixels SP1 and SP2 can be controlled in accordance with the amplitude of each of the auxiliary signals applied to the respective auxiliary capacity lines CS1 and CS2. This makes it possible to optionally differentiate the display luminance (first luminance) of the partial pixel SP1 from the display luminance (second luminance) of the partial pixel SP2.

Table 1 shows (i) the polarities of respective liquid crystal voltages supplied to the partial pixel (light pixel) with high luminance and the partial pixel (dark pixel) with low luminance and (ii) the states of the auxiliary signals immediately after the gate drawing. In the table the polarities of the liquid crystal voltages are indicated by "+, −". Also, the case where the auxiliary signal rises immediately after the gate drawing is indicated by "↑", whereas the case where the auxiliary signal falls immediately after the gate drawing is indicated by "↓".

TABLE 1

| | | |
|---|---|---|
| BLIGHT PIXEL | +, ↑ | −, ↓ |
| DARK PIXEL | +, ↓ | −, ↑ |

In the pixel-division drive, the luminance of a sub pixel SPIX is equal to the sum total of the luminance (corresponding to the luminance of liquid crystal) of two partial pixels SP1 and SP2.

Figure 29:
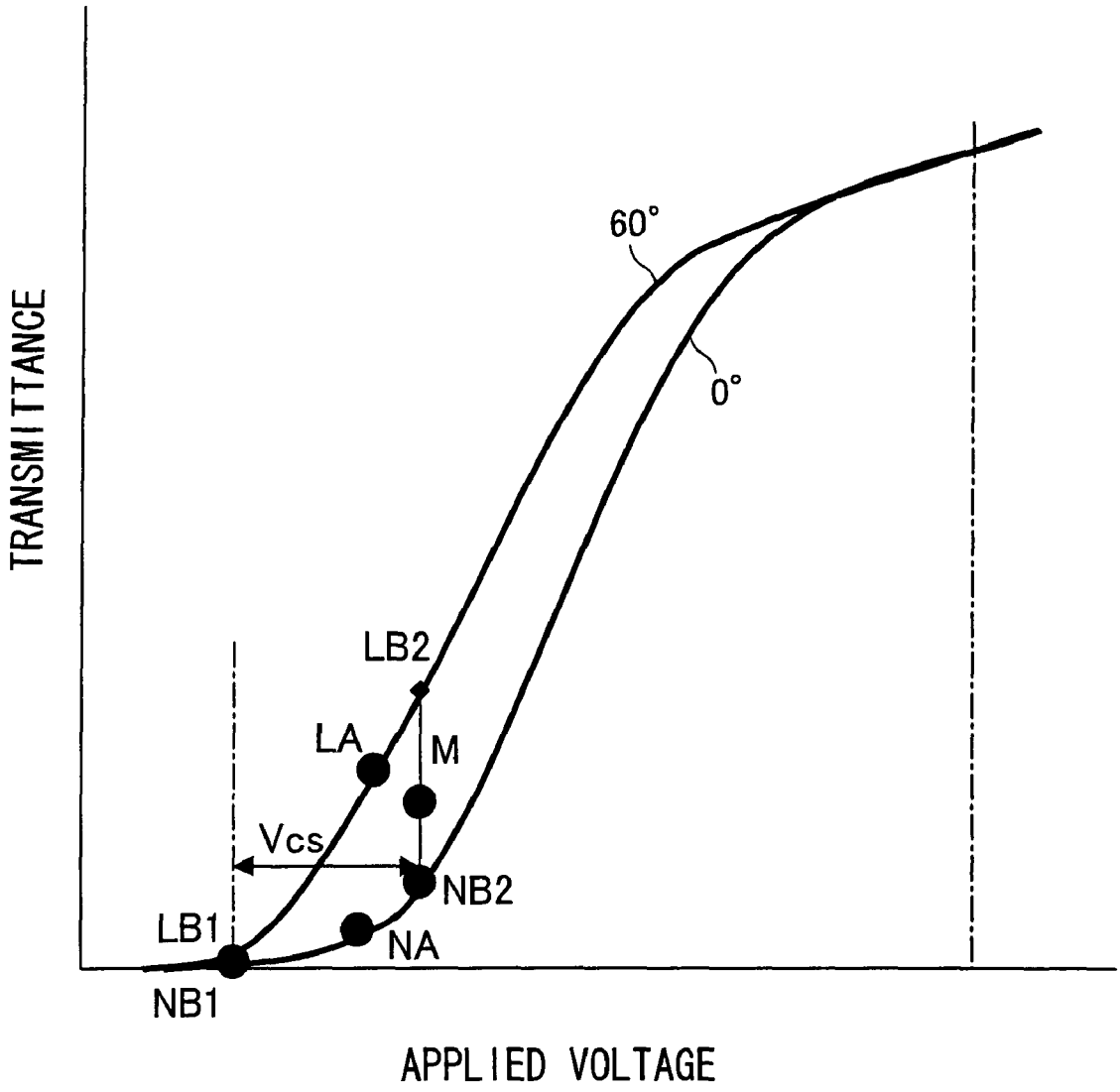
FIG. 29 is a graph showing relations between the transmittance and an applied voltage in a liquid crystal panel 21 at two different viewing angles (0° (head-on) and 60°), when pixel division drive is not carried out.

FIG. 29 is a graph showing the relationship between transmittance and an applied voltage of the liquid crystal panel at two viewing angles (0° (head-on) and 60°), in case where the pixel-division drive is not adopted.

As shown in the graph, in case where the transmittance when viewed head-on is NA (i.e. in case where the liquid crystal voltage is controlled so that the transmittance is NA), the transmittance at the viewing angle of 60° is LA.

To set the transmission when viewed head-on at NA in the pixel-division drive, voltages which are different from one another by Vcs are applied to the respective partial pixels SP1 and SP2 so that transmittances of the partial pixels SP1 and SP2 are set at NB1 and NB2 (NA=(NB1+NB2)/2).

In case where the transmittances of the partial pixels SP1 and SP2 at the angle of 0° are NB1 and NB2, the transmittances at the angle of 60° are LB1 and LB2. LB1 is substantially 0. Therefore, the transmittance of one sub pixel SPIX is M(LB2/2), and hence lower than LA.

In this way, the pixel-division drive makes it possible to improve the viewing angle characteristic.

Also, adopting the pixel-division drive, for example, an image with low luminance (high luminance) can be displayed by increasing the amplitude of the CS signal so as to cause one partial pixel to carry out dark grayscale display (white display) and to adjust the luminance of the other partial pixel. This minimizes the difference between display luminance and actual luminance in one of the partial pixels as in the case of the sub frame display, and hence the viewing angle characteristic is further improved.

In the arrangement above, one of the partial pixels may not carry out dark grayscale display (white display). That is to say, the viewing angle characteristic is improved in theory by differentiating the luminances of the respective partial pixels. Since this reduces the CS amplitude, the panel drive can be easily designed.

It is unnecessary to differentiate the luminances of the partial pixels SP1 and SP2 for all display signals. For example in case where the respective partial pixels carry out white display and dark grayscale display, the luminances of the respective partial pixels are preferably equal. Therefore, the partial pixels SP1 and SP2 are designed so that, in response to at least one display signal (display signal voltage), first luminance is attained by the partial pixel SP1 whereas second luminance which is different from the second luminance is attained by the partial pixel SP2.

In the pixel-division drive, the polarity of a display signal applied to the data signal line SL1 is preferably reversed in each frame. In other words, provided that in one frame the partial pixels SP1 and SP2 are driven as shown in FIGS. 28(*a*) and 28(*c*), in the subsequent frame the partial pixels SP1 and SP2 are preferably driven as shown in FIGS. 28(*b*) and 28(*c*).

This causes the total voltage on two liquid crystal capacities 132 of the sub pixel SPIX in two frames to be 0V. It is therefore possible to cancel the DC component of the applied voltage.

To perform the pixel-division drive, one sub pixel SPIX is divided into two pixels. Alternatively, one sub pixel SPIX may be divided into three or more partial pixels.

The above-described pixel-division drive may be combined with the normal hold display or the sub frame display. Also, the pixel-division drive may be combined with polarity reversal drive which has been illustrated in reference to FIGS. 28(*a*), 28(*b*), 25(*a*), and 25(*b*).

The following will describe a combination of the pixel-division drive, the sub frame display, and the polarity reversal drive.

Figure 30:
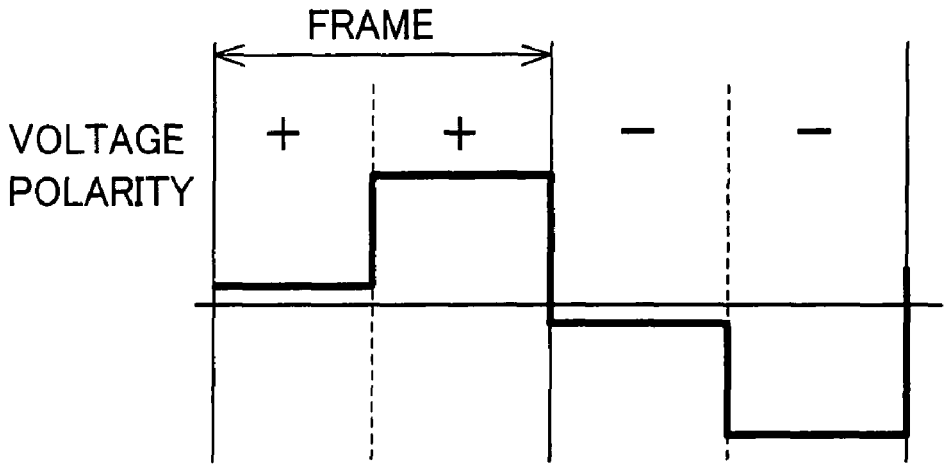
FIG. 30(*a*) is a graph showing a variation of liquid crystal voltage (for one pixel) in case where sub frame display is carried out while the polarity of liquid crystal voltage is reversed in each frame.
Figure 30:
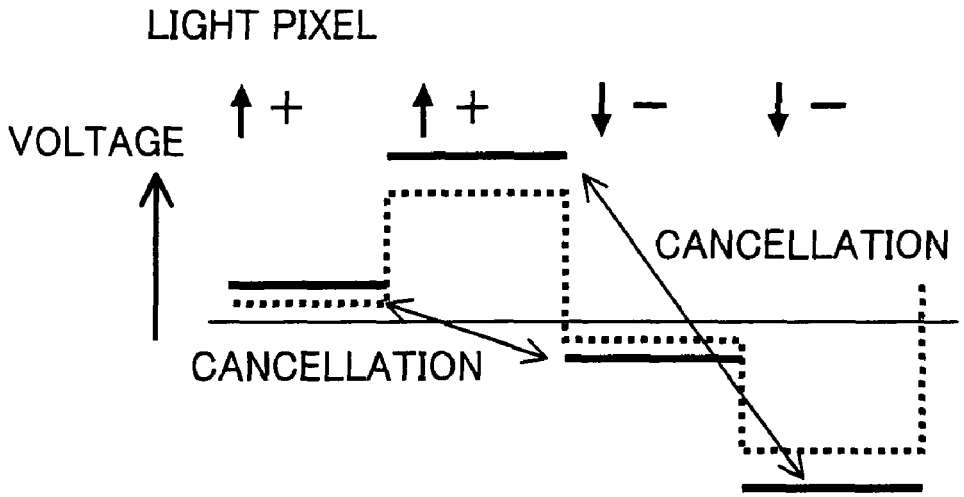
Figure 30:
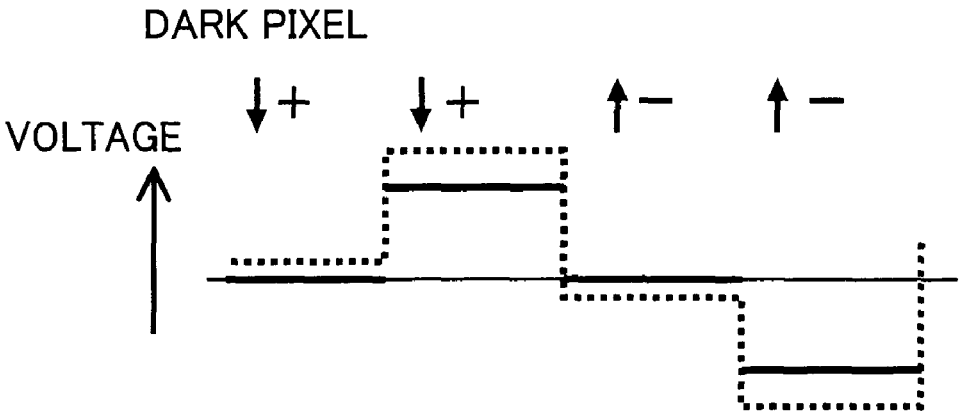

FIG. 30(*a*) is a graph showing changes in the liquid crystal voltage (for one pixel), in the case of the sub frame display in which polarity of the liquid crystal voltage is reversed in each frame as in the case of FIG. 25(*a*).

In case where the sub frame display by the polarity reversal drive is combined with the pixel-division drive, the liquid crystal voltage of each partial pixel changes as shown in FIGS. 30(*b*) and 30(*c*).

FIG. 30(*b*) is a graph showing the liquid crystal voltage of a partial pixel (light pixel) whose luminance is high in the pixel-division drive. FIG. 30(*c*) is a graph showing the liquid crystal voltage of a partial pixel (dark pixel) whose luminance is low in the pixel-division drive.

In the graphs, an undulating line indicates a liquid crystal voltage in case where the pixel-division drive is not performed, whereas a full line indicates a liquid crystal voltage in case where the pixel-division drive is performed.

Figure 31:
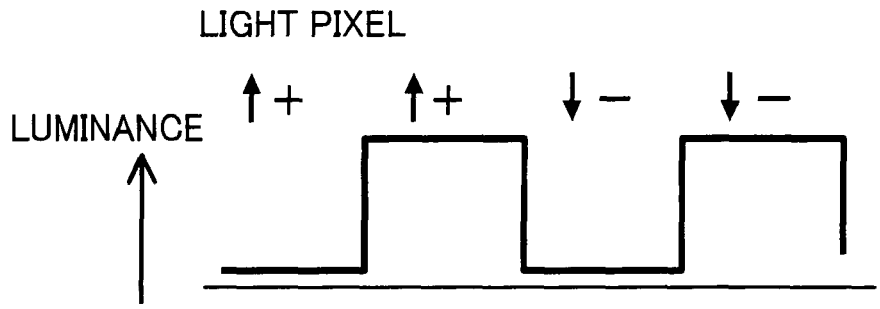
FIG. 31(*a*) is a graph showing the luminance of the light pixel of FIG. 30(*b*).
Figure 31:
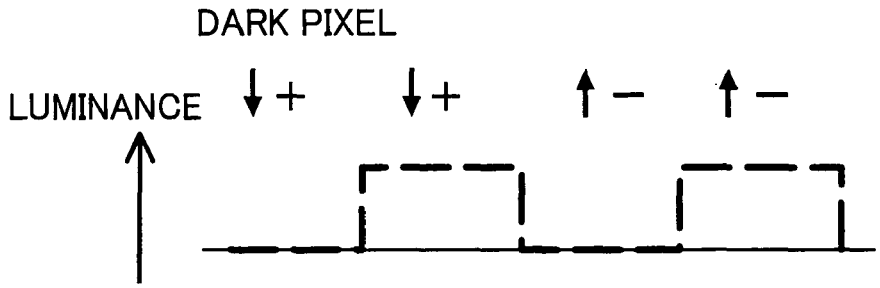

FIGS. 31(*a*) and 31(*b*) are graphs showing luminances of the light pixel and the dark pixel and correspond to the respective FIGS. 30(*b*) and 30(*c*).

In the figures, the signs "↑" and "↓" indicate the states of an auxiliary signal immediately after the gate drawing (i.e. indicate whether the signal rises or falls immediately after the gate drawing).

As shown in these figures, in the present case, the polarity of the liquid crystal voltage of each pixel is reversed in each frame. In doing so, liquid crystal voltages which are different between sub frames are appropriately cancelled (i.e. total liquid crystal voltage in two frames is set at 0V).

The state of the auxiliary signal (i.e. the phase ("↑" or "↓") immediately after the gate drawing) is reversed in the same phase as the reversal of the polarity.

With the drive in this way, as shown in FIGS. 30(*b*), 30(*c*), 31(*a*), and 31(*b*), the liquid crystal voltage (absolute value) and the luminance in the sub frames are high in the light pixel but low in the dark pixel.

The increase in the liquid crystal voltage on the light pixel in the first sub frame is equal to the decrease in the dark pixel. Similarly, the increase in the liquid crystal voltage on the light pixel in the second sub frame is equal to the decrease in the dark pixel.

Therefore, it is possible to prevent the polarity of the liquid crystal voltage applied to one sub pixel SPIX from being one-sided, and hence the total liquid crystal voltage in two frames is set at 0V. (It is noted that the increase (decrease) in the liquid crystal voltage on account of the pixel-division drive is different between the first and second sub frames. This is because the capacity changes in accordance with the transmittance of liquid crystal.)

In the case above, the polarity of the liquid crystal voltage of each frame is reversed in each frame. Alternatively, the polarity of the liquid crystal may be reversed in each frame cycle.

The following arrangement may therefore be adopted: as shown in FIG. 25(*b*), the liquid crystal voltage has different polarities in the respective sub frames in one frame, and the polarity in the second sub frame is identical with the polarity in the first sub frame of the directly precedent frame.

Figure 32:
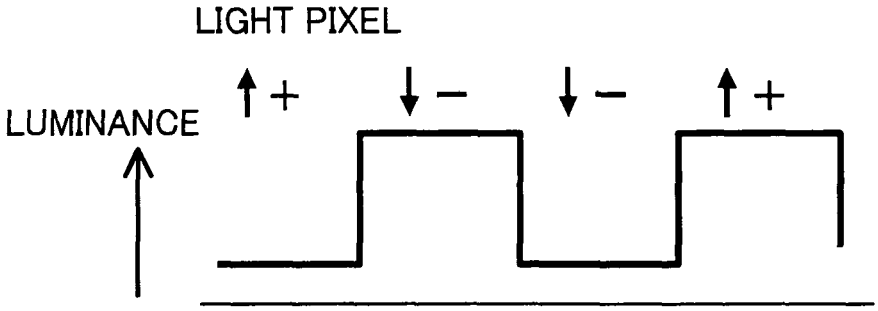
FIG. 32(*a*) is a graph showing the luminance of the light pixel in case where polarity reversal is carried out in each frame.
Figure 32:
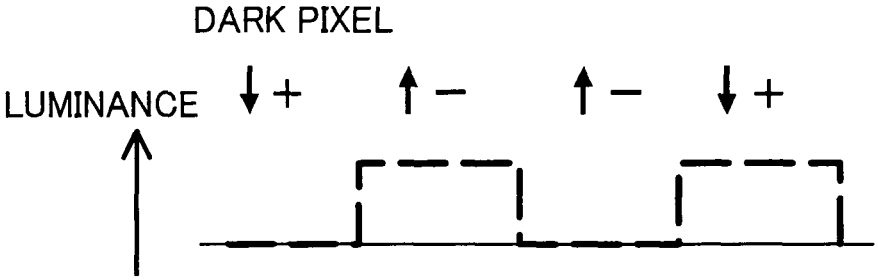

FIGS. 32(*a*) and 32(*b*) are graphs showing the luminances of the light pixel and dark pixel, in case where the polarity reversal is carried out as above.

Also in this case, the state ("↑" or "↓") of the auxiliary signal is reversed in the same phase as the polarity reversal, and hence the total liquid crystal voltage in two frames is set at 0V.

Figure 33:
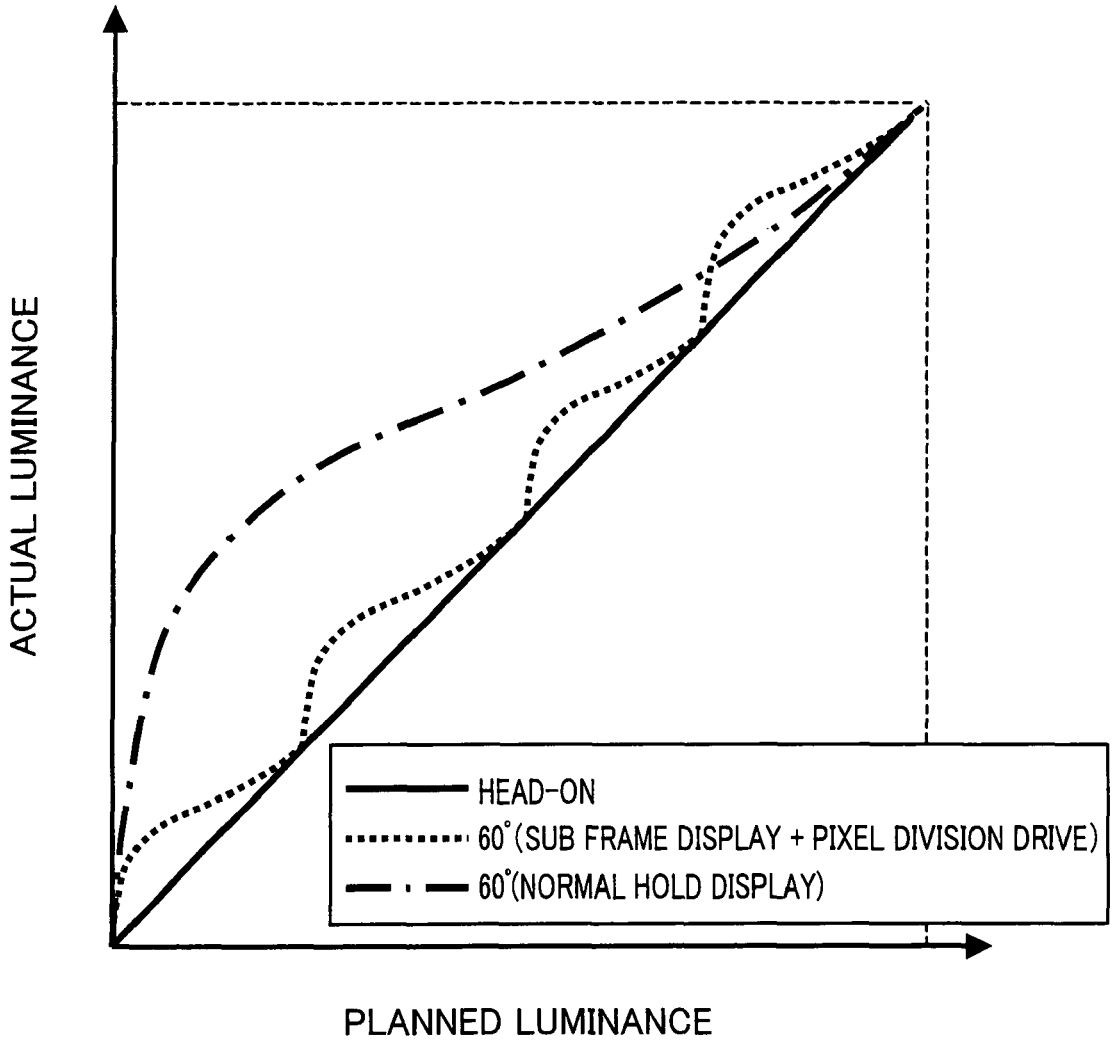
FIG. 33 is a graph showing (i) results (dotted line and full line) of image display by a combination of sub frame display, polarity reversal drive and pixel division drive and (ii) results (dashed line and full line) of normal hold display.

FIG. 33 is a graph showing both (i) the results (dotted line and full line) of image display by the image display device 1 of the present example, when the sub frame drive, the polarity reversal drive, and the pixel-division drive are combined and (ii) the results (dashed line and full line; identical with those shown in FIG. 13) of normal hold display.

As shown in the graph, in case where the viewing angle is 60°, it is possible to cause actual luminance to be very close to planned luminance by combining the sub frame display with the pixel-division drive. The viewing angle characteristic is especially good in this case, on account of the synergistic effect of the sub frame display and the pixel-division drive.

In the case above, the state (the phase ("↑" or "↓" immediately after the gate drawing) of the auxiliary signal is reversed in line with the reversal of the polarity. If the state of the auxiliary signal is changed in each frame irrespective of the polarity reversal, the liquid crystal voltage cannot appropriately be cancelled.

That is, the variation of the liquid crystal voltage in accordance with the state of the auxiliary signal depends on the magnitude (absolute value) of the original liquid crystal voltage. (The higher the liquid crystal voltage is, the larger the variation is.) As described above, the increase (decrease) in the liquid crystal voltage in the pixel-division drive is different between the first and second sub frames. (In the example shown in FIGS. 30(*b*) and 30(*c*), the variation in the second sub frame is larger than the variation in the first sub frame.)

Figure 34:
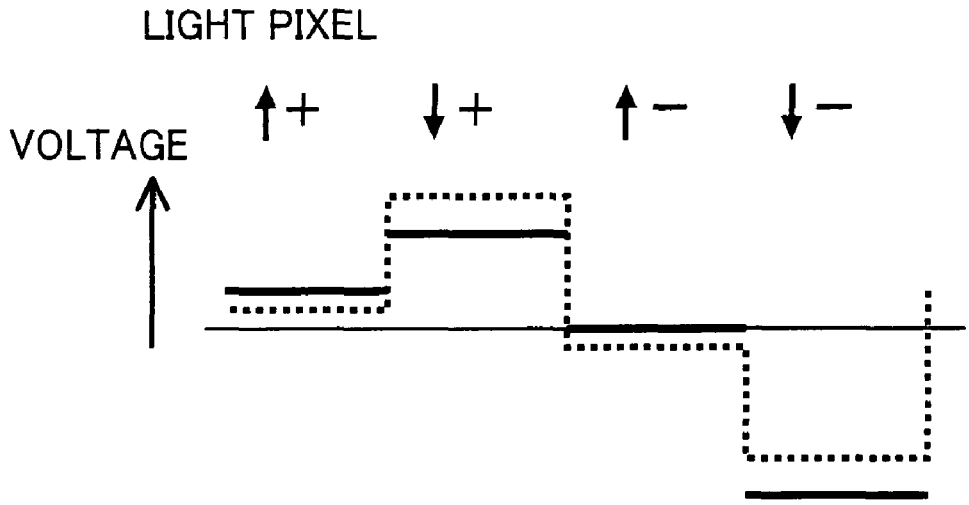
FIG. 34(*a*) is a graph showing the luminance of a light pixel in case where polarity reversal is carried out in a sub frame cycle.
Figure 34:
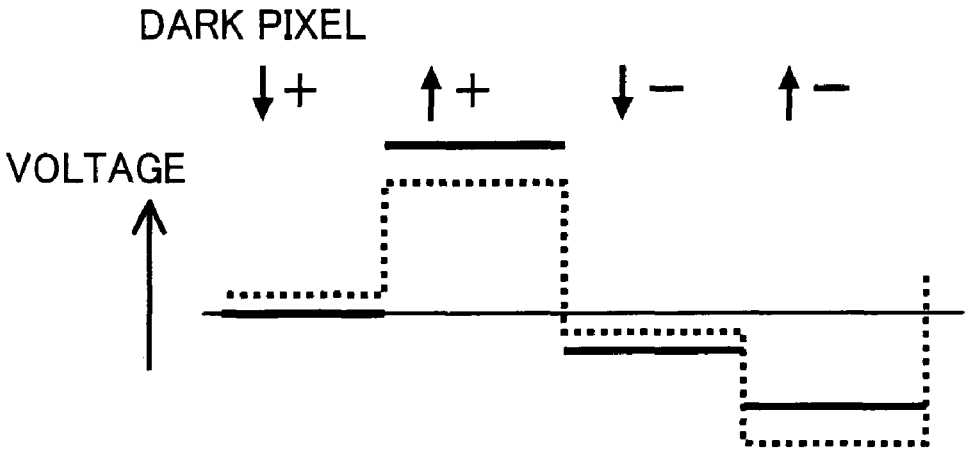

Therefore, in case where the liquid crystal voltage is applied as shown in FIG. 30(*a*), if the state (phase) of the auxiliary signal is reversed in each sub frame, the liquid crystal voltage in the second sub frame is significantly reduced in the light pixel as shown in FIG. 34(*a*), whereas the liquid crystal voltage in the first sub frame is increased a little bit.

As shown in FIG. 34(*b*), meanwhile, in the dark pixel, the liquid crystal voltage in the second sub frame is significantly increased, whereas the liquid crystal voltage in the first sub frame is decreased a little bit.

Therefore, the total liquid crystal voltage in two frames is not 0V (i.e., negative in the light pixel whereas positive in the dark pixel), and hence the DC component cannot be cancelled. It is therefore not possible to sufficiently prevent burn-in, flicker, or the like.

It has been described that a preferable ratio between the first sub frame period and the second sub frame period is 3:1 to 7:1. Alternatively, the ratio between the sub frames may be set at 1:1 or 2:1.

For example, in case where a frame is divided in the ratio of 1:1, as shown in FIG. 9, actual luminance is close to planned luminance in comparison with normal hold display. Also, as shown in FIG. 20, actual brightness is close to planned brightness in comparison with the normal hold display.

In this case, the viewing angle characteristic is clearly improved as compared to the normal hold display.

In the liquid crystal panel, a certain time in accordance with the response speed of liquid crystal is required for causing the liquid crystal voltage (voltage applied to the liquid crystal; interelectrode voltage) to reach a value corresponding to the display signal. Therefore, in case where one of the sub frame periods is too short, the voltage of the liquid crystal may not reach the value corresponding to the display signal, within the sub frame periods.

It is possible to prevent one of the first sub frame period and the second sub frame period from being too short, by setting the ratio between the sub frame periods at 1:1 or 2:1. On this account, image display is suitably performed even if liquid crystal with a slow response speed is adopted.

The ratio of frame division (ratio between the first sub frame and the second sub frame) may be set at n: 1 (n is a natural number not less than 7).

The ratio of division may be set at n:1 (n is a real number not less than 1, more preferably a real number more than 1). For example, the viewing angle characteristic is improved by setting the ratio of division at 1.5:1, as compared to the case where the ration is set at 1:1. Also, as compared to the case where the ratio is set at 2:1, a liquid crystal material with a slow response speed can be easily used.

In case where the ratio of frame division is set at n:1 (n is a real number not less than 1), to display an image with low luminance (low brightness) up to maximum luminance/(n+1)(Tmax/(n+1)), image display is preferably performed in such a manner that dark grayscale is attained in the first sub frame and luminance is adjusted only in the second sub frame.

On the other hand, to display an image with high luminance (high brightness) not lower than Tmax/(n+1), image display is preferably carried out in such a manner that white display is carried out in the second sub frame and luminance is adjusted only in the first sub frame.

With this, it is possible to always keep actual luminance and planned luminance to be equal in one sub frame. The viewing angle characteristic of the image display device 1 of the present example is therefore good.

In case where the ratio of frame division is n:1, substantially same effects are obtained when the first frame is set at n and when the second frame is set at n. In other words, the case of n:1 is identical with the case of 1:n, in terms of the improvement in the viewing angle characteristic.

The arrangement in which n is a real number not less than 1 is effective for the control of luminance grayscale using the aforesaid equations (10)-(12).

In the present example, the sub frame display in regard to the image display device 1 is arranged such that one frame is divided into two sub frames. Alternatively, the image display device 1 may be designed to perform sub frame display in which a frame is divided into three or more sub frames.

In the case of sub frame display in which a frame is divided into s sub frames, when luminance is very low, dark grayscale display is carried out in s-1 sub frames and luminance (luminance grayscale) is adjusted only in one sub frame. If the luminance is too high to be reproduced in one sub frame, white display is carried out in this sub frame, dark grayscale display is carried out in s-2 sub frames, and luminance is adjusted in the remaining one sub frame.

In other words, also in the case of dividing a frame into s sub frames, it is preferable that luminance is adjusted (changed) only in one sub frame and white display or dark grayscale display is carried out in the remaining sub frames. As a result of this, actual luminance and planned luminance are equal in s-1 sub frames It is therefore possible to improve the viewing angle characteristic of the image display device 1.

Figure 35:
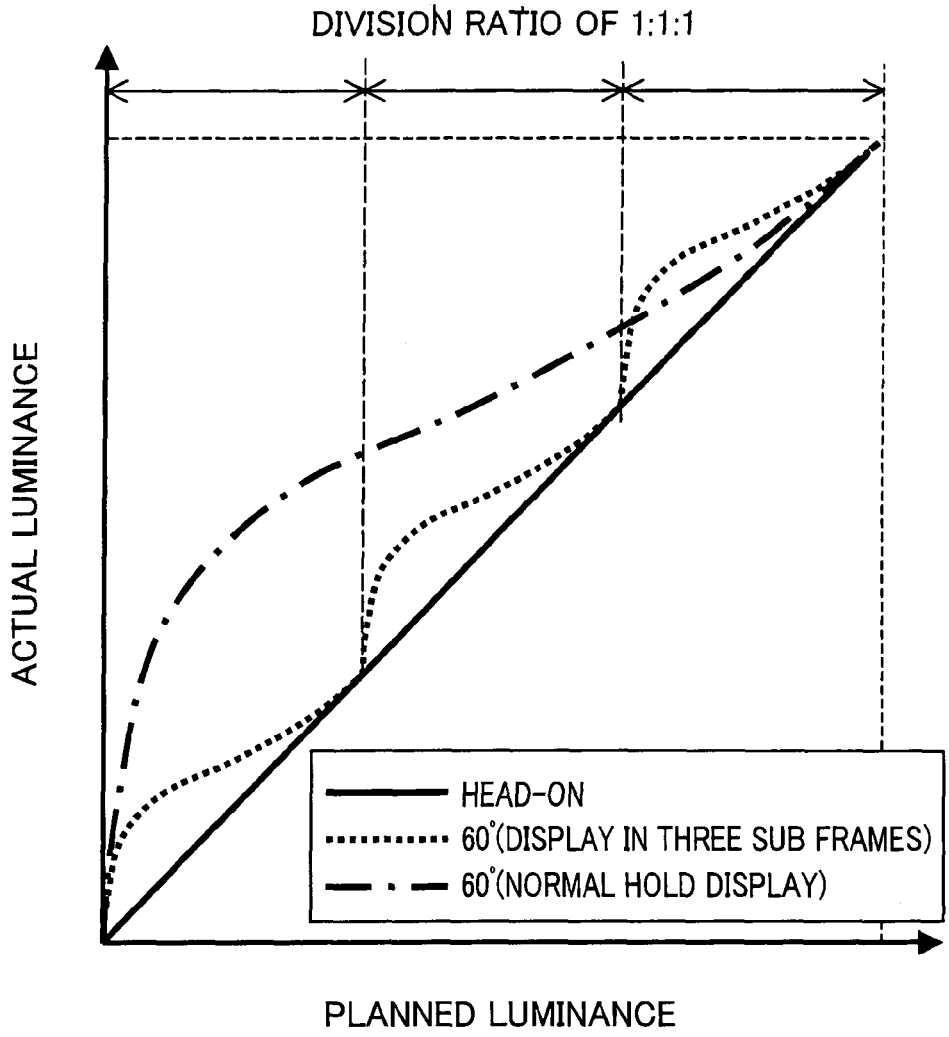
FIG. 35 is a graph showing (i) results (dotted line and full line) of image display by diving a frame into three equal sub frames and (ii) results (dashed line and full line) of normal hold display.

FIG. 35 is a graph showing both (i) the results (doted line and full line) of display with frame division into equal three sub frames and (ii) results (dashed line and full line; identical with those shown in FIG. 8) of normal hold display, in the image display device 1 of the present example.

As shown in the graph, in case where three sub frames are provided, actual luminance is significantly close to planned luminance. It is therefore possible to further improve the viewing angle characteristic of the image display device 1 of the present example.

Among the sub frames, the sub frame in which the luminance is adjusted is preferably arranged so that a temporal barycentric position of the luminance of the sub pixel in the frame period is close to a temporal central position of the frame period.

For example, in case where the number of sub frames is three, image display is performed by adjusting the luminance of the central sub frame, if dark grayscale display is performed in two sub frames. If the luminance is too high to be represented in that sub frame, white display is performed in the sub frame (central sub frame) and the luminance is adjusted in the first or last sub frame. If the luminance is too high to be represented in that sub frame and the central sub frame (white display), the luminance is adjusted in the remaining sub frame.

According to the arrangement above, the temporal barycentric position of the luminance of the sub pixel in one frame period is set so as to be close to the temporal central position of said one frame period. The quality of moving images can therefore be improved because the following problem is prevented: on account of a variation in the temporal varycentric position, needless light or shade, which is not viewed in a still image, appears at the anterior end or the posterior end of a moving image, and hence the quality of moving images is deteriorated.

Figure 36:
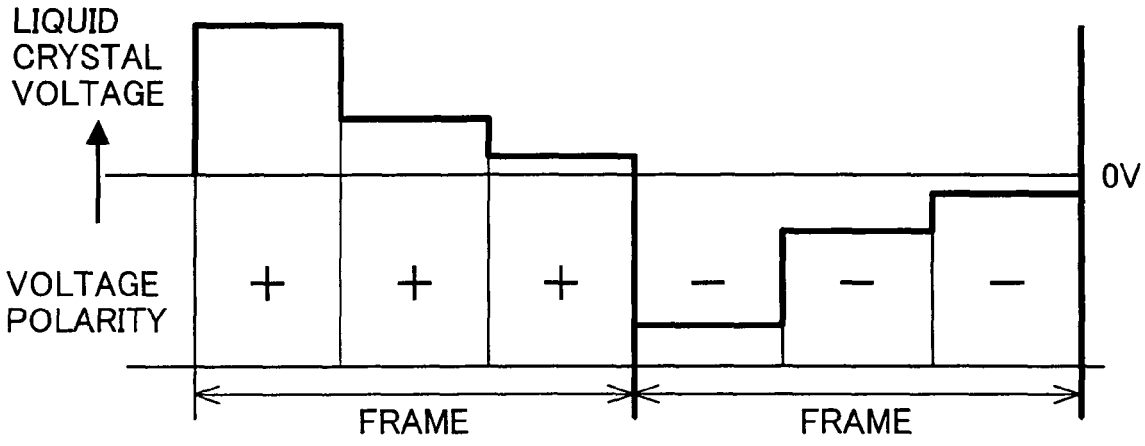
FIG. 36 is a graph showing the transition of a liquid crystal voltage in case where a frame is divided into three and voltage polarity is reversed in each frame.

The polarity reversal drive is preferably carried out even in a case where a frame is divided into s sub frames. FIG. 36 is a graph showing transition of the liquid crystal voltage in case where the voltage polarity is reversed in each frame.

As shown in this figure, the total liquid crystal voltage in this case can be set at 0V in two frames.

Figure 37:
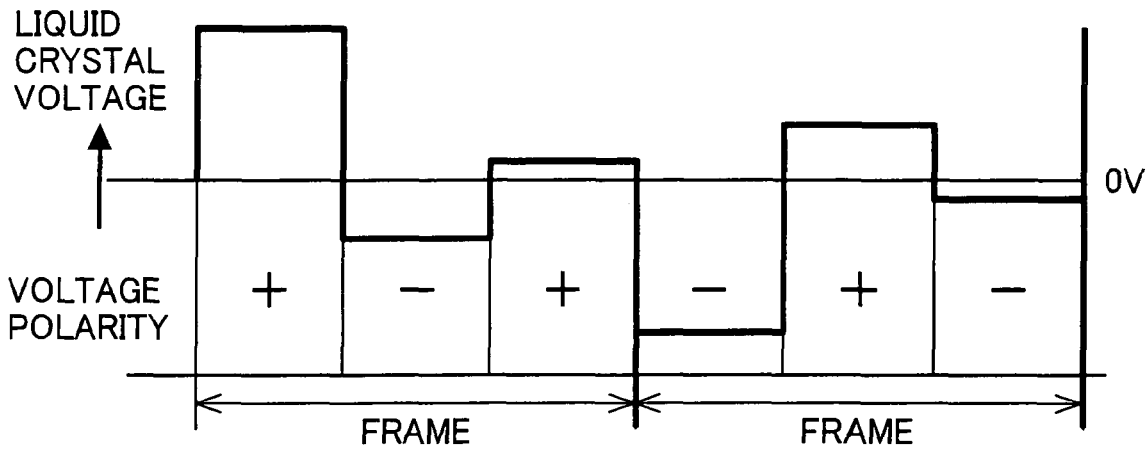
FIG. 37 is a graph showing the transition of a liquid crystal voltage in case where a frame is divided into three and voltage polarity is reversed in each sub frame.

FIG. 37 is a graph showing transition of the liquid crystal voltage in case where a frame is divided into three sub frames and the voltage polarity is reversed in each sub frame.

In this way, when a frame is divided into an odd-number of sub frames, the total liquid crystal voltage in two frames can be set at 0V even if the voltage polarity is reversed in each sub frame.

Therefore, in case where a frame is divided into s sub frames (s is an integer not less than 2), s-th sub frames in respective neighboring frames are preferably arranged so that respective liquid crystal voltages with different polarities are supplied. This allows the total liquid crystal voltage in two frames to be set at 0V.

In case where a frame is divided into s sub frames (s is an integer not less than 2), it is preferable that the polarity of the liquid crystal voltage is reversed in such a way as to set the total liquid crystal voltage in two frames (or more than two frames) to be 0V In the case above, in case where a frame is divided into s sub frames, the number of sub frame in which luminance is adjusted is always 1 and white display (maximum luminance) or dark grayscale display is carried out in the remaining sub frames.

Alternatively, luminance may be adjusted in two or more sub frames. Also in this case, the viewing angle characteristic can be improved by performing white display (maximum luminance) or dark grayscale display in at least one sub frame.

Alternatively, the luminance in a sub frame in which luminance is not adjusted may be set at not the maximum luminance but a value larger than the maximum or second predetermined value. Also, the luminance may be set at not the minimum luminance but a value which is smaller than the minimum or first predetermined value.

This can also sufficiently reduce the deviance (brightness deviance) of actual brightness from planned brightness in a sub frame in which luminance is not adjusted. It is therefore possible to improve the viewing angle characteristic of the image display device 1 of the present example.

Figure 38:
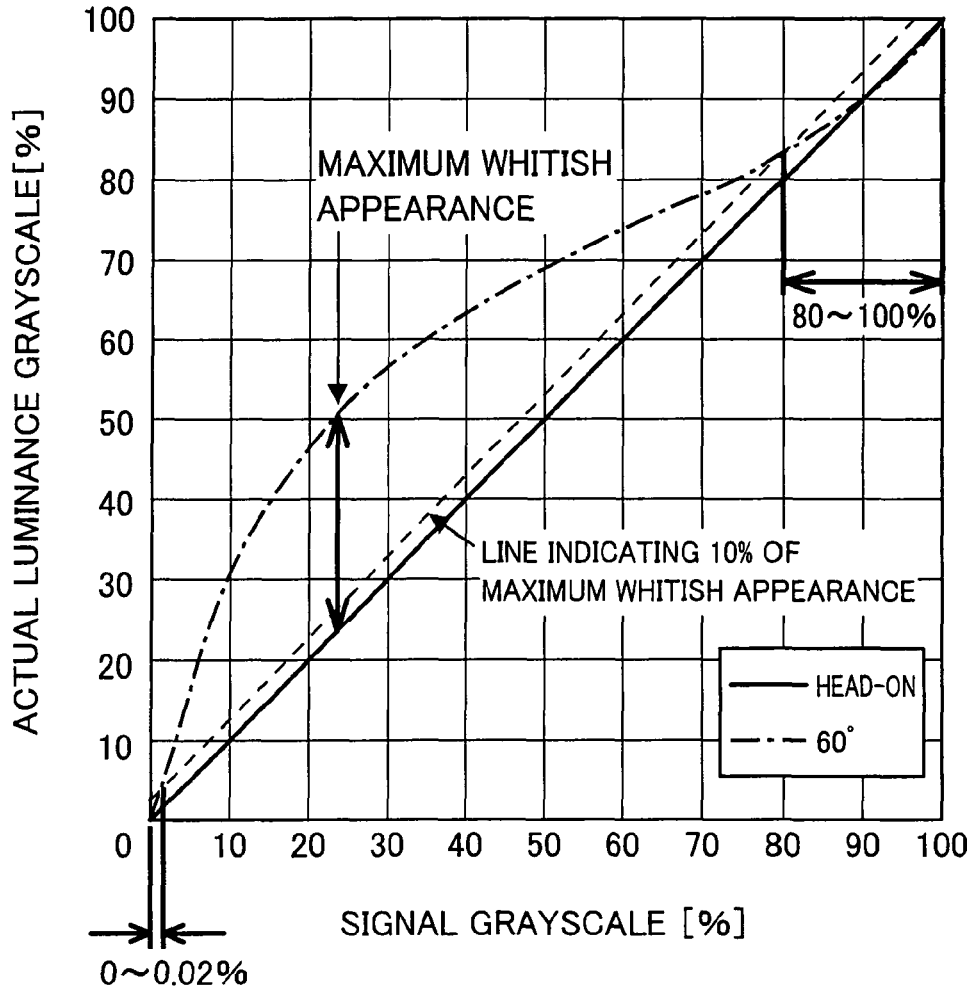
FIG. 38 is a graph showing relations (actual measurement values of viewing angle grayscale properties) between a signal grayscale (%; luminance grayscale of a display signal) of a signal supplied to the display section and an actual luminance grayscale (%), in a sub frame with no luminance adjustment.

FIG. 38 is a graph showing the relationship (viewing angle grayscale properties; actually measured) between a signal grayscale (%; luminance grayscale of a display signal) output to the panel 11 and an actual luminance grayscale (%) corresponding to each signal grayscale, in a sub frame in which luminance is not adjusted.

The actual luminance grayscale is worked out in such a manner that luminance (actual luminance) attained by the liquid crystal panel of the panel 11 in accordance with each signal grayscale is converted to a luminance grayscale by using the aforesaid equation (1).

As shown in the graph above, the aforesaid two grayscales are equal when the liquid crystal panel is viewed head-on (viewing angle of 0°). On the other hand, when the viewing angle is 60°, the actual luminance grayscale is higher than the signal grayscale in intermediate luminance, because of whitish appearance. The whitish appearance is maximized when the luminance grayscale is 20% to 30%, irrespective of the viewing angle.

It has been known that, in regard to the whitish appearance, the quality of image display by the image display device 1 of the present example is sufficient (i.e. the deviance in brightness is sufficiently small) when the whitish appearance is not higher than the "10% of the maximum value" in the graph, which is indicated by the dotted line. The ranges of signal grayscales in which the whitish appearance is not higher than the "10% of the maximum value" is 80-100% of the maximum value of the signal grayscale and 0-0.02% of the maximum value of the signal grayscale. These ranges are consistent even if the viewing angle changes.

The aforesaid second predetermined value is therefore preferably set at 80% of the maximum luminance, whereas the first predetermined value is preferably set at 0.02% of the maximum luminance.

Also, it may be unnecessary to provide a sub frame in which luminance is not adjusted. In other words, in case where image display is performed with s sub frames, it is unnecessary to set the display states of the respective sub frames to be different from one another. Even in such an arrangement, the aforesaid polarity reversal drive in which the polarity of the liquid crystal voltage is reversed in each frame is preferably carried out.

In case where image display is carried out with s sub frames, the viewing angle characteristic of the liquid crystal panel can be improved even by slightly differentiating the display states of the respective sub frames from one another.

Second Embodiment

In the embodiment above, the modulation processing section 31 which performs the grayscale transition emphasizing process is provided in the stage prior to the sub frame processing section 32 which performs frame division and gamma process. In the present embodiment, on the other hand, the modulation processing section is provided in the stage directly subsequent to the sub frame processing section.

Figure 39:
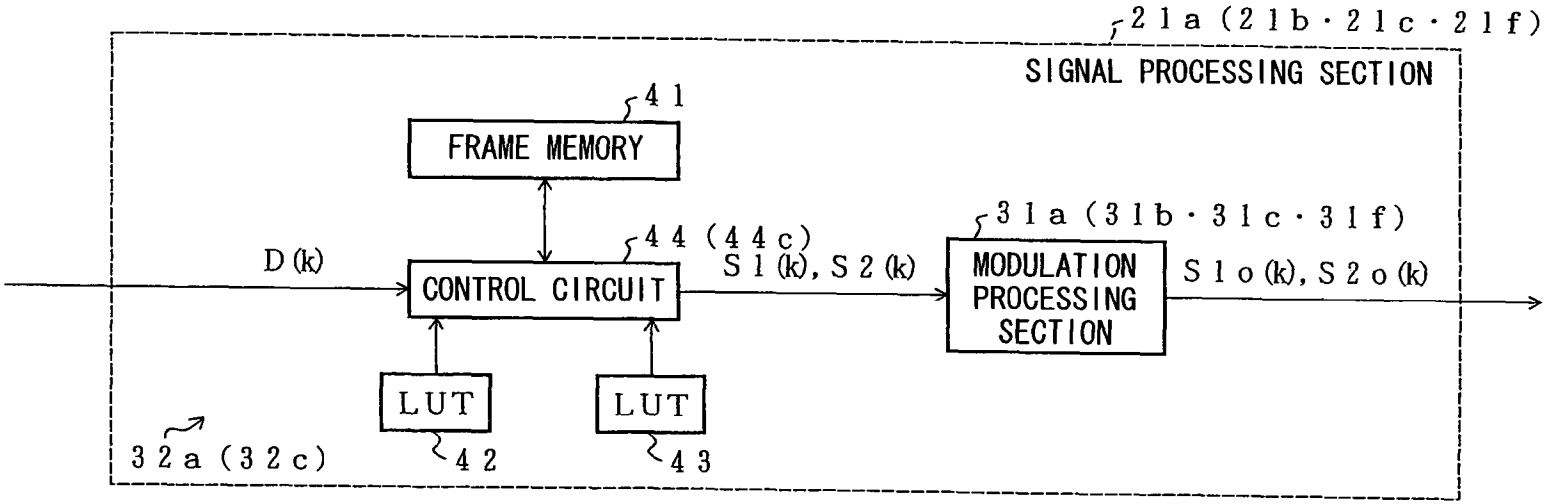
FIG. 39 relates to another embodiment of the present invention and is a block diagram showing the substantial part of a signal processing circuit.

As shown in FIG. 39, a signal processing circuit 21*a* of the present embodiment is provided with a modulation processing section 31*a* and a sub frame processing section 32*a*, whose functions are substantially identical with those of the modulation processing section 31 and the sub frame processing section 32 shown in FIG. 1. It is noted that the sub frame processing section 32*a* of the present embodiment is provided in the stage directly prior to the modulation processing section 31*a*, and frame division and gamma correction are conducted with respect to video data D (i, j, k) before correction, instead of video data Do (i, j, k) after correction. As a result, sets of video data S1 (*i, j, k*) and S2 (*i, j, k*) in the respective sub frames SFR1 (*k*) and SFR1 (*k*), which sets of video data correspond to the video data D (i, j, k), are output.

Because of the change in the circuit configuration, the modulation processing section 31*a* corrects, instead of video data D (i, j, k) before correction, sets of video data S1 (*i, j, k*) and S2 (*i, j, k*) to emphasize grayscale transition, and output the corrected video data as sets of video data S1*o* (i, j, k) and S2*o* (i, j, k) constituting a video signal DAT2. Being similar to the aforesaid sets of video data So1 (*i, j, k*) and So2 (*i, j, k*), the sets of video data S1*o* (i, j, k) and S2*o* (i, j, k) are transmitted in a time-sharing fashion.

Correction and prediction by the modulation processing section 31*a* are performed in units of sub frame. The modulation processing section 31*a* corrects video data So (i, j, x) of the current sub frame (x) based on (1) a predicted value E (i, j, x−1) of the previous sub frame SFR (x−1), which is read out from a frame memory (not illustrated) and (2) video data So (i, j, x) in the current sub frame SFR (x), which is supplied to the sub pixel SPIX (i, j). The modulation processing section 31*a* predicts a value indicating a grayscale which corresponds to luminance to which the sub pixel SPIX (i, j) is assumed to reach at the start of the next sub frame SFR (x+1), based on the predicted value E (i, j, x−1) and the video data So (i, j, x). The modulation processing section 31*a* then stores the predicted value E (i, j, x) in the frame memory.

Figure 40:
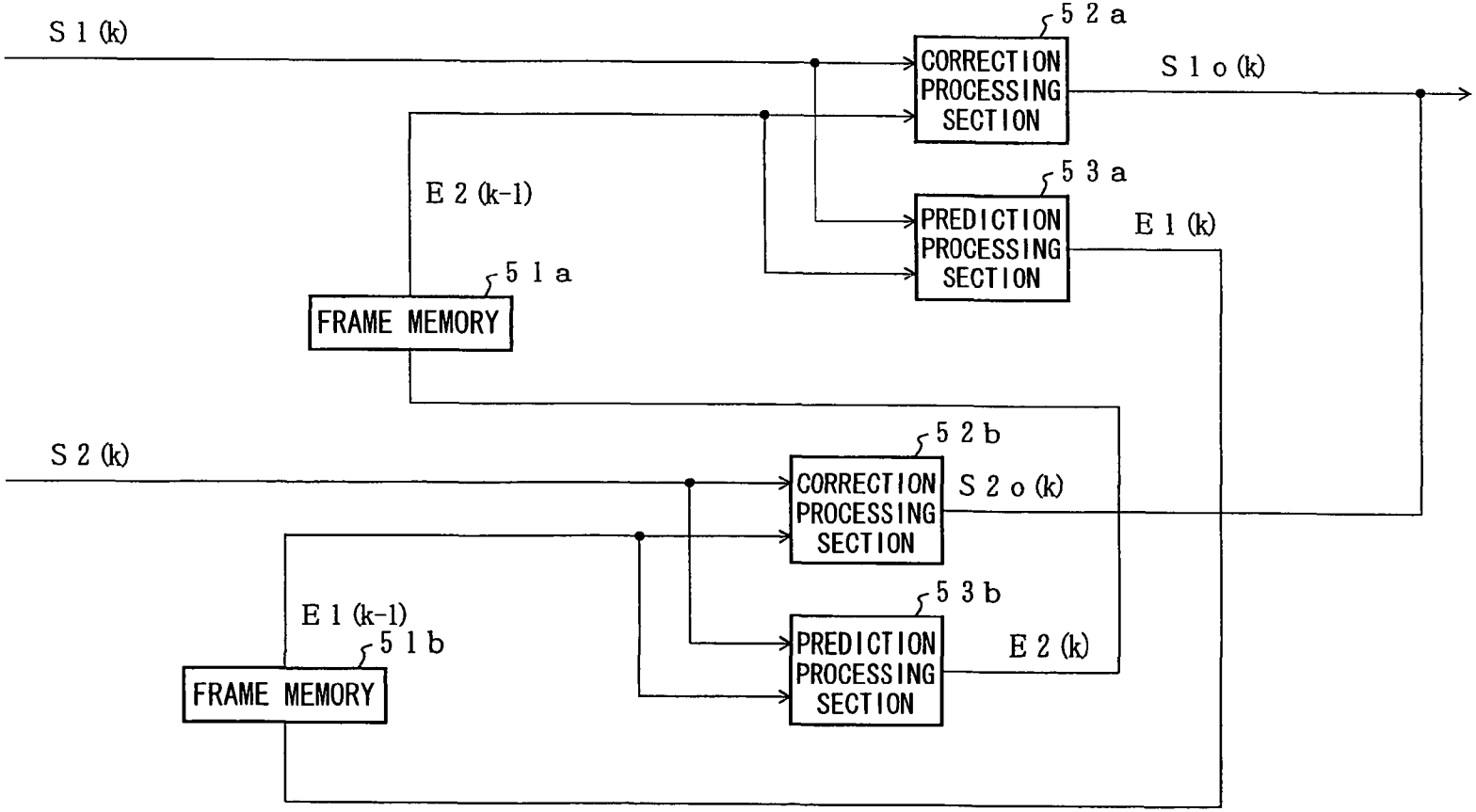
FIG. 40 shows an example of a modulation processing section in the signal processing circuit and is a block diagram showing the substantial part of the modulation processing section.

Before describing an example in which writing speed is decreased, the following will discuss, in reference to FIG. 40, a case where the modulation processing section 31*a* is constructed using the same circuits as those in FIG. 16.

The modulation processing section 31*b* of the present example includes members 51*a*-53*a* for generating the aforesaid video data S1*o* (i, j, k) and members 51*b*-53*b* for generating the aforesaid video data S2*o* (i, j, k). These members 51*a*-53*a* and 51*b*-53*b* are substantially identical with the members 51-53 shown in FIG. 16.

Correction and prediction, however, are performed in units of sub frame. On this account, the members 51*a*-53*b* are designed so as to be capable of operating at a speed twice as fast as the members in FIG. 16. Also, values stored in the respective LUTs (not illustrated in FIG. 40) are different from those in the LUTs shown in FIG. 16.

Instead of the video data D (i, j, k) of the current frame FR (k), the correction processing section 52*a* and the prediction processing section 53*a* receive video data S1 (*i, j, k*) supplied from the sub frame processing section 32*a*. The correction processing section 52*a* outputs the corrected video data as video data S1*o* (i, j k). Similarly, instead of the video data D (i, j, k) of the current frame FR (k), the correction processing section 52*b* and the prediction processing section 53*b* receive video data S2 (*i, j, k*) supplied from the sub frame processing section 32*a*. The correction processing section 52*a* outputs the corrected video data as video data S20 (*i, j, k*). In the meanwhile, the prediction processing section 53*a* outputs a predicted value E1 (*i, j, k*) not to a frame memory 51*a* that the correction processing section 52*a* refers to but to a frame memory 51*b* that the correction processing section 52*b* refers to. The prediction processing section 53*b* outputs a predicted value E2 (*i, j, k*) to the frame memory 51*a*.

The predicted value E1 (*i, j, k*) indicates a grayscale corresponding to luminance to which the sub pixel SPIX (i, j) is assumed to reach at the start of the next sub frame SFR2 (*k*), when the sub pixel SPIX (i, j) is driven by video data S1*o* (i, j, k) supplied from the correction processing section 52*a*. The prediction processing section 53*a* predicts the predicted value E1 (*i, j, k*), based on the video data S1 (*i, j, k*) of the current frame FR (k) and the predicted value E2 (*i, k, k*−1) of the previous frame FR (k−1), which value is read out from the frame memory 51*a*. Similarly, the predicted value E2 (*i, j, k*) indicates a grayscale corresponding to luminance to which the sub pixel SPIX (i, j) is assumed to reach at the start of the next sub frame SFR1 (*k*+1), when the sub pixel SPIX (i, j) is driven by video data S2*o* (i, j, k) supplied from the correction processing section 52*b*. The prediction processing section 53*b* predicts a predicted value E2 (*i, j, k*), based on the video data S2 (*i, j, k*) of the current frame FR (k) and the predicted value E1 (*i, j, k*) read out from the frame memory 51*b*.

Figure 41:
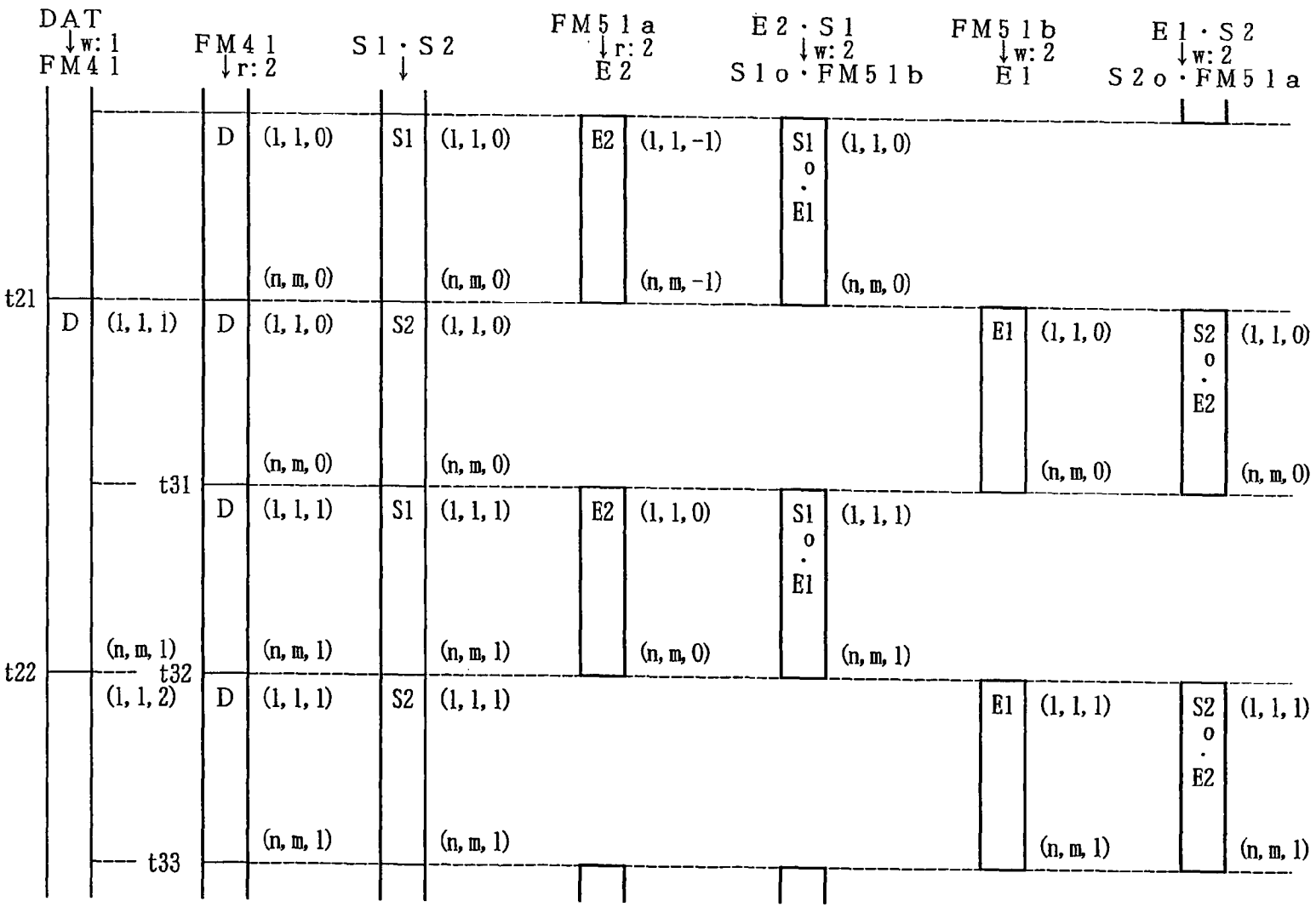
FIG. 41 is a timing chart showing how the signal processing circuit operates.

In the arrangement above, as shown in FIG. 41, when sets of video data D (1, 1, k) to D (n, m, k) of a frame FR (k) are supplied to the signal processing circuit 21*a*, these sets of video data D (1, 1, k) to D (n, m, k) are stored in a frame memory 41 (FM in the figure) of the sub frame processing section 32*a* (during a time period from t21 to t22). The control circuit 44 of the sub frame processing section 32*a* reads out these sets of video data D (1, 1, k) to D (n, m, k) twice in each frame (during a time period from t31 to t33). In the first read out, the control circuit 44 outputs sets of video data S1 (1, 1, k) to S1 (*n, m, k*) for the sub frame SFR1 (*k*) in reference to the LUT 42 (in a time period of t31-t32). In the second read out, the control circuit 44 outputs sets of video data S2 (1, 1, k) to S2 (*n, m, k*) for the sub frame SFR2 (*k*) for the sub frame SFR2 (*k*), in reference to the LUT 43 (in a time period of t32-t33). By providing a buffer memory, it is possible to adjust the time difference between a time t21 at which the signal processing circuit 21*a* receives the first set of video data D (1, 1, k) and a time t31 at which a set of video data S1 (1, 1, k) for the sub frame SFR1 (*k*), which data corresponds to the foregoing video data D (1, 1, k), is output. FIG. 41 shows a case where the time difference is a half of one frame (one sub frame), for example.

On the other hand, in the time period of t31 to t32, the frame memory 51*a* of the modulation processing section 31*b* stores predicted values E2 (1, 1, k−1) to E2 (*n, m, k*−1) which are updated in reference to sets of video data S2 (1, 1, k−1) to S2 (*n, m, k*−1) of the sub frame SFR2 (*k*−1) in the previous frame FR (k−1). The correction processing section 52*a* corrects sets of video data S1 (1, 1, k) to S1 (*n, m, k*) in reference to the predicted values E2 (1, 1, k−1) to E2 (*n, m, k*−1), and outputs the corrected vide data as sets of corrected video data S1*o* (1, 1, k) to S1*o* (n, m, k). In a similar manner, the prediction processing section 53*a* generates predicted values E1 (1, 1, k) to predicted value E1 (*n, m, k*) and stores them in the frame memory 51*b*, based on the sets of video data S1 (1, 1, K) to S1 (*n, m, k*) and the predicted values E2 (1, 1, k−1) to E2 (*n, m, k*−1).

Similarly, in the time period of t32 to t33, the correction processing section 52*b* corrects sets of video data S2 (1, 1, k) to S2 (*n, m, k*) with reference to the predicted values E1 (1, 1, k) to E1 (*n, m, k*), and outputs the corrected video data as sets of corrected video data S2*o* (1, 1, k) to S2*o* (n, m, k). The prediction processing section 53*b* generates predicted values E2 (1, 1, k) to E2 (*n, m, k*) based on the sets of video data S2 (1, 1, k) to S2 (*n, m, k*) and the predicted values E1 (1, 1, k−1) to E1 (*n, m, k*−1), and stores the generated values in the frame memory 51*a*.

Strictly speaking, in case where a buffer is provided between each pair of neighboring circuits for a delay of each circuit or timing adjustment, timings at which the former-stage circuit outputs data is different from timings at which the latter-stage circuit outputs data, because of a delay in the buffer circuit, or the like.

In this way, the signal processing circuit 21*a* of the present embodiment performs correction (emphasis of grayscale transition) and prediction in units of sub frame. Prediction can therefore be performed precisely as compared to the first embodiment in which the aforesaid processes are performed in units of frame. It is therefore possible to emphasize the grayscale transition with higher precision. As a result, deterioration of image quality on account of inappropriate grayscale transition emphasis is restrained, and the quality of moving images is improved.

In the present arrangement, video data S1 which falls within a range set for dark display is set at a dark grayscale other than black. On this account, a speed to respond intermediate luminance is significantly improved as compared to a case where both sets of video data S1 and S2 for the sub frames SFR1 and SFR2 have values indicating black when video data D indicates black, and hence the quality of moving images is significantly improved.

Most of the members constituting the signal processing circuit 21*a* of the present embodiment are typically integrated in one integrated circuit chip, for the sake of speed-up. However, each of the frame memories 41, 51*a*, and 51*b* requires storage capacity significantly larger than a LUT, and hence cannot be easily integrated into an integrated circuit. The frame memories are therefore typically connected externally to the integrated circuit chip.

In this case, the data transmission paths for the frame memories 41, 51*a* and 51*b* are external signal lines. It is therefore difficult to increase the transmission speed as compared to a case where transmission is performed within the integrated circuit chip. Moreover, when the number of signal lines is increased to increase the transmission speed, the number of pins of the integrated circuit chip is also increased, and hence the size of the integrated circuit is significantly increased. Also, since the modulation processing section 31*b* shown in FIG. 40 is driven at a doubled clock, each of the frame memories 41, 51*a*, and 51*b* must have a large capacity and be able to operate at a high speed.

The following will give details of the transmission speed. As shown in FIG. 41, sets of video data D (1, 1, k) to D (n, m, k) are written into the frame memory 41 once in each frame. The frame memory 41 outputs sets of video data D (1, 1, k) to D (n, m, k) twice in each frame. Therefore, provided that, as in the case of a typical memory, processes of writing and reading share the same signal line for data transmission, the frame memory 41 is required to support access with a frequency of not less than three times as high as a frequency f at the time of transmission of sets of video data D for a video signal DAT. In FIG. 41, an access speed required in writing or reading is expressed in such a way that, after an alphabet (r/w) indicating reading/writing, a magnification is indicated such as r:2, assuming that the access speed required for reading or writing in the frequency f is 1.

Figure 43:
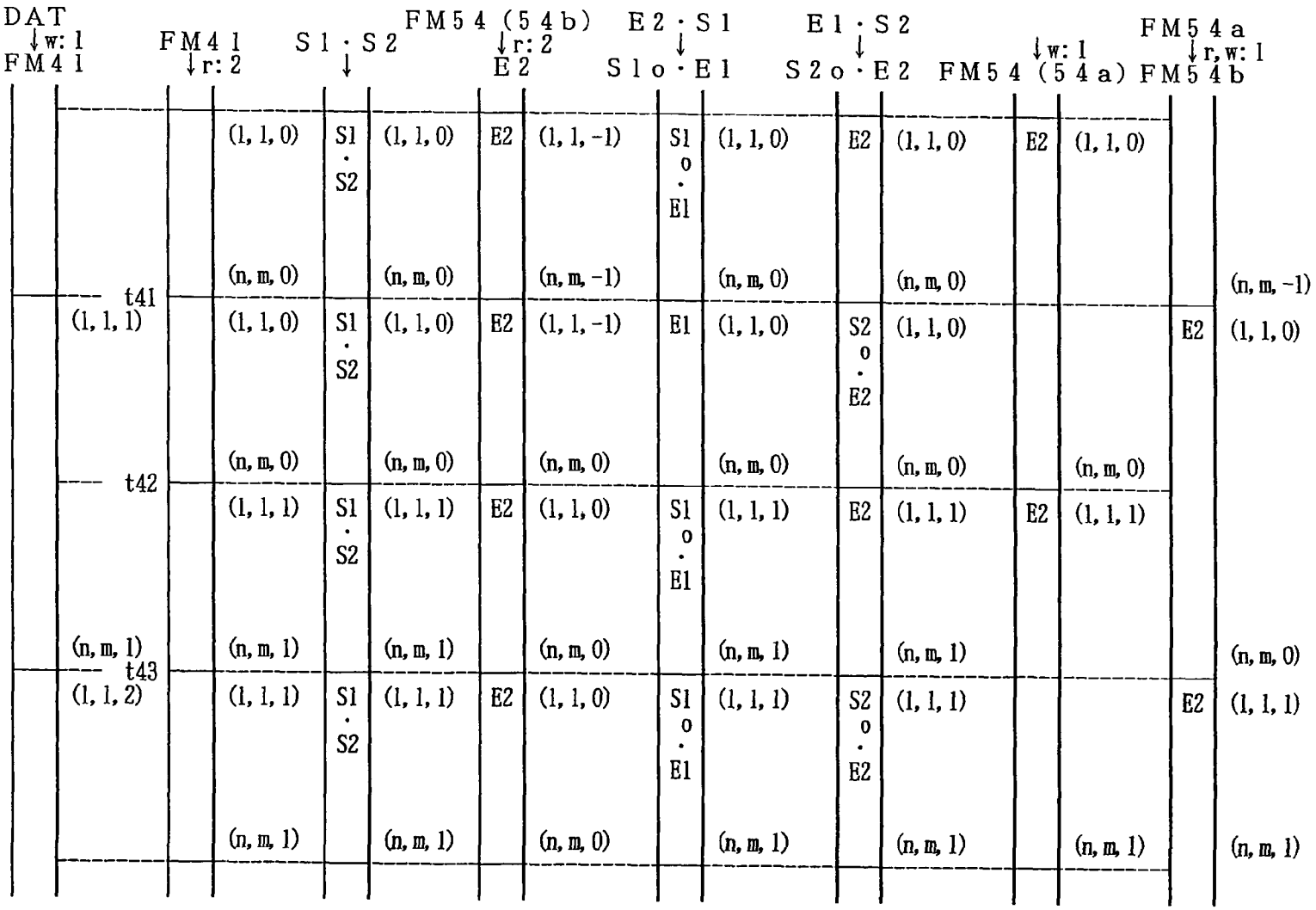
FIG. 43 is a timing chart showing how the signal processing circuit operates.
Figure 44:
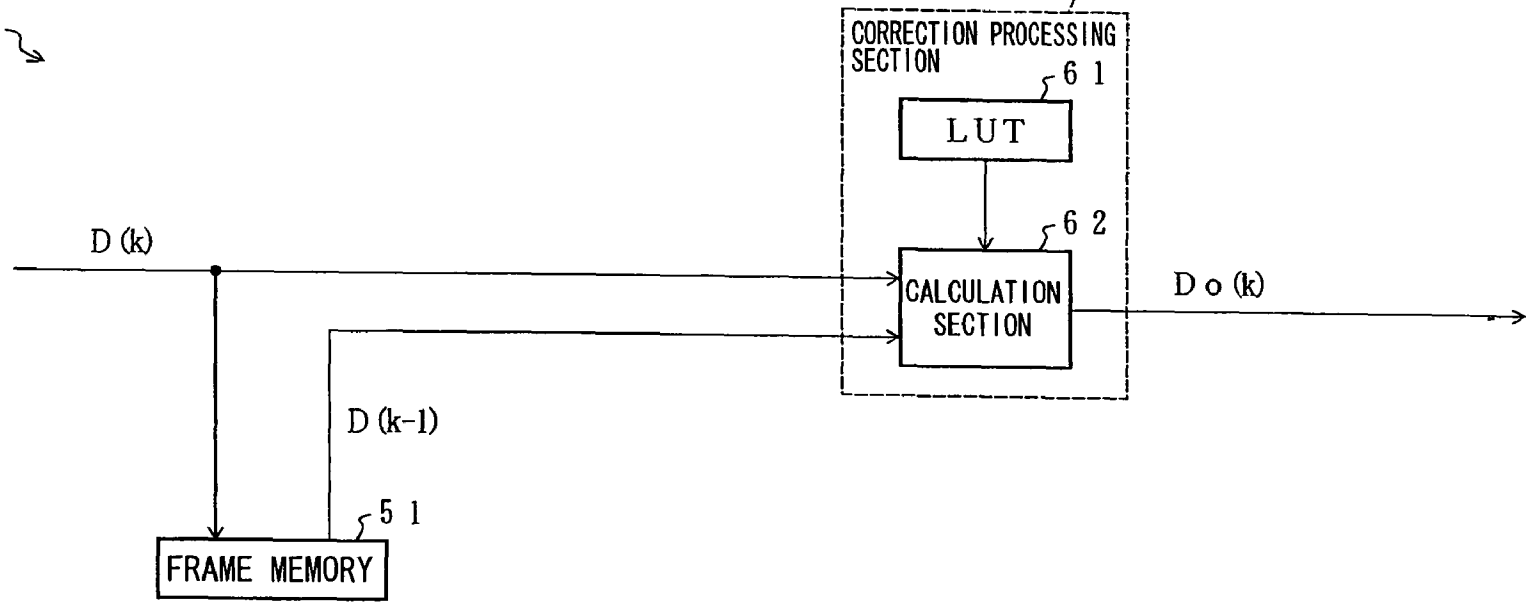
FIG. 44 relates to a variant example and is a block diagram showing the substantial part of the modulation processing section.

On the other hand, to/from the frame memories 51*a* and 51*b*, the predicted values E2 (1, 1, k) to E2 (*n, m, k*) and the predicted values E1 (1, 1, k) to E1 (*n, m, k*) are written/read out once in each frame. In the arrangement of FIG. 40, as shown in FIG. 43, a time period for readout from the frame memory 51*a* (e.g. t31 to t32) is different from a time period for readout from the frame memory 51*b* (e.g. t32 to t33), and each of these time periods is half as long as one frame. Similarly, each of time periods for writing into the respective frame memories 51*a* and 51*b* is half as long as one frame. On this account, the frame memories 51*a* and 51*b* must support an access speed four times higher than the frequency f.

As a result, in case where the modulation processing section 31*b* shown in FIG. 40 is adopted, the frame memories 41, 51*a*, and 51*b* are required to support a higher access speed. This causes problems such that the manufacturing costs of the signal processing circuit 21*a* is significantly increased, and the size and the number of pins of the integrated circuit chip are increased because of the increase in signal lines.

Figure 42:
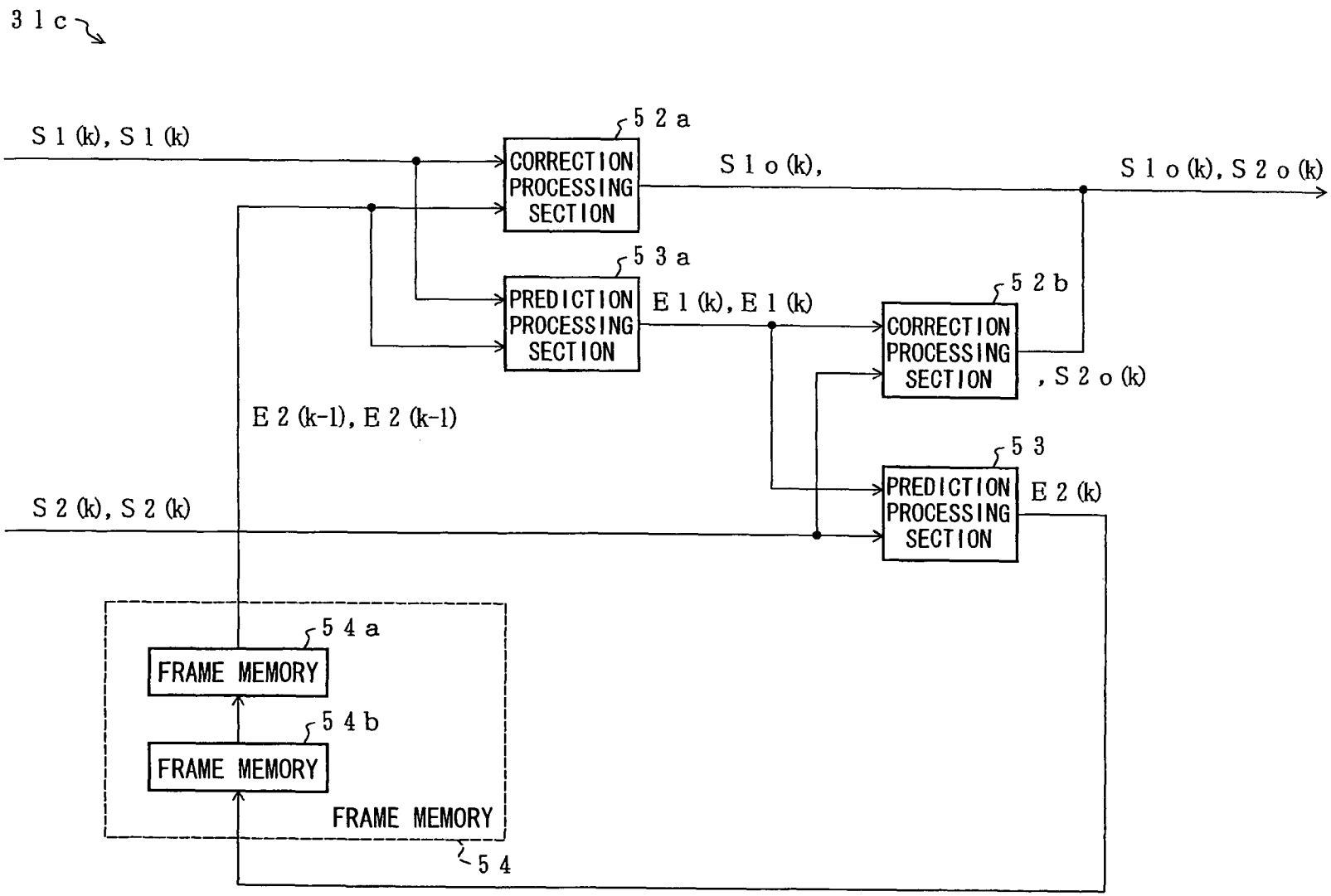
FIG. 42 shows another example of the modulation processing section in the signal processing circuit and is a block diagram showing the substantial part of the modulation processing section.

On the other hand, in the signal processing circuit 21 of another example of the present embodiment, as shown in FIG. 42, sets of video data S1 (1, 1, k) to S1 (*s, m, k*), sets of video data S2 (1, 1, k) to S2 (*n, m, k*), and predicted values E1 (1, 1, k) to E1 (*n, m, k*) are generated twice in each frame, and a half of processes of generation and output of the predicted values E2 (1, 1, k) to E2 (*n, m, k*) is thinned out and the predicted values E2 (1, 1, k) to E2 (*n, m, k*) is stored in the frame memory once in each frame. The frequency of writing in the frame memory is reduced in this way.

More specifically, in the signal processing circuit 21*c* of the present example, the sub frame processing section 32*c* can output sets of video data S1 (1, 1, k) to S1 (*n, m, k*) and sets of video data S2 (1, 1, k) to S2 (*n, m, k*) twice in each frame.

That is to say, the control circuit 44 of the sub frame processing section 32 shown in FIG. 40 stops outputting sets of video data S2 (1, 1, k) to S2 (*n, m, k*) while outputting sets of video data S1 (1, 1, k) to S1 (*n, m, k*). On the other hand, as shown in FIG. 43, the control circuit 44*c* of the sub frame processing section 32*c* of the present example outputs sets of video data S2 (1, 1, k) to S2 (*n, m, k*) even while outputting sets of video data S1 (1, 1, k) to S1 (*n, m, k*) (in a time period of t41-t42), and also outputs sets of video data S1 (1, 1, k) to S1 (*n, m, k*) even while outputting sets of video data S2 (1, 1, k) to S2 (*n, m, k*) (in a time period of t42-t43).

The sets of video data S1 (*i, j, k*) and S2 (*i, j, k*) are generated based on the same value, i.e. the video data D (i, j, k). Therefore, the control circuit 44*c* generates the sets of video data S1 (*i, j, k*) and S2 (*i, j, k*) based on one set of video data D (i, j, k), each time one set of video data D (i, j, k) from the frame memory 41 is read out. This makes it possible to prevent an amount of data transmission between the frame memory 41 and the control circuit 44*c* from being increased. An amount of data transmission between the sub frame processing section 32*c* and the modulation processing section 31*c* is increased as compared to the arrangement shown in FIG. 40. No problem, however, is caused by this increase, because the transmission is carried out within the integrated circuit chip.

On the other hand, as shown in FIG. 42, the modulation processing section 31*c* of the present example includes a frame memory (predicted value storage means) 54 in place of frame memories 51*a* and 51*b* which store respective predicted values E1 and E2 for one sub frame. The frame memory 54 stores predicted values E2 for two sub frames and outputs the predicted values E2 (1, 1, k−1) to E2 (*n, m, k*−1) twice in each frame. The modulation processing section 31*c* of the present example is provided with members 52*c*, 52*d*, 53*c*, and 53*d* which are substantially identical with the members 52*a*, 52*b*, 53*a*, and 53*d* shown in FIG. 40. In the present example, these members 52*c*, 52*d*, 53*c*, and 53*d* correspond to correction means recited in claims.

However, being different from the arrangement shown in FIG. 40, predicted values E2 (1, 1, k−1) to E2 (*n, m, k*−1) to the correction processing section 52*c* and the prediction processing section 53*c* are supplied not from the frame memory 41*a* but from the frame memory 54. Predicted values E1 (1, 1, k) to E1 (*n, m, k*) to the correction processing section 52*d* and the prediction processing section 53*d* are supplied not from the frame memory 41*b* but from the prediction processing section 53*c*.

Also, as discussed above, in each frame, the predicted values E2 (1, 1, k−1) to E2 (*n, m, k*−1) and sets of video data S1 (1, 1, k) to S1 (*n, m, k*) are output twice, and the prediction processing section 53*c* generates, as shown in FIG. 42, the predicted values E1 (1, 1, k) to E1 (*n, m, k*) and output them, twice in each frame. Although the number of predicted values E1 which are output in each frame is different, the prediction process and the circuit configuration of the prediction processing section 53*c* are identical with those of the prediction processing section 53*a* shown in FIG. 40.

Also, in each frame, predicted values E2 (1, 1, k−1) to E2 (*n, m, k*−1) and sets of video data S1 (1, 1, k) to S1 (*n, m, k*) are output twice. The correction processing section 52*c* generates and outputs sets of corrected video data S1*o* (1, 1, k) to S1*o* (n, m, k) (during a time period of t41-t42), based on the predicted values output in the first time. Furthermore, predicted values E1 (1, 1, k) to E1 (*n, m, k*) and sets of video data S2 (1, 1, k) to S2 (*n, m, k*) are output twice in each frame, and the correction processing section 52*d* generates and outputs sets of corrected video data S2*o* (1, 1, k) to S2*o* (n, m, k) (during a time period of t42 to t43), based on the predicted values and sets of video data output in the second time.

Since the sets of video data S2 (1, 1, k) to S2 (*n, m, k*) and the predicted values E1 (1, 1, k) to E1 (*n, m, k*) are output twice in each frame, predicted values E2 (1, 1, k) to E2 (*n, m, k*) can be generated twice in each frame. However, in the prediction processing section 53*d* of the present example, a half of the predicted values E (1, 1, k) to E2 (*n, m, k*) and the processes of generation and output of the predicted values E (1, 1, k) to E2 (*n, m, k*) are thinned out, and predicted values E (1, 1, k) to E2 (*n, m, k*) are generated and output once in each frame. Timings to generate and output the predicted values E2 in each frame are different from the above, but the prediction process is identical with that of the prediction processing section 53*b* shown in FIG. 40. The circuit configuration is substantially identical with the prediction processing section 53*b*, but a circuit to determine a timing to perform the thin-out and to thin out the generation processes and the output processes is additionally provided.

As an example of the thin-out, the following will describe an arrangement in which the prediction processing section 53*d* thins out every other generation processes and output processes, in case where the time ratio between the sub frames SFR1 and SFR1 is 1:1. More specifically, during a time period (of t41 to t42) in which video data S2 (*i, j, k*) and a predicted value E1 (*i, j, k*) for the first time are output, the prediction processing section 53*d* generates a predicted value E2 (*i, j, k*) based on a predetermined odd-number-th or even-number-th set of video data S2 (*i, j, k*) and predicted value E1 (*i, j, k*). On the other hand, in a time period (t42 to t43) in which a video data S2 (*i, j, k*) and a predicted value E1 (*i, j, k*) for the second time is output, the prediction process section 53*d* generates a predicted value E (i, j, k) based on the remaining video data and predicted value. With this, the prediction processing section 53*d* can output all predicted values E2 (1, 1, k) to E2 (*n, m, k*) once in each frame, and the time length required for outputting the predicted value E2 (*i, j, k*) is twice as long as the case of FIG. 40.

In the present arrangement, in each frame, the predicted values E2 (1, 1, k) to E2 (*n, m, k*) are written once in one frame period. It is therefore possible to reduce the access speed required by the frame memory 54 to ¾ of the arrangement of FIG. 40. For example, in case of an XGA video signal, since the dot clock of each set of video data (i, j, k) is about 65 [MHz], the frame memories 51*a* and 51*b* shown in FIG. 40 must support an access with a dot clock four times higher than this, i.e. about 260 [MHz]. In the meanwhile, being similar to the frame memory 41, the frame memory 54 of the present example is required to support a dot clock only three times higher than the above, i.e. about 195 [MHz].

In the case above, the generation processes and output processes are alternately thinned out by the prediction processing section 53*d* of the present example when the time ratio between the sub frames SFR1 and SFR2 is 1:1. However, even if the time ratio is differently set, the access speed that the frame memory 54 is required to have can be decreased on condition that a half of the output processes is thinned out, in comparison with a case where the thin-out is not performed.

All storage areas (for two sub frames) of the frame memory 54 may be accessible with the aforesaid access speed but the frame memory 54 of the present example is composed of two frame memories 54*a* and 54*b*, and hence an access speed that one of these frame memories is required to have is further decreased.

More specifically, the frame memory 54 is composed of two frame memories 54*a* and 54*b* each of which can store predicted values E2 for one sub frame. To the frame memory 54*a*, a predicted value E2 (*i, j, k*) is written by the prediction processing section 53*d*. Predicted values E2 (1, 1, k−1) to E2 (*n, m, k*−1) for one sub frame, which have been written in the previous frame FR (k−1), can be sent to the frame memory 54*b*, before these predicted values E2 (1, 1, k−1) to E2 (*n, m, k*−1) are overwritten by predicted values E2 (1, 1, k) to E2 (*n, m, k*) of the current frame FR (k). Since reading/writing of predicted values E2 from/into the frame memory 54*a* in one frame period is only performed once, the frame memory 54*a* is required only to support an access with a frequency identical with for the second time is output, the prediction process section 53*d* generates a predicted value E (i, j, k) based on the remaining video data and predicted value. With this, the prediction processing section 53*d* can output all predicted values E2 (1, 1, k) to E2 (*n, m, k*) once in each frame, and the time length required for outputting the predicted value E2 (*i, j, k*) is twice as long as the case of FIG. 40.

In the present arrangement, in each frame, the predicted values E2 (1, 1, k) to E2 (*n, m, k*) are written once in one frame period. It is therefore possible to reduce the access speed required by the frame memory 54 to ¾ of the arrangement of FIG. 40. For example, in case of an XGA video signal, since the dot clock of each set of video data (i, j, k) is about 65 [MHz], the frame memories 51*a* and 51*b* shown in FIG. 40 must support an access with a dot clock four times higher than this, i.e. about 260 [MHz]. In the meanwhile, being similar to the frame memory 41, the frame memory 54 of the present example is required to support a dot clock only three times higher than the above, i.e. about 195 [MHz].

In the case above, the generation processes and output processes are alternately thinned out by the prediction processing section 53*d* of the present example when the time ratio between the sub frames SFR1 and SFR2 is 1:1. However, even if the time ratio is differently set, the access speed that the frame memory 54 is required to have can be decreased on condition that a half of the output processes is thinned out, in comparison with a case where the thin-out is not performed.

All storage areas (for two sub frames) of the frame memory 54 may be accessible with the aforesaid access speed but the frame memory 54 of the present example is composed of two frame memories 54*a* and 54*b*, and hence an access speed that one of these frame memories is required to have is further decreased.

More specifically, the frame memory 54 is composed of two frame memories 54*a* and 54*b* each of which can store predicted values E2 for one sub frame. To the frame memory 54*a*, a predicted value E2 (*i, j, k*) is written by the prediction processing section 53*d*. Predicted values E2 (1, 1, k−1) to E2 (*n, m, k*−1) for one sub frame, which have been written in the previous frame FR (k−1), can be sent to the frame memory 54*b*, before these predicted values E2 (1, 1, k−1) to E2 (*n, m, k*−1) are overwritten by predicted values E2 (1, 1, k) to E2 (*n, m, k*) of the current frame FR (k). Since reading/writing of predicted values E2 from/into the frame memory 54*a* in one frame period is only performed once, the frame memory 54*a* is required only to support an access with a frequency identical with the aforesaid frequency f.

On the other hand, the frame memory 54*b* receives the predicted values E2 (1, 1, k−1) to E2 (*n, m, k*−1), and outputs the predicted values E2 (1, 1, k−1) to E2 (*n, m, k*−1) twice in each frame. In this case, in one frame period, it is necessary to write predicted values E2 for one sub frame once and read out these predicted values E2 twice. On this account, it is necessary to support an access with a frequency three times higher than the frequency f.

In the arrangement above, the predicted values E2 stored in the frame memory 54*a* by the prediction processing section 53*d* are sent to the frame memory 54*b* which is provided for outputting the predicted values E2 to the correction processing section 52*c* and the prediction processing section 53*c*. On this account, among the storage areas of the frame memory 54, an area where reading is carried out twice in each frame is limited to the frame memory 54*b* having a storage capacity for one sub frame. FIG. 43 shows an example in which sending from the frame memory 54*a* to the frame memory 54*b* is shifted for one sub frame, in order to reduce a storage capacity required for buffer.

As a result, as compared to the case where all storage areas of the frame memory 54 can respond to a frequency three times higher than the frequency f, it is possible to reduce the size of the storage areas which can respond to an access with a frequency three times higher than the frequency f, and hence the frame memory 54 can be provided easily and with lower costs.

In the case above, generation processes and output processes of predicted values E2 are thinned out in the prediction processing section 53*d*. Alternatively, only output processes may be thinned out. In this case, predicted values E1 (1, 1, k) to E1 (*n, m, k*) and sets of video data S2 (1, 1, k) to S2 (*n, m, k*) are generated in such a way as to generate predicted values E2 (1, 1, k) to E2 (*n, m, k*) twice in each frame period, and generation processes and output processes of predicted values E2 based on the generated predicted values are thinned out so that timings to generate the predicted values E2 (1, 1, k) to E2 (*n, m, k*) are dispersed across one frame period. Alternatively, the following arrangement may be used.

The modulation processing section includes: correction processing sections 52*c* and 52*d* which correct plural sets of video data S1 (*i, j, k*) and S2 (*i, j, k*) generated in each frame period and output sets of corrected video data S1*o* (i, j, k) and S2*o* (i, j, k) corresponding to respective sub frames SFR1 (*k*) and SFR2 (*k*) constituting the frame period, the number of sub frames corresponding to the number of aforesaid plural sets of video data; and a frame memory 54 which stores a predicted value E2 (*i, j, k*) indicating luminance that the sub pixel SPIX (i, j) reaches at the end of the period in which the sub pixel SPIX (i, j) is driven by corrected video data S2*o* (i, j, k) corresponding to the last sub frame SFR2 (*k*). When video data S1 (*i, j, k*) or S2 (*i, j, k*), which is the target of correction, corresponds to the first sub frame SFR1 (*k*) (i.e. in the case of video data S1 (*i, j, k*)), the correction processing section 52*c* corrects the video data S1 (*i, j, k*) in such a way as to emphasize the grayscale transition from the luminance indicated by the predicted value E2 (*i, j, k*−1) read out from the frame memory 54 to the luminance indicated by the video data S1 (*i, j, k*). Also, when video data S1 (*i, j, k*) or S2 (*i, j, k*), which is the target of correction, corresponds to the second sub frame or one of the subsequent sub frames (i.e. in the case of video data S2 (*i, j, k*)), the prediction processing section 53*c* of the modulation processing section and the correction processing section 52*d* predict the luminance of the sub pixel SPIX (i, j) at the start of the sub frame SFR2 (*k*), based on the video data S2 (*i, j, k*), the video data S1 (*i, j, k*) corresponding to the previous sub frame SFR1 (*k*), and the predicted value E2 (*i, j, k*−1) stored in the frame memory 54, and then correct the video data S2 (*i, j, k*) in such a way as to emphasize the grayscale transition from the predicted luminance (i.e. luminance indicated by E1 (*i, j, k*)) to the luminance indicated by the video data S2 (*i, j, k*). Furthermore, when video data S1 (*i, j, k*) or S2 (*i, j, k*), which is the target of correction, corresponds to the last sub frame SFR2 (*k*) (i.e. in the case of video data S2 (*i, j, k*)), the prediction processing sections 53*c* and 53*d* in the modulation processing section predict the luminance of the sub pixel SPIX (i, j) at the end of the sub frame SFR2 (*k*) corresponding to the video data S2 (*i, j, k*) which is the target of correction, based on the video data S2 (*i, j, k*), the video data S1 (*i, j, k*) corresponding to the previous sub frame SFR1 (*k*), and the predicted value E2 (*i, j, k*−1) stored in the frame memory 54, and then stores the predicted value E2 (*i, j, k*), which indicates the result of the prediction, in the frame memory 54.

In the arrangement above, being different from the arrangement shown in FIG. 40, the sets of video data S1 (*i, j, k*) and S2 (*i, j, k*) can be corrected without each time storing, in the frame memory, the results E1 (*i, j, k*) and E2 (*i, j, k*) of the prediction of the luminance that the sub pixel SPIX (i, j) reaches at the end of the sub frame SFR2 (*k*–1) and the sub frame SFR1 (*k*–1) which are directly prior to the sub frames SFR1 (*k*) and SFR2 (*k*) corresponding to the sets of video data S1 (*i, j, k*) and S2 (*i, j, k*).

As a result, an amount of data of predicted values stored in the frame memory in each frame period is reduced as compared to a case where the result of prediction in each sub frame is each time stored in the frame memories (51*a* and 51*b*) as shown in FIG. 40. Because of the reduction in data amount, even in a case, for example, where the access speed that the frame memory is required to have is reduced by providing buffer or the like, the reduction in the access speed can be achieved by providing a smaller circuit.

As shown in FIG. 42, however, it is possible to reduce the access speed that the frame memory is required to have without providing new buffer, by an arrangement such that the prediction processing section 53*d* thins out a half of predicted values E (1, 1, k) to E2 (*n, m, k*) and generation processes and output processes of the predicted values E (1, 1, k) to E2 (*n, m, k*), and the predicted values E (1, 1, k) to E2 (*n, m, k*) are generated and output once in each frame.

In the case above, the modulation processing section 31 or 31*a* performs prediction-type grayscale transition emphasizing process. Alternatively, for example, the modulation processing section 31 may be constructed as a modulation processing section 31*e* shown in FIG. 44. This modulation processing section 31*e* is substantially identical with the modulation processing section 31 shown in FIG. 16, but the prediction processing section 53 is not provided, the frame memory 51 stores video data D (i, j, k) of the current frame FR (k) until the next frame FR (k+1) has come, in place of a predicted value E (i, j, k), and supplies video data D (i, j, k–1) stored in the previous frame FR (k–1) to the correction processing section 52, in place of a predicted value E (i, j, k–1). The correction processing section 52 corrects video data D (i, j, k) based on video data D (i, j, k–1) of the previous frame FR (k–1) and video data D (i, j, k) of the current frame FR (k), in such a way as to emphasize grayscale transition of both sets of data. In this case, the modulation processing section 31*e* assumes that the sub pixel SPIX (i, j) reaches to the luminance indicated by video data D (i, j, k) at the start of the next frame FR (k+1) on account of the drive based on video data D (i, j, k) of the current frame FR (k).

Figure 45:
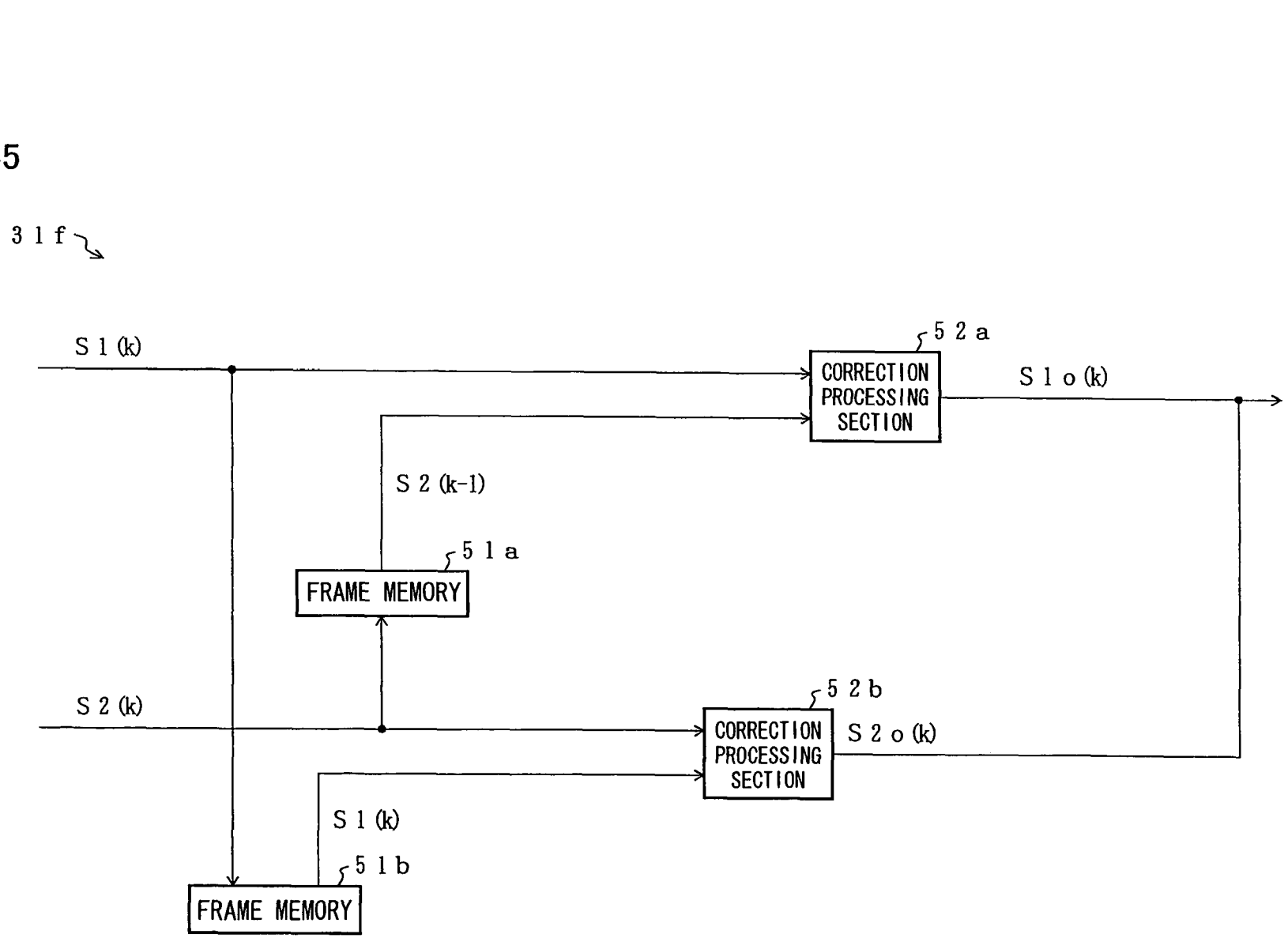
FIG. 45 relates to another variant example and is a block diagram showing the substantial part of the modulation processing section.

Similarly, the modulation processing section 31*a* may be constructed as a modulation processing section 31*f* as shown in FIG. 45. The modulation processing section 31*f* is substantially identical with the modulation processing section 31*b* shown in FIG. 40, but the prediction processing sections 53*a* and 53*b* are omitted, the frame memories 51*a* and 51*b* store sets of video data S1 (*i, j, k*) and S2 (*i, j, k*) until the next frame FR (k+1) has come, in place of predicted values E1 (*i, j, k*) and E2 (*i, j, k*), and the video data S1 (*i, j, k*–1) or S2 (*i, j, k*–1) which has been stored in the previous frame FR (k–1), is supplied to the correction processing section 52*a* or 53*b*, in place of the predicted values E1 (*i, j, k*–1) and E2 (*i, j, k*–1). The correction processing section 52*a* corrects video data S1 (*i, j, k*) based on video data S2 (*i, j, k*–1) of the previous frame FR (k–1) and video data S1 (*i, j, k*) of the current frame FR (k), in such a way as to emphasize grayscale transition thereof. Similarly, the correction processing section 52*b* corrects video data S2 (*i, j, k*) based on video data S1 (*i, j, k*–1) of the current frame FR (k) and video data S2 (*i, j, k*) of the current frame FR (k), in such a way as to emphasize grayscale transition thereof. In the case above, the modulation processing section 31*f* assumes that the sub pixel SPIX (i, j) reaches, at the start of the next sub frame SFR2 (*k*), the luminance indicated by the video data S1 (*i, j, k*), by the drive based on video data S1 (*i, j, k*) of the current frame FR (k). It is also assumed that, by the drive based on video data S2 (*i, j, k*) of the current frame FR (k), the sub frame SPIX (i, j) reaches to the luminance indicated by video data S2 (*i, j, k*) at the start of the next sub frame SFR1 (*k*+1).

Also in the arrangement above, it is possible to perform correction to emphasize grayscale transition in each sub pixel SPIX, with respect to video data D, video data S1, and video data S2. It is therefore possible to improve the response speed of each sub pixel SPIX by the grayscale transition emphasis and improve the quality of moving images on the pixel array 2 by simulating impulse-type light emission.

Furthermore, also in the arrangement above, video data S1 falling within the range for dark display indicates a dark grayscale which is not black. On this account, the speed to respond to intermediate luminance is significantly improved as compared to a case where all of sets of video data S1 and S2 for sub frames SFR1 and SFR2 indicate black when video data D indicates black, and hence the quality of moving images is significantly improved.

Moreover, in the arrangement above, the LUTs 42 and 43 of the sub frame processing section (32, 32*a*, 32*c*) store a parameter indicating gamma-converted video data of each sub frame, so that the LUTs 42 and 43 can function not only as the LUTs 542 and 543 for time-sharing drive but also as the LUT 533*a* for gamma conversion, shown in FIG. 15. As a result, the circuit size is reduced because of the omission of the LUT 533*a* for gamma conversion as compared to the arrangement shown in FIG. 15, and hence the circuit size required for the signal processing circuit is significantly reduced.

In the arrangement above, video data D is corrected in reference to video data D which has been input to the sub pixel SPIX (i, j), in such a way as to emphasize grayscale transition. Alternatively, the modulation processing section (31-31*f*) may be omitted. Also in this case, the circuit size required for the signal processing circuit 21 can be significantly reduced, on condition that the LUTs 42 and 43 of the sub frame processing section (32, 32*a*, 32*c*) store a parameter indicating gamma-converted video data of each sub frame.

In the arrangement above, since a frame is divided into sub frames, a faster response is required. However, when the response speed of a sub pixel SPIX is slow because it is, for example, a liquid crystal element, the requirement may not be satisfied. In such a case, the arrangement above, which is to improve a response speed of a sub pixel SPIX by emphasizing grayscale transition by providing a modulation processing section, is particularly effective.

In the arrangement above, in the pixel array 2, one pixel is constituted by sub pixels SPIX for respective colors, and hence color images can be displayed. However, effects similar to the above can be obtained even if the pixel array is a monochrome type.

In the arrangement above, the control circuit (44 and 44*c*) refers to the same LUT (42, 43) irrespective of changes in the circumstance of the image display device 1, an example of such changes is temperature change which causes temporal change in luminance of a pixel (sub pixel). Alternatively, the following arrangement may be adopted: plural LUTs corresponding to respective circumstances are provided, sensors for detecting circumstances of the image display device 1 are provided, and the control circuit determines, in accordance with the result of detection by the sensors, which LUT is referred to at the time of generation of video data for each sub frame. According to this arrangement, since video data for each sub frame can be changed in accordance with the circumstances, the display quality is maintained even if the circumstances change.

For example, the response characteristic and grayscale luminance characteristic of a liquid crystal panel change in accordance with an environmental temperature (temperature of an environment of the panel 11). For this reason, even if the same video signal DAT is supplied, an optimum value as video data for each sub frame is different in accordance with the environmental temperature.

Therefore, when the panel 11 is a liquid crystal panel, LUTs (42 and 43) suitable for respective temperature ranges which are different from each other are provided, a sensor for measuring the environmental temperature is provided, and the control circuit (44, 44*c*) switches the LUT to be referred to, in accordance with the result of the measurement of the environmental temperature by the sensor. With this, the signal processing section (21-21*f*) including the control circuit can generate a suitable video signal DAT2 even if the same video signal DAT is supplied, and send the generated video signal to the liquid crystal panel. On this account, image display with suitable luminance is possible in all envisioned temperature ranges (e.g. 0° C. to 65° C.).

In the arrangement above, the LUTs 42 and 43 store a gamma-converted value indicating video data of each sub frame so that the LUTs 42 and 43 function not only as the LUT 142 and 143 for time-sharing drive shown in FIG. 7 but also as the LUT 133*a* for gamma conversion. Alternatively, in place of the LUTs 42 and 43, LUTs 142 and 143 identical with those in FIG. 7 and a gamma correction circuit 133 may be provided. The gamma correction circuit 133 is unnecessary if gamma correction is unnecessary.

In the arrangement above, the sub frame processing section (32, 32*c*) mainly divides one frame into two sub frames. Alternatively, in case where video data (input video data) periodically supplied to a pixel indicates luminance lower than a predetermined threshold, the sub frame processing section may set at least one of sets of video data (S1*o* and S2*o*; S1 and S2) for each sub frame at a value indicating luminance falling within a predetermined range for dark display, and may control the time integral value of luminance of the pixel in each frame period by increasing or decreasing at least one of the sets of remaining video data for each sub frame. Also, when the input video data indicates luminance higher than the predetermined threshold, the sub frame processing section may set at least one of the sets of video data for each sub frame at a value indicating luminance falling within a predetermined range for light display, and may control the time integral value of luminance of the pixel in each frame period by increasing or decreasing at least one of the remaining video data for each sub frame.

By this arrangement, it is possible to provide, at least once in each frame period in most cases, a period in which luminance of the pixel is lower than those of other periods, and hence the quality of moving images is improved. In the case of light display, luminance of the pixel in the periods other than the light display period increases as the luminance indicated by input video data increases. On this account, it is possible to increase the time integral value of luminance of the pixel in the whole frame period as compared to a case where dark display is performed at least once in each frame period, and hence brighter image display is possible.

In the arrangement above, in a case of dark display, one of the aforesaid sets of output video data is set at a value indicating luminance for dark display. On this account, in the dark display period, it is possible to widen the range of viewing angles in which the luminance of the pixel falls within an allowable range. Similarly, in a case of light display, since one of the sets of output video data is set at a value indicating luminance for dark display, it is possible to widen the range of viewing angles in which the luminance of the pixel falls within an allowable range, in the dark display period. As a result, problems such as whitish appearance are restrained in comparison with a case where time-sharing drive is not carried out, and the range of viewing angles is widened.

Also, as described in the embodiments above, when the number of the pixel is more than one, the following arrangement may be adopted in addition to the arrangement above: in accordance with input video data for each pixel, the generation means generates, in each input cycle, predetermined sets of output video data supplied to each pixel, the correction means corrects the output video data for each pixel and stores a prediction result for each pixel in the prediction result storage section, the generation means generates, for each pixel, predetermined sets of output video data in each input cycle, the correction section reads out, for all pixels, prediction results for the respective pixels for the predetermined times in each input cycle, and among these prediction results and sets of output video data, for all pixels, at least one process of writing of the prediction result is thinned out from processes of prediction of luminance at the end and processes of storing the prediction result, which can be performed plural times in each input cycle.

In this arrangement, the number of sets of output video data generated in each input cycle is determined in advance, and the number of times the prediction results are read out in each input cycle is equal to the number of sets of output video data. On this account, based on the sets of output video data and the prediction results, it is possible to predict the luminance of the pixel at the end for plural times and store the prediction results. The number of the pixels is plural and the reading process and the generation process are performed for each pixel.

In the arrangement above, at least one process of writing of the prediction result is thinned out among the prediction processes and processes of storing prediction results which can be performed plural times in each input cycle.

Therefore, in comparison with the arrangement of no thin-out, it is possible to elongate the time interval of storing the prediction result of each pixel in the prediction result storage section, and hence the response speed that the prediction result storage section is required to have can be lowered.

An effect can be obtained by thinning out at least one writing process. A greater effect is obtained by reducing, for each pixel, the number of times of writing processes by the correction means to one in each input cycle.

Regardless of whether a writing process is thinned out or not, when the dark display period or light display period is provided, as described in the embodiments, in addition to the above, sets of video data for the remaining sub frames other than a particular one set of video data are preferably set at a value indicating luminance falling within a predetermined range for dark display or a value indicating luminance falling within a predetermined range for light display, and the time integral value of luminance of the pixel in one frame period is controlled by increasing or decreasing the particular set of video data.

According to this arrangement, among sets of video data for each sub frame, sets of video data other than the particular set of video data are set at a value indicating luminance falling within a predetermined range for dark display or a value indicating luminance falling within a predetermined range for light display. On this account, problems such as whitish appearance are restrained and the range of viewing angles is increased, as compared to a case where sets of video data for plural sub frames are set at values falling within neither of the ranges above.

Video data for each sub frame is preferably set so that the temporal barycentric position of the luminance of the sub pixel in one frame period is set so as to be close to the temporal central position of said one frame period.

More specifically, in the sub frame processing section (32, 32*c*), in a region where luminance indicated by input video data is lowest, a set of video data corresponding to a sub frame closest to the temporal central position of the frame period, among sub frames constituting one frame period, is selected as the particular set of video data, and the time integral value of luminance of the pixel in one frame period is controlled by increasing or decreasing the value of the particular set of video data.

As the luminance indicated by input video data gradually increases and the predetermined sets of video data falls the predetermined range for light display, the video data of that sub frame is set at a value falling within that range, and a set of video data which is closest to the temporal central position of the frame period, among the remaining sub frames, is selected as the particular set of video data, and the time integral value of luminance of the pixel in one frame period is controlled by increasing or decreasing the value of the particular set of video data. The selection of the sub frame corresponding to the particular set of video data is repeated each time the particular set of video data falls within the predetermined range for light display.

In the arrangement above, regardless of the luminance indicated by input video data, the temporal barycentric position of the luminance of the sub pixel in one frame period is set so as to be close to the temporal central position of said one frame period. It is therefore possible to prevent the following problem: on account of a variation in the temporal varycentric position, needless light or shade, which is not viewed in a still image, appears at the anterior end or the posterior end of a moving image, and hence the quality of moving images is deteriorated. The quality of moving images is therefore improved.

When the increase in the range of viewing angle is preferred to the reduction in the circuit size, the signal processing section (21-21*f*) preferably sets the time ratio of the sub frame periods in such a way as to cause a timing to switch a sub frame corresponding to the particular set of video data to be closer to a timing to equally divide a range of brightness that the pixel can attain than a timing to equally divide a range of luminance that the pixel can attain.

According to this arrangement, it is possible to determine in which sub frame the luminance to be mainly used for controlling the luminance in one frame period is attained, with appropriate brightness. On this account, it is possible to further reduce human-recognizable whitish appearance as compared to a case where the determination is made at a timing to equally dividing a range of luminance, and hence the range of viewing angles is further increased.

In the case above, the signal processing section corrects values (sets of video data So1, So2, S1*o*, S2*o*) of the video signal DAT2 supplied to the data signal line drive circuit 3 so as to attain a dark grayscale other than black in at least one sub frame period. This arrangement, however, is not always necessary.

Instead of correcting a video signal DAT2, the following arrangement may be adopted: the luminance in at least one sub frame periods is set at a dark grayscale other than black in such a manner that, for example, the data signal line drive circuit 3 controls a voltage applied to the sub pixel SPIX (i, j) in reference to the video signal DAT2.

More specifically, to drive a liquid crystal display device which drives a liquid crystal cell in a vertical alignment mode by a normally black mode, following steps may be performed: (i) in case where input video data which is input to a pixel of a liquid crystal panel indicates luminance lower than a predetermined threshold value, setting luminance of the pixel in at least one divided periods at luminance falling within a predetermined range for dark display, and controlling luminance of the pixel in the remaining divided periods so as to control a time integral value of luminance of the pixel in a unit period for drive based on the input video data, the divided periods being generated by dividing the unit period into plural periods; and (ii) in case where the input video data indicates luminance higher than the predetermined threshold value, setting luminance of the pixel in at least one of the divided periods at luminance falling within a predetermined range for light display, and controlling luminance of the pixel in the remaining divided periods so as to control a time integral value of luminance of the pixel in the unit period, in the step (i), luminance of the pixel being controlled so as to be luminance other than black, when the input video data indicates black.

According to this arrangement, being similar to the embodiments above, it is possible to provide in most cases at least one period in which luminance of the pixel is lower than that of other sub frame periods, in each frame period. On this account, the quality of moving images displayed on the liquid crystal display device can be improved. In a case of light display, as the luminance indicated by input data increases, the luminance of the pixel in periods other than the sub frame period (light display period) in which the luminance is set so as to fall within a predetermined range for light display increases. On this account, it is possible to realize the liquid crystal display device which can perform brighter display.

Furthermore, in the arrangement above, being similar to the embodiments above, when input video data indicates black, at least one of the sub frame periods is controlled to have luminance other than black. As a result, the speed to respond to intermediate luminance is significantly improved as compared to a case where all sub frame periods (=one frame period) are controlled to be black display when input image data indicates black, and hence the quality of moving images is significantly improved.

As a result, it is possible to realize a liquid crystal display device which is brighter, has a wider range of viewing angles, has a faster response speed, and produces moving images with better quality.

However, if, as in the embodiments above, the signal processing section corrects a video signal DAT2 (sets of video data So1 and So2; S1 and S2*o*) supplied to the data signal line drive circuit 3 so that luminance of at least one of sub frames is set at a dark grayscale other than black, it is unnecessary to change the data signal line drive circuit 3. On this account, the liquid crystal display device which is driven by the aforesaid drive method can be relatively easily realized.

In the embodiments above, the liquid crystal cell 111 is arranged as shown in FIG. 5 or 7 so that the alignment direction of liquid crystal molecules in the pixel is divided into four. An alternative arrangement, however, may be adopted.

For example, slits 123*b* may be provided in place of the protrusions 123*a* shown in FIG. 7, which are formed on the pixel electrodes 121*a*. Also, protrusions 123*a* may be formed in place of the slits 123*b* on the opposing electrode 121*b*. In any case, an oblique electric field is formed around the protrusion 123*a* or slit 123*b* when a voltage is applied, and liquid crystal molecules around the member (the protrusion 123*a* or slit 123*b*) are aligned in accordance with the electric field. Also, on account of the continuity of liquid crystal, the alignment direction of liquid crystal molecules away from that member is determined after the alignment direction in the region around the member is determined. Therefore, as in the case of FIGS. 5-7, a response speed from black display is slow. As a result, the effects of the embodiments above can be obtained when the liquid crystal cell with this arrangement is adopted as the liquid crystal cell of the pixel array 2.

Figure 47:
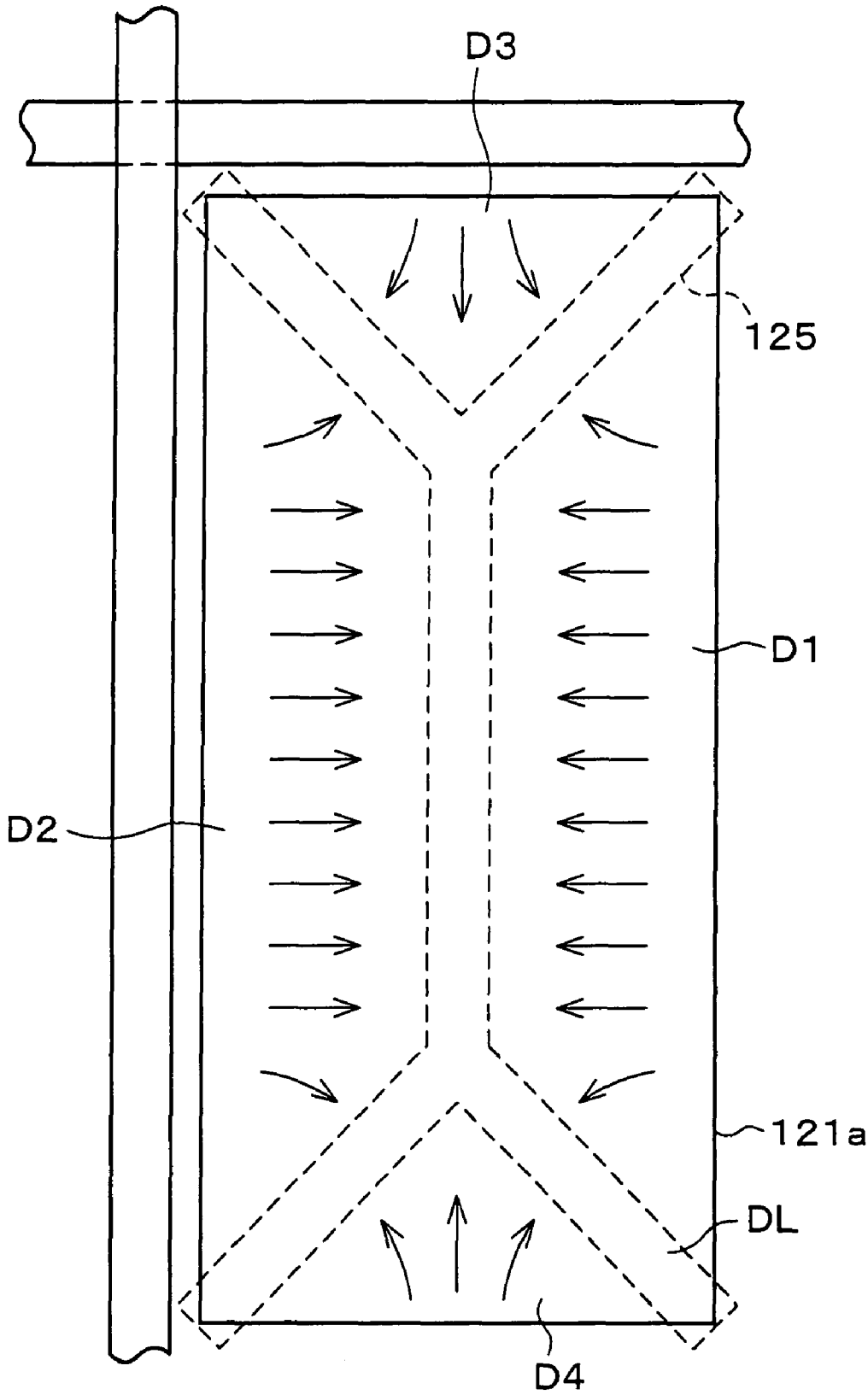
FIG. 47 relates to a further example of the liquid crystal cell and is a plan view showing the surrounding of a pixel electrode.

As another structure, in a liquid crystal cell adopting pixel electrodes 121*a* shown in FIG. 47, the protrusions 123*a* and slits 123*b* shown in FIG. 7 are omitted, and a quadrilateral protrusion 124 is provided on the pixel electrodes 121*a*. Being similar to the protrusions 123*a*, the quadrilateral protrusion 124 can be formed by applying photosensitive resin on the pixel electrodes 121*a* and performing photolithography.

Also in this arrangement, liquid crystal molecules are aligned so as to be orthogonal to each inclined surface, around the protrusion 124. When a voltage is applied, an electric field around the protrusion 124 is tilted towards the direction in parallel to the inclined surface of the protrusion 124. As a result, when a voltage is applied, an in-plane component of the alignment angle of liquid crystal molecules is identical with the in-plane component (direction P1, P2, P3, or P4) of the normal direction of the closest inclined surface. On this account, the pixel region is divided into four domains D1-D4 having different alignment directions when tilted. Furthermore, the alignment direction of liquid crystal molecules away from the protrusion 124 are determined by the continuity of liquid crystal, after the alignment direction of the liquid crystal molecules around the protrusion 124 is determined. On this account, as in the case of FIGS. 5-7, the response speed from black display is slow. As a result, effects similar to those of the embodiments above can be obtained even when the above-described liquid crystal cell is adopted as the liquid crystal cell of the pixel array 2.

For example, in a case of a large (e.g. 40 inches) liquid crystal television receiver, the size of each pixel is large (about 1 mm square). On this account, the alignment restraining force may be weak and alignment may be volatile, when only one protrusion 124 is provided in each pixel electrode 121*a*. Therefore, when the alignment restraining force may be insufficient, plural protrusions 124 are preferably provided on each pixel electrode 121*a*.

As shown in FIG. 47, the multi-domain alignment can also be realized by providing an alignment control window (where no electrode is formed) 125 which is arranged such that, on the opposing electrode 121*b* of the opposing substrate 111*b*, a Y-shaped slit is connected in a vertically symmetrical manner (in the direction in parallel to one of the sides of the pixel electrode 121*a* having a substantially square shape).

In this arrangement, on the surface of the opposing substrate 111*b*, in a region directly below the alignment control window 125, an electric field sufficient to tilt liquid crystal molecules is not formed in response to voltage application, and hence the liquid crystal molecules are vertically aligned. On the other hand, on the surface of the opposing substrate 111*b*, an electric field is formed in a region around the alignment control window 125. This electric field spreads toward the opposing substrate 111*b*, in such a way as to avoid the alignment window 125. The longitudinal axes of the liquid crystal molecules tilt toward the direction vertical to the electric field, and the in-plane components of the alignment directions of liquid crystal molecules become substantially vertical to each side of the alignment control window 125, as indicated by arrows in the figure.

Also in this arrangement, the alignment of liquid crystal molecules away from the alignment control window 125 is determined by the continuity of liquid crystal, after the alignment of liquid crystal molecules around the alignment control window 125 is determined. On this account, as in the case shown in FIGS. 5-7, the response speed from black display is slow. On this account, effects similar to those of the embodiments above are obtained when the aforesaid liquid crystal cell is adopted as the liquid crystal cell of the pixel array 2.

In the case above, liquid crystal molecules have four different orientations. Alternatively, as shown in FIGS. 48 and 49, similar effects are obtainable by adopting a liquid crystal cell 111 which is aligned in a radial pattern.

Figure 46:
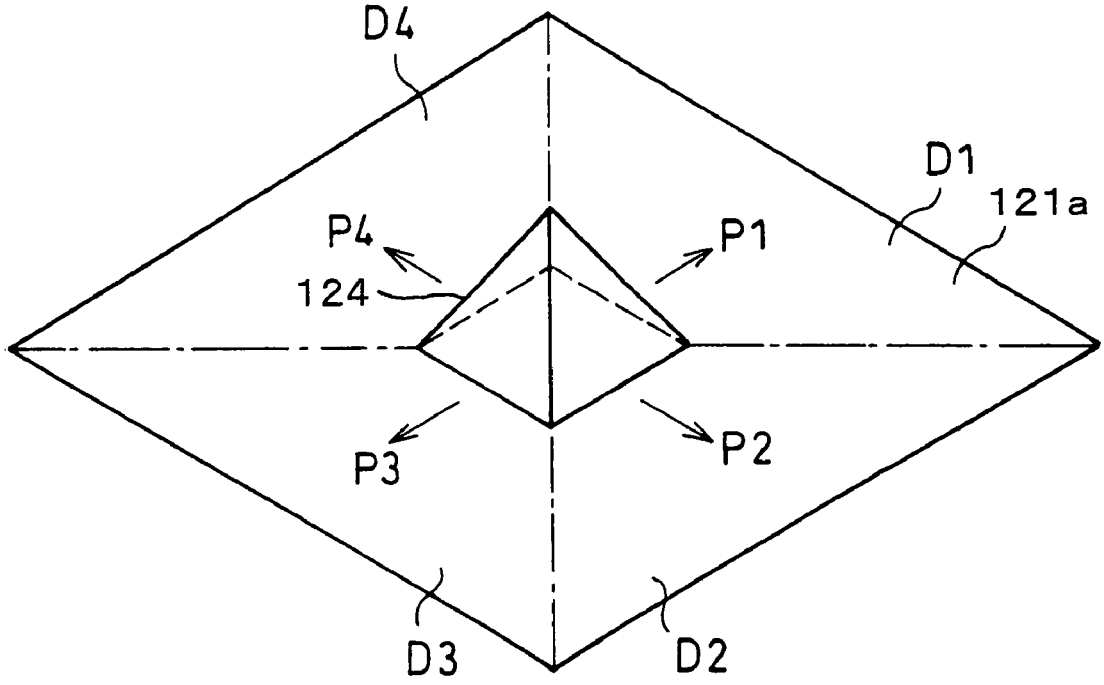
FIG. 46 relates to another example of the liquid crystal cell and is an oblique view showing a pixel electrode.
Figure 48:
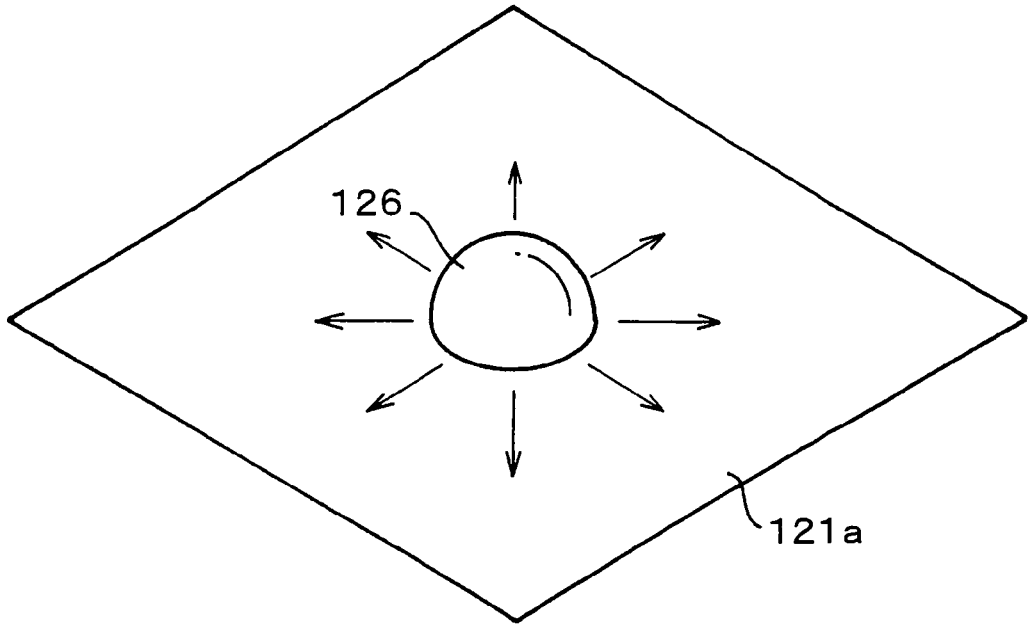
FIG. 48 shows yet another example of the liquid crystal cell and is an oblique view showing a pixel electrode.

More specifically, in the structure shown in FIG. 48, a protrusion 126 with a substantially semi-sphere shape is provided in place of the protrusion 124 shown in FIG. 46. Also in this case, around the protrusion 126, liquid crystal molecules are aligned to be vertical to the surface of the protrusion 126. When a voltage is applied, an electric field around the protrusion 126 tilts toward the direction in parallel to the surface of the protrusion 126. As a result, when a voltage is applied, liquid crystal molecules tend to tilt in a radial pattern in the in-plane direction from the protrusion 126, and hence the liquid crystal molecules in the liquid crystal cell 111 are obliquely aligned in a radial pattern. The protrusion 126 can be formed by similar steps as the formation of the protrusion 124. Also, being similar to the protrusion 124, plural protrusions 126 are preferably provided on each pixel electrode 121*a*, when the alignment restraining force is insufficient.

Also in this arrangement, the alignment of liquid crystal molecules away from the protrusion 126 is determined by the continuity of liquid crystal after the alignment of liquid crystal molecules around the protrusion 126 is determined, and as in the case of FIGS. 5-7, the response speed from black display is slow. As a result, effects similar to those of the embodiments above can be obtained when the aforesaid liquid crystal cell is adopted as the liquid crystal cell of the pixel array 2.

Figure 49:
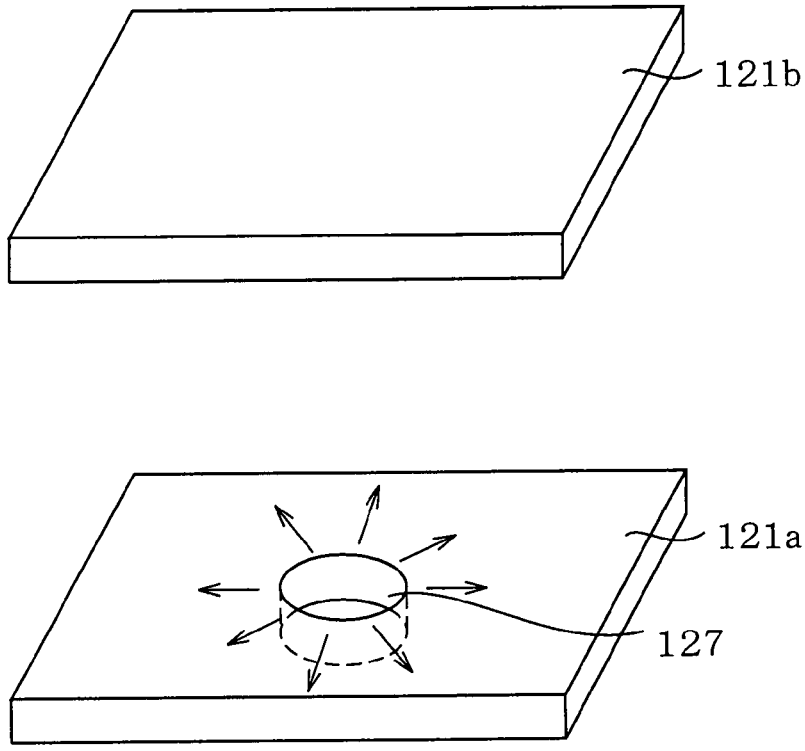
FIG. 49 shows still another example of the liquid crystal cell and is an oblique view showing a pixel electrode and an opposing electrode.

In the arrangement shown in FIG. 49, in place of the protrusion 124 shown in FIG. 46, a circular slit 127 is formed on the pixel electrode 121*a*. With this, when a voltage is applied, an electric field enough to tilt liquid crystal molecules is not formed in a region directly above the slit 127 on the surface of the pixel electrode 121*a*. Therefore, in this region, liquid crystal molecules are vertically aligned even when a voltage is applied. On the other hand, in a region around the slit 127 on the surface of the pixel electrode 121*a*, an electric field spreads so as to avoid the slit 127, towards the slit 127 in thickness direction. The longitudinal axes of the liquid crystal molecules tilt towards the vertical direction, and the liquid crystal molecules away from the slit 127 also tilt in a similar manner, on account of the continuity of liquid crystal. Therefore, when a voltage is applied to the pixel electrode 121*a*, the in-plane components of the alignment orientation spreads in a radial pattern from the slit 127, i.e. in axial symmetry centering on the center of the slit 127, as indicated by arrows in the figure. Since the tilt of the electric field changes in accordance with an applied voltage, the component, in parallel to the normal of the substrate, of the alignment orientation of the liquid crystal molecules (i.e. tilt angle) can be controlled by an applied voltage. As the applied voltage increases, the tilt angle with respect to the normal of the substrate increases, and the liquid crystal molecules are aligned to be substantially in parallel to the display screen and to be in a radial pattern in plane. Being similar to the protrusion 126, plural slits 127 are preferably provided on each pixel electrode 121*a*, in case where the alignment restraining force is insufficient.

Also in this arrangement, the alignment of liquid crystal molecules away from the slit 127 is determined by the continuity of liquid crystal after the alignment of liquid crystal molecules around the slit 127 is determined, and as in the case of FIGS. 5-7, the response speed from black display is slow. As a result, effects similar to those of the embodiments above can be obtained when the aforesaid liquid crystal cell is adopted as the liquid crystal cell of the pixel array 2.

In the pixel electrode 121*a*, a region (slit) where no electrode is formed may be replaced with a region where an electrode is formed. More specifically, in the pixel electrode 121*a* shown in FIG. 50, plural slits 128 are arranged so that the centers thereof form square lattice, and a central real part (hereinafter, unit central real part) 129, which is substantially enclosed by four slits 128 whose centers are on the respective four lattice points forming one unit lattice, has a substantially circle form. Each slit 128 has four edges each of which is a quarter circular arc, and is a substantially star-shaped with four rotation axes. The aforesaid pixel electrode 121*a* is also made of a conductive film (e.g. ITO film). The slits 128 are formed by, for example, after forming a conductive film, removing the conductive film so as to shape the slits 128 as above. While plural slits 128 are formed in each pixel electrode 121*a*, the central real part 129 is basically formed by a continuous single conductive film.

Also in this arrangement, when a voltage is applied to the pixel electrode 121*a*, an electric field tilted with respect to the surface of the substrate is formed in a region (edge region) around the border between the central real part 129 and the slit 128, and the liquid crystal molecules in the edge region tilt in accordance with the electric field. The alignment of the liquid crystal molecules away from the edge region is determined by the continuity of liquid crystal, after the alignment of the liquid crystal molecules around the slit 128 is determined. Therefore, as in the case of FIGS. 5-7, the response speed from black display is slow. As a result, effects similar to those of the embodiments above can be obtained when the aforesaid liquid crystal cell is adopted as the liquid crystal cell of the pixel array 2.

In the case above, the centers of the respective slits 128 are arranged so as to form square lattice. Alternatively, the shape of the lattice may be rectangle or the like. Also, although each of the slit 127 and the central real part 129 as described above has a substantially circular shape, each of these members may be, for example, elliptical-shaped or square-shaped.

In any case, effects similar to the above can be obtained on condition that a liquid crystal cell is arranged such that liquid crystal cells are vertically aligned when no voltage is applied, an oblique electric field is formed in a region (edge region) around the border between a part where an electrode is formed and a part where no electrode is formed, when a voltage is applied to the pixel electrode, and the alignment of liquid crystal molecules is determined by the electric field.

Figure 50:
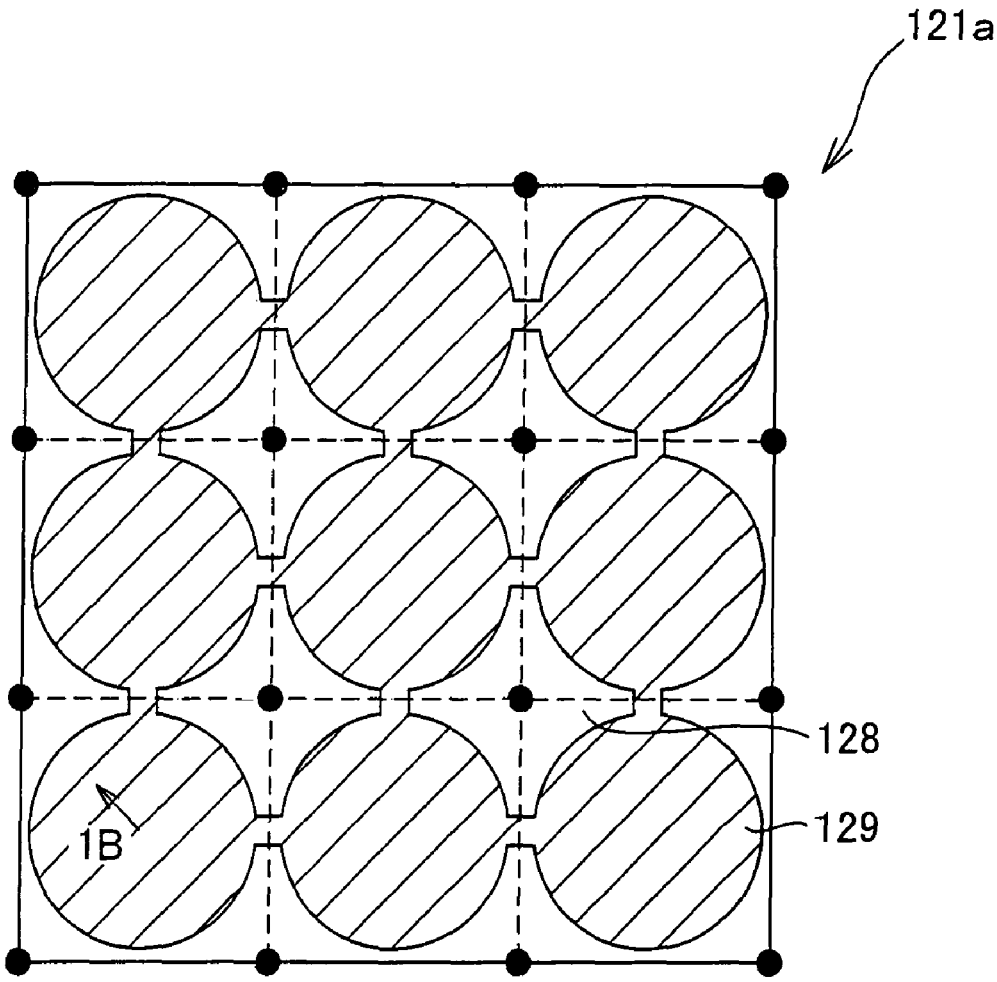
FIG. 50 shows still another example of the liquid crystal cell and is a plan view showing a pixel electrode.

However, as shown in FIG. 50, it is possible to realize an image display device 1 having better viewing angle characteristic when the centers of slits 128 form square lattice and each of central real parts 129 has a substantially circular shape, because the alignment orientations of liquid crystal molecules in a pixel PIX (i, j) are evenly dispersed.

In the embodiments above, the members constituting the signal processing circuit (21-21*f*) are hardware. Alternatively, at least one of the members may be realized by a combination of a program for realizing the aforesaid function and hardware (computer) executing the program. For example, the signal processing circuit may be realized as a device driver which is used when a computer connected to the image display device 1 drives the image display device 1. In case where the signal processing circuit is realized as a conversion circuit which is included in or externally connected to the image display device 1 and the operation of a circuit realizing the signal processing circuit can be rewritten by a program such as firmware, the software may be delivered as a storage medium storing the software or through a communication path, and the hardware may execute the software. With this, the hardware can operate as the signal processing circuit of the embodiments above.

In the cases above, the signal processing circuit of the embodiments above can be realized by only causing hardware capable of performing the aforesaid functions to execute the program.

More specifically, CPU or computing means constituted by hardware which can perform the aforesaid functions execute a program code stored in a storage device such as ROM and RAM, so as to control peripheral circuits such as an input/output circuit (not illustrated). In this manner, the signal processing circuit of the embodiments above can be realized.

In this case, the signal processing circuit can be realized by combining hardware performing a part of the process and the computing means which controls the hardware and executes a program code for remaining process. Among the aforesaid members, those members described as hardware may be realized by combining hardware performing a part of the process with the computing means which controls the hardware and execute a program code for remaining process. The computing means may be a single member, or plural computing means connected to each other by an internal bus or various communication paths may execute the program code in cooperation.

A program code which is directly executable by the computing means or a program as data which can generate the program code by a below-mentioned process such as decompression is stored in a storage medium and delivered or delivered through communication means for transmitting the program code or the program by a wired or wireless communication path, and the program or the program code is executed by the computing means.

To perform transmission via a communication path, transmission mediums constituting the transmission path transmit a series of signals indicating a program, so that the program is transmitted via the communication path. To transmit a series of signals, a sending device may superimpose the series of signals indicating the program to a carrier wave by modulating the carrier wave by the series of signals. In this case, a receiving device demodulates the carrier wave so that the series of signals is restored. In the meanwhile, to transmit the series of signals, the sending device may divide the series of signals, which are series of digital data, into packets. In this case, the receiving device connects the supplied packets so as to restore the series of signals. Also, to send a series of signals, the sending device may multiplex the series of signals with another series of signals by time-sharing, frequency-division, code-division, or the like. In this case, the receiving device extracts each series of signals from the multiplexed series of signals and restore each series of signals. In any case, effects similar to the above can be obtained when a program can be sent through a communication path.

A storage medium for delivering the program is preferable detachable, but a storage medium after the delivery of the program is not required to be detachable. As long as the program is stored, the storage medium may be or may not be rewritable, may be or may not be volatile, can adopt any recording method, any can have any shape. Examples of the storage medium are a tape, such as a magnetic tape and a cassette tape; a magnetic disk, such as a flexible disk and a hard disk; a disc including an optical disc, such as a CD-ROM/MO/MD/DVD; a card, such as an IC card; and a semiconductor memory, such as a mask ROM, an EPROM (Erasable Programmable Read Only Memory), an EEPROM (Electrically Erasable Programmable Read Only Memory), or a flash ROM. Also, the storage medium may be a memory formed in computing means such as a CPU.

The program code may instruct the computing means to execute all procedures of each process. Alternatively, if a basic program (e.g. operation system and library) which can execute at least a part of the processes by performing calling by a predetermined procedure has already existed, at least a part of the procedures may be replaced with a code or a pointer which instructs the computing means to call the basic program.

The format of a program stored in the storage medium may be a storage format which allows the computing means to access and execute the program, as in the case of real memory, may be a storage format before being stored in real memory and after being installed in a local storage medium (e.g. real memory or a hard disc) to which the computing means can always access, or may be a storage format before being installed from a network or a portable storage medium to the local storage medium. The program is not limited to a compiled object code. Therefore the program may be stored as a source code or an intermediate code generated in the midst of interpretation or compilation. In any case, effects similar to the above can be obtained regardless of the format for storing a program in a storage medium, on condition that the format can be converted to a format that the computing means is executable, by means of decompression of compressed information, demodulation of modulated information, interpretation, completion, linking, placement in real memory, or a combination of these processes.

INDUSTRIAL APPLICABILITY

According to the present invention, when input video data indicates black, luminance which is not black is attained in at least one of divided periods. On this account, it is possible to provide a liquid crystal display device which is brighter, has a wider range of viewing angles, has a faster response speed, and has better moving image quality. On this account, the present invention can be suitably and widely used as a driver of various liquid crystal display devices such as a liquid crystal television receiver and a liquid crystal monitor.

The invention claimed is:

1. A drive method of a liquid crystal display device which drives a liquid crystal cell in a vertical alignment mode by a normally black mode, the method comprising the step of:

(i) generating plural sets of output video data supplied to a pixel, in response to each input cycle of inputting input video data to the pixel, said plural sets of output video data being generated for driving the pixel in a lime-sharing fashion, the step (i) including the sub steps of:

(I) in case where the input video data indicates luminance lower than a threshold, setting luminance of at least one of said plural sets of output video data to be at a value within a luminance range for dark display, and controlling a time integral value of the luminance of the pixel in periods in which the pixel is driven based on said plural sets of output video data, by increasing or decreasing luminance of at least one of remaining sets of output video data; and (II) in case where the input video data indicates luminance higher than the threshold, setting at least one of said plural sets of output video data to be at a value within a luminance range for light display, and controlling a time integral value of the luminance of the pixel in periods in which the pixel is driven based on said plural sets of output video data, by increasing or decreasing luminance of at least one of the remaining sets of output video data, in the sub step (I), at least one of said plural sets of output video data indicating luminance other than black, when the input video data indicates black, the luminance other than black being less than or equal to about 3% of a maximum luminance for light display.

2. A drive method of a liquid crystal display device which drives a liquid crystal cell in a vertical alignment mode by a normally black mode, the method comprising the steps of:

(i) in case where input video data which is input to a pixel of a liquid crystal panel indicates luminance lower than a threshold value, setting luminance of the pixel in at least one divided period at luminance falling within a range for dark display, and controlling luminance of the pixel in remaining divided periods so as to control a time integral value of luminance of the pixel in a unit period for drive based on the input video data, the divided periods being generated by dividing the unit period into plural periods; and (ii) in case where the input video data indicates luminance higher than the threshold value, setting luminance of the pixel in at least one of the divided periods at luminance falling within a range for light display, and controlling luminance of the pixel in the remaining divided periods so as to control a time integral value of luminance of the pixel in the unit period, in the step (i), in at least one of said divided periods, luminance of the pixel being controlled so as to be luminance other than black, when the input video data indicates black, the luminance other than black being less than or equal to about 3% of a maximum luminance for light display.

3. A driver of a liquid crystal display device which drives a liquid crystal cell in a vertical alignment mode by a normally black mode, the driver comprising:

generation means for generating plural sets of output video data supplied to a pixel and corresponding to respective input cycles, in response to each of the input cycles of inputting input video data to the pixel, said plural sets of output video data being generated for driving the pixel in a time-sharing fashion, the generation means performing control so as to:

(i) in case where the input video data indicates luminance lower than a threshold, set luminance of at least one of said plural sets of output video data at a value within a luminance range for dark display, and control a time integral value of the luminance of the pixel in periods in which the pixel is driven based on said plural sets of output video data, by increasing or decreasing luminance of at least one of remaining sets of output video data; and (ii) in case where the input video data indicates luminance higher than the threshold, set luminance of at least one of said plural sets of output video data at a value within a luminance range for light display, and control a time integral value of the luminance of the pixel in periods in which the pixel is driven based on said plural sets of output video data, by increasing or decreasing luminance of at least one of the remaining sets of output video data, and the generation means setting at least one of said plural sets of output video data at a value indicating luminance other than black, when the input video data indicates black, the luminance other than black being less than or equal to about 3% of a maximum luminance for light display.

4. The driver as defined in claim 3, wherein, the generation means sets at least two of said plural sets of output video data at different values, when the input video data indicates black.

5. The driver as defined in claim 3, wherein, the value within the range for dark display is a value indicating a color which is not black.

6. The driver as defined in claim in claim 3, wherein, when the input video data indicates black, the generation means sets, among said plural sets of output video data, a set of output video data of a last period among periods in which the pixel is driven based on said plural sets of output video data is set at a value indicating luminance other than black.

7. The driver as defined in claim 3, wherein, the generation means controls the time integral value by increasing or decreasing output video data which is one of the remaining sets of output video data, and sets the remaining sets of output video data other than the output video data at either a value indicating luminance falling within the range for dark display or a value indicating luminance falling within the range for light display.

8. The driver as defined in claim 7, wherein, provided that the periods in which the pixel is driven by said plural sets of output video data are divided periods whereas a period constituted by the divided periods and in which the pixel is driven by said plural sets of output video data is a unit period, the generation means selects, as the output video data, a set of output video data corresponding to a divided period which is closest to a temporal central position of the unit period, among the divided periods, in a region where luminance indicated by the input video data is lowest, and when luminance indicated by the input video data gradually increases and hence the output video data enters the range for light display, the generation means sets the set of video data in that divided period at a value falling within the range for light display, and selects, as new output video data, a set of output video data in a divided period which is closest to the temporal central position of the unit period, among remaining divided periods.

9. The driver as defined in claim 7, wherein, a ratio between the periods in which the pixel is driven based on said plural sets of output video data is set so that a timing to determine which set of output video data is selected as the output video data is closer to a timing at which a range of brightness that the pixel can reproduce is equally divided than a timing at which luminance that the pixel can reproduce is equally divided.

10. The drive as defined in claim 3, comprising:

correction means, which is provided prior to or subsequent to the generation means, corrects correction target data which is either the input video data or said plural output video data, and predicts luminance at which the pixel reaches at the end of a drive period of the correction target data, the drive period being a period in which the pixel is driven based on the corrected correction target data, the correction means correcting correction target data of a present time based on a prediction result, among past prediction results, which indicates luminance that the pixel reaches at the beginning of a drive period of the correction target data of the present time, and predicts luminance at the end of the drive period of the correction target data of the present time, at least based on the correction target data of the present time, among the past prediction results, past correction target data, and the correction target data of the present time.

11. A liquid crystal display device, comprising:

the driver defined in claim 3; and a liquid crystal display device driven by that driver.

12. A liquid crystal display device comprising:

a liquid crystal cell in a vertical alignment mode; and a driver which is driven by a normally black mode, the driver performing control so as to:

(i) in a case where input video data which is input to a pixel of a liquid crystal panel indicates luminance lower than a threshold value, set luminance of at least one divided periods at luminance falling within a range for dark display, and control luminance of the pixel in remaining divided periods so as to control a time integral value of luminance of the pixel in a unit period for drive based on the input video data, the divided periods being generated by dividing the unit period into plural periods; and (ii) in a case where the input video data indicates luminance higher than the threshold value, set luminance of the pixel in at least one of the divided periods at luminance falling within a range for light display, and control luminance of the pixel in the remaining divided periods so as to control a time integral value of luminance of the pixel in the unit period, in (i), in at least one of said divided periods, luminance of the pixel being controlled so as to be luminance other than black, when the input video data indicates black, the luminance other than black being less than or equal to about 3% of a maximum luminance for light display.

13. The liquid crystal display device as defined in claim 12, wherein, the driver controls the time integral value by increasing or decreasing luminance in a divided period which is one of the remaining divided periods, and sets luminance in the divided periods other than the divided periods either at a value indicating luminance falling within the range for dark display or at a value indicating luminance falling within the range for light display.

14. The liquid crystal display device as defined in claim 13, wherein, in a region where the luminance indicated by the input video data is lowest, the driver selects, as the divided period, a divided period which is closest to a temporal central position of the unit period, among the divided periods, and when luminance indicated by the input video data gradually increases and hence the luminance of the divided period enters the range for light display, the driver sets the luminance of the divided period at a value falling within the range for light display, and selects, as new divided period, a divided period which is closest to the temporal central position of the unit period, among the remaining divided period.

15. The liquid crystal display device as defined in claim 13, wherein, a ratio between the divided periods is set so that a timing to determine which divided period is selected as the divided period is closer to a timing at which a range of brightness that the pixel can reproduce is equally divided than a timing at which luminance that the pixel can reproduce is equally divided.

16. The liquid crystal display device as defined in claim 11, further comprising:

image receiving means which receives television broadcast and sends, to the driver of the liquid crystal display device, a video signal indicating an image transmitted by the television broadcast, the liquid crystal display device functioning as a liquid crystal television receiver.

17. The liquid crystal display device as defined in claim 11, wherein, the driver of the liquid crystal display device receives a video signal from outside, and the liquid crystal display device functions as a liquid crystal monitor device which displays an image indicated by the video signal.

18. A program which causes a computer, which controls a liquid crystal display device including a liquid crystal cell which is in a vertical alignment mode and driven by a normally black mode, to execute the steps defined in claim 1.

19. A tangible, computer readable storage medium, storing the program defined in claim 18.

20. The liquid crystal display device as defined in claim 12, further comprising:

image receiving means which receives television broadcast and sends, to the driver of the liquid crystal display device, a video signal indicating an image transmitted by the television broadcast, the liquid crystal display device functioning as a liquid crystal television receiver.

21. The liquid crystal display device as defined in claim 12, wherein, the driver of the liquid crystal display device receives a video signal from outside, and the liquid crystal display device functions as a liquid crystal monitor device which displays an image indicated by the video signal.

22. A program which causes a computer, which controls a liquid crystal display device including a liquid crystal cell which is in a vertical alignment mode and driven by a normally black mode, to execute the steps defined in claim 2.

23. A tangible, computer readable storage medium, storing the program defined in claim 22.

24. The drive method of claim 1, wherein the luminance other than black is less than or equal to about 1% of the maximum luminance for light display.

25. The drive method of claim 1, wherein the maximum luminance for light display is white and black is a minimum luminance for dark display.

26. The drive method of claim 2, wherein the luminance other than black is less than or equal to about 1% of the maximum luminance for light display.

27. The drive method of claim 2, wherein the maximum luminance for light display is white and black is a minimum luminance for dark display.

28. The driver of claim 3, wherein the luminance other than black is less than or equal to about 1% of the maximum luminance for light display.

29. The drive method of claim 3, wherein the maximum luminance for light display is white and black is a minimum luminance for dark display.

30. The liquid crystal display device of claim 12, wherein the luminance other than black is less than or equal to about 1% of the maximum luminance for light display.

31. The liquid crystal display device of claim 12, wherein the maximum luminance for light display is white and black is a minimum luminance for dark display.

* * * * *